US008281766B2

(12) United States Patent
Tomiita et al.

(10) Patent No.: US 8,281,766 B2
(45) Date of Patent: Oct. 9, 2012

(54) MOUNT STRUCTURE OF FUEL INJECTION VALVE AND FUEL INJECTION SYSTEM

(75) Inventors: Yukio Tomiita, Anjo (JP); Hidekazu Oomura, Hekinan (JP); Fumiaki Aoki, Nishio (JP); Yoshinori Yamashita, Kariya (JP); Takanori Suzuki, Nishio (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 12/662,603

(22) Filed: Apr. 26, 2010

(65) Prior Publication Data

US 2010/0250100 A1 Sep. 30, 2010

Related U.S. Application Data

(62) Division of application No. 12/064,968, filed as application No. PCT/JP2007/056315 on Mar. 27, 2007.

(30) Foreign Application Priority Data

| | | |
|---|---|---|
| Mar. 29, 2006 | (JP) | 2006-089704 |
| Mar. 29, 2006 | (JP) | 2006-089711 |
| Mar. 29, 2006 | (JP) | 2006-089715 |
| May 16, 2006 | (JP) | 2006-136467 |
| Mar. 19, 2007 | (JP) | 2007-070191 |

(51) Int. Cl.
*F02B 15/00* (2006.01)

(52) U.S. Cl. ..... 123/432; 701/103

(58) Field of Classification Search ..... 123/432, 123/470, 90.15, 304, 308, 345–348, 429, 123/431

See application file for complete search history.

(56) References Cited

U.S. PATENT DOCUMENTS 3,995,609 A 12/1976 Klomp (Continued)

FOREIGN PATENT DOCUMENTS

JP 63-7260 2/1988

(Continued)

OTHER PUBLICATIONS

Machine translation of Kashima (JP 2005180285 A), named "JP2005180285_MT".*

(Continued)

*Primary Examiner* — Mahmoud Gimie
*Assistant Examiner* — David Hamaoui
(74) *Attorney, Agent, or Firm* — Nixon & Vanderhye PC

(57) ABSTRACT

A combustion chamber side end portion of a fuel injection valve is placed at a location that overlaps with an imaginary plane, which is perpendicular to a center axis of a cylinder and extends along a portion of a wall surface of an intake port where an intake valve protrudes, or is projected out from the imaginary plane toward a combustion chamber. Alternatively, a center of a fuel injecting side end port of the fuel injection valve, which injects fuel into intake air that flows in a branch port branched from the intake port, may be placed on the center axis side of the intake valve in a radial direction of the cylinder. Further alternatively, an upstream side fuel injection valve may inject fuel into intake air that flows in the intake port, and a downstream side fuel injection valve may inject fuel into intake air that flows in the branch port branched from the intake port. Alternatively, an injection quantity of fuel may be controlled for each of fuel injection valves, which injects fuel into intake air that flows in the corresponding branch port branched from the intake port.

6 Claims, 22 Drawing Sheets

U.S. PATENT DOCUMENTS

| | | | | | |
|---|---|---|---|---|---|
| 4,200,067 | A | | 4/1980 | Trenne | |
| 4,270,500 | A | * | 6/1981 | Nakagawa et al. | 123/308 |
| 4,494,504 | A | * | 1/1985 | Yagi et al. | 123/308 |
| 4,548,175 | A | * | 10/1985 | Kawai et al. | 123/308 |
| 4,671,233 | A | | 6/1987 | Iwashita et al. | |
| 4,726,343 | A | * | 2/1988 | Kruger | 123/432 |
| 4,779,594 | A | | 10/1988 | Oda et al. | |
| 5,027,778 | A | * | 7/1991 | Nogi et al. | 123/472 |
| 5,050,557 | A | * | 9/1991 | Ishida et al. | 123/432 |
| 5,081,971 | A | | 1/1992 | Inoue et al. | |
| 5,168,839 | A | * | 12/1992 | Hitomi et al. | 123/184.42 |
| 5,174,260 | A | * | 12/1992 | Nonogawa et al. | 123/432 |
| 5,220,899 | A | | 6/1993 | Ikebe et al. | |
| 5,237,973 | A | * | 8/1993 | Oda | 123/432 |
| 5,259,348 | A | * | 11/1993 | Kobayashi et al. | 123/260 |
| 5,284,117 | A | | 2/1994 | Akase | |
| 5,291,865 | A | | 3/1994 | Sasaki | |
| 5,357,925 | A | | 10/1994 | Sasaki | |
| 5,463,995 | A | | 11/1995 | Sakai et al. | |
| 5,524,591 | A | | 6/1996 | Hirota et al. | |
| 5,553,580 | A | * | 9/1996 | Ganoung | 123/308 |
| 5,685,276 | A | * | 11/1997 | Tanaka et al. | 123/478 |
| 5,829,408 | A | * | 11/1998 | Yamaguchi et al. | 123/308 |
| 6,032,652 | A | * | 3/2000 | Nozawa et al. | 123/478 |
| 6,055,948 | A | * | 5/2000 | Shiraishi et al. | 123/90.15 |
| 6,161,780 | A | | 12/2000 | Sugimoto et al. | |
| 6,253,737 | B1 | * | 7/2001 | Radue | 123/499 |
| 6,308,684 | B1 | | 10/2001 | Konishi | |
| 6,386,161 | B2 | | 5/2002 | Pierik | |
| 6,499,469 | B2 | | 12/2002 | Ogawa et al. | |
| 6,609,499 | B2 | * | 8/2003 | Kabat et al. | 123/432 |
| 6,659,054 | B2 | | 12/2003 | Sugiyama et al. | |
| 6,681,741 | B2 | | 1/2004 | Majima et al. | |
| 6,722,344 | B2 | * | 4/2004 | Ashida et al. | 123/432 |
| 6,742,495 | B2 | * | 6/2004 | Ashida et al. | 123/310 |
| 6,854,432 | B2 | | 2/2005 | Hirano | |
| 6,854,448 | B2 | * | 2/2005 | Okamoto et al. | 123/470 |
| 6,892,696 | B2 | | 5/2005 | Tsukui | |
| 6,990,968 | B2 | | 1/2006 | Nagaishi et al. | |
| 7,013,875 | B2 | | 3/2006 | Saruwatari | |
| 7,096,835 | B2 | | 8/2006 | Fujita et al. | |
| 7,195,000 | B2 | * | 3/2007 | Kayama et al. | 123/432 |
| 7,216,626 | B2 | * | 5/2007 | Araki et al. | 123/406.47 |
| 7,240,664 | B2 | | 7/2007 | Yoshida et al. | |
| 7,415,966 | B2 | | 8/2008 | Irisawa | |
| 7,484,495 | B2 | * | 2/2009 | Kamio et al. | 123/304 |
| 7,574,982 | B2 | * | 8/2009 | Blackburn | 123/21 |
| 7,608,011 | B2 | * | 10/2009 | Grabowski et al. | 477/5 |
| 7,942,129 | B2 | * | 5/2011 | Pagot et al. | 123/432 |
| 2002/0017256 | A1 | | 2/2002 | Shiraishi et al. | |
| 2004/0164187 | A1 | | 8/2004 | Kihara et al. | |
| 2005/0126526 | A1 | | 6/2005 | Fujita et al. | |
| 2007/0215110 | A1 | * | 9/2007 | Stein et al. | 123/431 |
| 2009/0084339 | A1 | * | 4/2009 | Oomura et al. | 123/193.2 |
| 2009/0241904 | A1 | * | 10/2009 | Sugiyama et al. | 123/468 |
| 2009/0241905 | A1 | * | 10/2009 | Tomiita et al. | 123/470 |
| 2009/0248275 | A1 | * | 10/2009 | Ichihara et al. | 701/103 |

FOREIGN PATENT DOCUMENTS

| | | | | |
|---|---|---|---|---|
| JP | 1-173467 | | | 12/1989 |
| JP | 04-013415 | | | 3/1992 |
| JP | Y2-4-13415 | | | 3/1992 |
| JP | 5-26286 | | | 7/1993 |
| JP | H5-223040 | | | 8/1993 |
| JP | 06-031174 | | | 8/1994 |
| JP | Y2-6-31174 | | | 8/1994 |
| JP | 06-249109 | | | 9/1994 |
| JP | 07-332208 | | | 12/1995 |
| JP | 08-218986 | | | 8/1996 |
| JP | 10-073061 | | | 3/1998 |
| JP | 2809558 | | | 7/1998 |
| JP | 11-107890 | | | 4/1999 |
| JP | 3071255 | | | 5/2000 |
| JP | 2001-159322 | | | 6/2001 |
| JP | 2001-193553 | | | 7/2001 |
| JP | 2003-013741 | | | 1/2003 |
| JP | 2003-262174 | | | 9/2003 |
| JP | 2003-262175 | | | 9/2003 |
| JP | 2003262174 | A | * | 9/2003 |
| JP | 2004-353463 | | | 12/2004 |
| JP | 2005-098231 | | | 4/2005 |
| JP | 2005-180285 | | | 7/2005 |
| JP | 2005-220885 | | | 8/2005 |
| JP | 3690824 | | | 8/2005 |
| JP | 2006-125333 | | | 5/2006 |
| JP | 2007-262995 | | | 10/2007 |
| WO | 97/13063 | A | | 4/1997 |

OTHER PUBLICATIONS

Japanese Office Action dated Feb. 12, 2010, issued in corresponding Japanese Application No. 2006-089715, with English translation.
Chinese Office Action dated Dec. 4, 2009, issued in corresponding Chinese Application No. 200780001505.8, with English translation.
Japanese Office Action dated Oct. 5, 2009, issued in corresponding Japanese Application No. 2006-089704, with English translation.
Japanese Office Action dated Oct. 5, 2009, issued in corresponding Japanese Application No. 2006-089715, with English translation.
Japanese Office Action dated Oct. 5, 2009, issued in corresponding Japanese Application No. 2006-136467, with English translation.
U.S. Appl. No. 12/238,802, Oomura et al., filed Sep. 26, 2008.
Advisory Action dated Jan. 4, 2011, issued in copending U.S. Appl. No. 12/064,968 of Tomiita, filed Feb. 27, 2008.
Official Action dated Sep. 14, 2010 issued in co-pending U.S. Appl. No. 12/064,968 of Tomiita, filed Feb. 27, 2008.
Japanese Office Action dated Nov. 30, 2010, issued in corresponding Japanese Application No. 2006-89704 with English Translation.
Office Action dated Feb. 15, 2011, issued in copending U.S. Appl. No. 12/064,968 of Tomiita, filed Feb. 27, 2008.
Tomiita, final Office Action dated Aug. 16, 2011, issued in co-pending Appl. No. 12/064,968, filed Feb. 27, 2008.
Japanese Office Action dated Oct. 25, 2011, issued in corresponding Japanese Application No. 2010-208810, with English translation.
Japanese Office Action dated Oct. 25, 2011, issued in corresponding Japanese Application No. 2010-208811, with English translation.

* cited by examiner

MOUNT STRUCTURE OF FUEL INJECTION VALVE AND FUEL INJECTION SYSTEM

CROSS-REFERENCE TO RELATED APPLICATIONS

This application is a Division of application Ser. No. 12/064,968, filed Feb. 27, 2008, which is the U.S. National phase of International Application No. PCT/JP2007/056315, filed 27 Mar. 2007, which designated the US and claims priority from Japanese patent application No. 2006-89704 filed on Mar. 29, 2006, No. 2006-89711 filed on Mar. 29, 2006, No. 2006-89715 filed on Mar. 29, 2006, No. 2006-136467 filed on May 16, 2006, and No. 2007-70191 filed on Mar. 19, 2007, the contents of each of which are incorporated herein by reference.

TECHNICAL FIELD

The present invention relates to a mount structure of a fuel injection valve that injects fuel into intake air to be drawn into an internal combustion engine, and to a fuel injection system.

BACKGROUND ART

In JP-2004-225598-A and its associated US-2004/0164187-A1 and DE-2004003361-A1, disclosed is a fuel injection system, which is used with an internal combustion engine (hereinafter simply referred to as "engine") including a plurality of branch ports per one combustion chamber, for injecting fuel into intake air flowing through each branch port. According to a technique disclosed in JP-2004-225598-A and its associated US-2004/0164187-A1 and DE-2004003361-A1, two jets of fuel mist formed by the fuel injection valve are distributed to two branch ports. As such, the fuel injection valve forms two jets of fuel mist, thereby allowing the fuel to be less adhered to the wall portion which provides a partition between the two branch ports.

However, according to the technique disclosed in JP-2004-225598-A and its associated US-2004/0164187-A1 and DE-2004003361-A1, the fuel injection valve is installed in the branch port away from the combustion chamber. Accordingly, depending on the shape of the branch port, the fuel injected from the fuel injection valve may possibly adhere to the wall surface which forms the branch port. Furthermore, in a fuel injection system with one combustion chamber communicating with a plurality of intake ports, the fuel injection valve may be installed upstream of the branch point of the intake ports. In this case, the fuel injected from the fuel injection valve adheres to the partition wall installed in between the intake ports. As such, the fuel having adhered to the wall surface which forms the intake port flows into the combustion chamber without being sufficiently atomized. The insufficiently atomized fuel is not burned in the combustion chamber, and thus emitted from the engine as uncombusted hydrocarbon (HC). This leads to an increase in uncombusted HC in the exhaust gas and degradation in fuel consumption.

In this context, to prevent fuel from adhering to the wall surface which forms the branch port, the fuel injection valve may be conceivably installed in each intake port. On the other hand, the intake air distributed to an intake port further flows into the combustion chamber by way of a branch port. Accordingly, the flow quantity of the intake air flowing through the branch port is reduced. As such, to install a fuel injection valve in each branch port, the amount of fuel injected from the fuel injection valve needs to be reduced corresponding to the low flow quantity of intake air in order to facilitate the atomization of fuel. However, a reduction in the amount of fuel injected from each fuel injection valve installed in the intake port does not suffice the flow quantity of fuel required to increase the output of the engine.

Furthermore, as disclosed in JP-2003-262174-A, JP-2003-262175-A, and JP-2004-232463-A, the port injection type fuel injection system is designed such that the fuel injection valve is installed on the center axis of an intake valve for opening and closing the end opposing the combustion chamber.

In an engine with a plurality of intake valves, the end portion of the intake port opposing the combustion chamber is branched into two or more branch ports corresponding to each intake valve. Thus, when a fuel injection valve is installed in each of the branch ports branched from the intake port, the fuel injected from the fuel injection valve is biased due to the intake air flowing through the branch port.

For example, when one intake port is branched into two branch ports, the branch ports are branched from the intake port generally in the shape of a letter "Y" and curved toward the inner peripheral wall of the housing which forms the cylinder. Accordingly, the intake air flowing into the combustion chamber from the intake port by way of the branch port is formed closer to the inner peripheral wall of the cylinder. As a result, when fuel is injected from the fuel injection valve installed on the center axis of the intake valve, the fuel mist is carried on the intake air flowing through the branch port toward the inner peripheral wall. As such, the fuel injected from the fuel injection valve may readily adhere to the inner peripheral wall of the housing which forms the cylinder.

The fuel having adhered to the inner peripheral wall of the housing takes the form of droplets to be emitted out of the engine as uncombusted hydrocarbon without contributing to combustion in the combustion chamber. This may possibly cause an increase in hydrocarbon emitted from the engine and degradation in fuel consumption.

Also disclosed in JP-2000-234579-A and its associated U.S. Pat. No. 6,308,684 B1 is a fuel injection system, which is used with an engine including a plurality of intake ports per one combustion chamber, for injecting fuel into intake air flowing through each intake port. In the case of this technique, two jets of fuel mist formed by the fuel injection valve are distributed to the two intake ports. As such, the fuel injection valve forms two jets of fuel mist, thereby allowing the fuel to be less adhered to the wall portion which provides a partition between the two intake ports.

When two or more intake ports are in communication with one combustion chamber, the intake ports may have different inner diameters, the intake valve installed in each intake port may have different amounts of lift, and the flow quantity of intake air flowing through each intake port may be different. In these cases, according to the technique disclosed in JP-2000-234579-A and its associated U.S. Pat. No. 6,308,684 B1, the injection holes of the fuel injection valve are asymmetrically arranged to set the distribution ratio of fuel to be injected into each intake port.

However, some recent engines may stop opening and closing any one of a plurality of intake valves or change the amount of lift, for example, depending on the load of the engine. At this time, the flow quantity of the intake air flowing through each intake port varies depending on the amount of lift of the intake valve. According to the technique disclosed in JP-2000-234579-A and its associated U.S. Pat. No. 6,308,684 B1, fuel can be distributed to each intake port but the distribution ratio of fuel to be injected into each intake port cannot be changed. Accordingly, when a variation in the flow quantity of the intake air flowing through each intake port occurs due to a change in the load of the engine, part of the fuel injected from the fuel injection valve may stay in the intake port. The fuel staying in the intake port does not contribute to combustion in the combustion chamber. This leads to degradation in fuel consumption of the engine. Furthermore, the fuel staying in the intake port flows as in the liquid state into the combustion chamber when the intake valve is opened. Accordingly, the fuel is incompletely burned, thereby causing an increase in uncombusted hydrocarbon (HC) to be emitted from the engine.

DISCLOSURE OF THE INVENTION

In view of the aforementioned problems, it is an object of the present invention to provide a fuel injection valve mount structure which reduces uncombusted HC contained in exhaust gas.

It is another object of the present invention to provide a fuel injection system which reduces uncombusted HC contained in exhaust gas and improves fuel consumption.

It is still another object of the present invention to provide a fuel injection system which simultaneously serves to provide a necessary flow quantity of fuel and atomization of fuel.

According to one aspect of the present invention, there is provided a mount structure for mounting a fuel injection valve to an internal combustion engine that includes: a combustion chamber that is formed at an end surface of a piston, which reciprocates in an axial direction in a cylinder; an intake port, through which intake air to be drawn into the combustion chamber flows; and an intake valve that opens and closes a connection between the intake port and the combustion chamber. The fuel injection valve is placed to inject fuel into intake air that flows in the intake port. An end portion of the fuel injection valve located on a combustion chamber side thereof is placed at a location that overlaps with an imaginary plane, which is perpendicular to a center axis of the cylinder and extends along a portion of a wall surface of the intake port where the intake valve protrudes, or is projected out from the imaginary plane toward the combustion chamber.

According to another aspect of the present invention, there is provided a fuel injection system comprising: a cylinder block that forms a cylinder; a piston that is reciprocally supported in the cylinder; a cylinder head that is installed to the cylinder block and forms a combustion chamber between the cylinder block and the piston, wherein the cylinder head includes an intake port, which is communicatable with the combustion chamber; an intake valve that extends through the cylinder head to open and close a combustion chamber side end portion of the intake port; and a fuel injection valve that is provided in the cylinder head to inject fuel into intake air, which flows in the intake port. An end portion of the fuel injection valve located on a combustion chamber side thereof is placed at a location that overlaps with an imaginary plane, which is perpendicular to a center axis of the cylinder and extends along a portion of a wall surface of the intake port of the cylinder head where the intake valve protrudes, or is projected out from the imaginary plane toward the combustion chamber.

According to another aspect of the present invention, there is provided a mount structure for mounting a plurality of fuel injection valves to an internal combustion engine that includes: a combustion chamber that is formed at an end surface of a piston, which reciprocates in an axial direction in a cylinder; an intake port, through which intake air to be drawn into the combustion chamber flows and which is branched into a plurality of branch ports at an end portion of the intake port located on a combustion chamber side thereof; and a plurality of intake valves, each of which opens and closes a combustion chamber side end portion of a corresponding one of the plurality of branch ports, each of the plurality of fuel injection valves being placed in a corresponding one of the plurality of branch ports to inject fuel into intake air that flows in the corresponding one of the plurality of branch ports. A center of a fuel injecting side end portion of each fuel injection valve is placed on one side of a central axis of the corresponding intake valve, at which a center axis of the cylinder is located, in a radial direction of the cylinder.

According to another aspect of the present invention, there is provided a fuel injection system for an internal combustion engine, comprising: a piston that reciprocates; a housing that includes a cylinder, which reciprocally supports the piston, wherein the housing forms a combustion chamber at an end surface of the piston; an intake port, through which intake air to be drawn into the combustion chamber flows and which is branched into a plurality of branch ports at an end portion of the intake port located on a combustion chamber side thereof; a plurality of intake valves, each of which is provided in a corresponding one of the plurality of branch ports and opens and closes a combustion chamber side end portion of the corresponding one of the plurality of branch ports; and a plurality of fuel injection valves, each of which is placed in a corresponding one of the plurality of branch ports to inject fuel into intake air that flows in the corresponding one of the plurality of branch ports. A center of a fuel injecting side end portion of each fuel injection valve is placed on one side of a central axis of the corresponding intake valve, at which a center axis of the cylinder is located, in a radial direction of the cylinder.

According to another aspect of the present invention, there is provided a fuel injection system for an internal combustion engine, comprising: an intake port, in which intake air to be distributed into a cylinder flows; two or more branch ports that are branched from the intake port at a branching portion located on a combustion chamber side of the intake port; an upstream side fuel injection valve that is placed on an opposite side of the branching portion of the intake port, which is opposite from the two or more branch ports, wherein the upstream side fuel injection valve injects fuel into intake air that flow in the intake port; and two or more downstream side fuel injection valves, each of which is placed in a corresponding one of the two or more branch ports to inject fuel into intake air that flows in the corresponding branch port.

According to another aspect of the present invention, there is provided a fuel injection system comprising: two or more intake ports that are communicated with a combustion chamber; two or more intake valves, each of which is placed in an end portion of a corresponding one of the two or more intake ports to open and close a connection between the corresponding intake port and the combustion chamber; two or more fuel injection valves, each of which is placed in a corresponding one of the two or more intake ports to inject fuel into intake air that flows in the corresponding intake port; and an injection quantity control means for controlling an injection quantity of fuel at each of the two or more fuel injection valves.

BEST MODE FOR CARRYING OUT THE INVENTION

Figure 1:
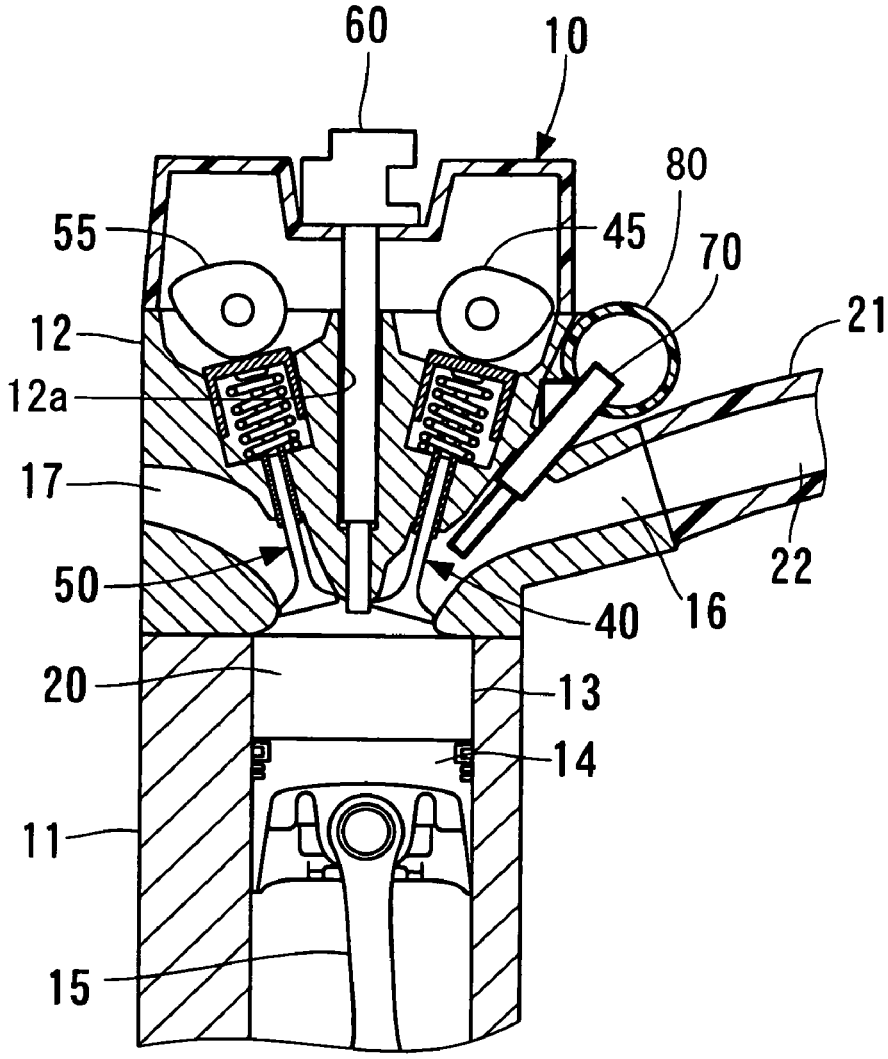
FIG. 1 is a cross-sectional view illustrating an internal combustion engine which incorporates a fuel injection valve mount structure and a fuel injection system according to a first embodiment of the present invention.

A mount structure of a fuel injection valve and a fuel injection system according to first to fourth embodiments of the present invention will be described below.

In the mount structure of the fuel injection valve and the fuel injection system according to the first to fourth embodiments, an end portion of the fuel injection valve is placed at a location that overlaps with an imaginary plane, which is perpendicular to a center axis of the cylinder and extends along a portion of a wall surface of the intake port where the intake valve protrudes, or is projected out from the imaginary plane toward the combustion chamber. In this way, adhesion of the fuel, which is injected from the fuel injection valve, to the wall surface of the intake port, is limited. As a result, inflow of the fuel, which is not sufficiently atomized, into the combustion chamber is limited. Thereby, the fuel, which is injected from the fuel injection valve, is sufficiently combusted. Therefore, the amount of uncombusted HC in the exhaust gas can be reduced, and the fuel consumption can be improved.

Furthermore, in the case where the injection holes are provided in a combustion chamber side end portion of the fuel injection valve, when the fuel is injected from the fuel injection valve, adhesion of the fuel mist to the wall surface located on an extension line of the fuel mist can be limited. As a result, inflow of the fuel, which is not sufficiently atomized, into the combustion chamber is limited. Thus, the amount of uncombusted HC in the exhaust gas can be reduced.

Also, in the case where the injection holes of the fuel injection valve are arranged to form a tubular cross section in the fuel mist injected from the injection holes, the injected fuel forms the tubular fuel mist. Thus, when the intake valve opens the connection between the intake port and the combustion chamber, the fuel, which is injected from the fuel injection valve, flows into the combustion chamber through a space located radially outward of the intake valve. Therefore, adhesion of the fuel, which is injected from the fuel injection valve, to the intake valve is also reduced in addition to the reduction of the adhesion of the fuel to the wall surface of the intake port. As a result, inflow of the fuel, which is not sufficiently atomized, into the combustion chamber is limited. Thus, the amount of uncombusted HC in the exhaust gas can be reduced.

Also, in a case where the injection holes of the fuel injection valve are arranged to form an ellipsoidal cross section in the fuel mist injected from the injection holes, the injected fuel forms the fuel mist having the ellipsoidal cross section. Thus, when the intake valve opens the connection between the intake port and the combustion chamber, the fuel, which is injected from the fuel injection valve, flows into the combustion chamber through a space located radially outward of a circular valve portion of the intake valve. Therefore, adhesion of the fuel, which is injected from the fuel injection valve, to the valve portion of the intake valve is also reduced in addition to the reduction of the adhesion of the fuel to the wall surface of the intake port. As a result, inflow of the fuel, which is not sufficiently atomized, into the combustion chamber is limited. Thus, the amount of uncombusted HC in the exhaust gas can be reduced.

Also, in a case where the injection holes of the fuel injection valve are arranged to form a C-shaped cross section in the fuel mist injected from the injection holes, the injected fuel forms the tubular fuel mist, having a cutout in its circumferential region. A shaft portion of the intake valve is placed in an extension of the cutout part of the fuel mist. Thus, when the intake valve opens the connection between the intake port and the combustion chamber, the fuel, which is injected from the fuel injection valve, flows into the combustion chamber through a space located radially outward of a valve portion of the intake valve while avoiding the contact with the shaft portion of the intake valve. Therefore, adhesion of the fuel, which is injected from the fuel injection valve, to the shaft portion and the valve portion of the intake valve is also reduced in addition to the reduction of the adhesion of the fuel to the wall surface of the intake port. As a result, inflow of the fuel, which is not sufficiently atomized, into the combustion chamber is limited. Therefore, the amount of uncombusted HC in the exhaust gas can be reduced, and the fuel consumption can be improved.

Furthermore, in the case where injection valves are provided to two or more intake ports, respectively, the fuel, which is injected from each fuel injection valve, flows into the combustion chamber while adhesion of the fuel, which is injected from each fuel injection valve, to the wall surface of the corresponding intake port is reduced. As a result, inflow of the fuel, which is not sufficiently atomized, into the combustion chamber is limited. Therefore, the amount of uncombusted HC in the exhaust gas can be reduced, and the fuel consumption can be improved.

Furthermore, in the case where the fuel injection valves are provided to the two or more intake ports, respectively, the appropriate amount of fuel can be injected according to, for example, the flow quantity of the intake air and/or the state of the engine.

Figure 2:
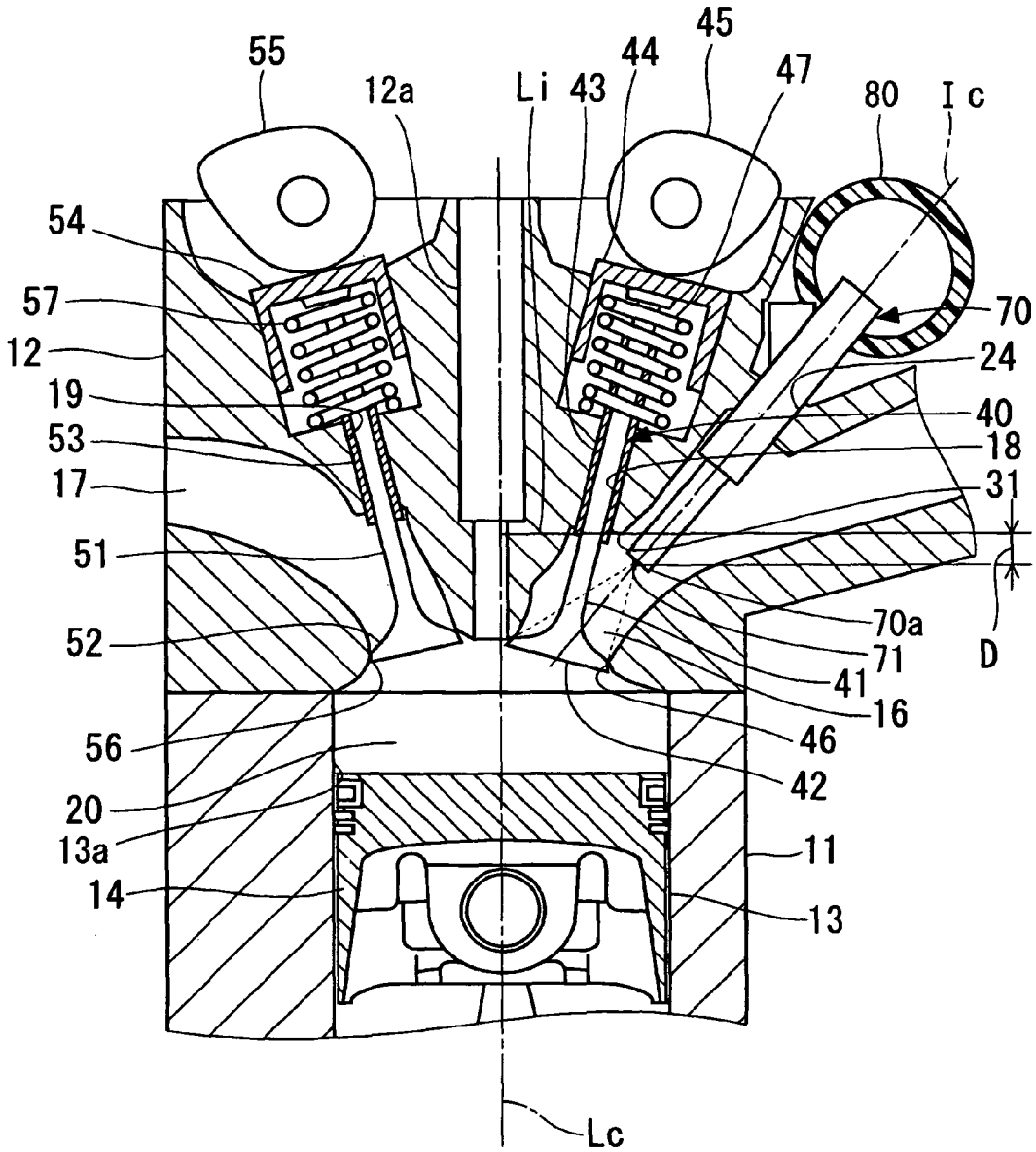
FIG. 2 is a schematic cross-sectional view illustrating the main portion of the internal combustion engine which incorporates the fuel injection valve mount structure and the fuel injection system according to the first embodiment.

FIGS. 1 and 2 show an internal combustion engine (an engine), in which a mount structure of a fuel injection valve and a fuel injection system according to the first embodiment of the present invention are implemented. The engine 10 may be, for example, a gasoline engine that uses gasoline as fuel. Here, it should be noted that the fuel may alternately be, for example, alcohol.

The engine 10 includes a cylinder block 11 and a cylinder head 12. The cylinder block 11 forms a cylinder 13. The engine 10 has one or more cylinders 13. Each cylinder 13 receives a piston 14 therein. The piston 14 is reciprocated by a connecting rod 15 in an axial direction of the cylinder 13.

The cylinder head 12 is disposed at one end of the cylinder block 11. The cylinder head 12 forms an intake port 16 and an exhaust port 17. The engine 10 includes an intake valve 40 and an exhaust valve 50. The intake valve 40 penetrates through the cylinder head 12 and opens and closes the intake port 16. The exhaust valve 50 opens and closes the exhaust port 17.

As shown in FIG. 2, the intake valve 40 extends through an intake-side through hole 18, which is formed by the cylinder head 12. The intake valve 40 has a shaft portion 41 and a valve portion 42. The shaft portion 41 is slidably supported by a portion of the cylinder head 12, which forms the intake-side through hole 18, through a gasket 43. One axial end portion of the shaft portion 41 is connected to the valve portion 42, and the other axial end portion of the shaft portion 41 is connected to an intake cam 45 through a tappet 44. The valve portion 42 is seatable against a valve seat 46, which is formed by the cylinder head 12 at an end portion of the intake port 16. A spring (resilient member) 47 is placed between the cylinder head 12 and the tappet 44. The spring 47 urges the tappet 44 in a direction away from the cylinder head 12. The tappet 44 moves integrally with the intake valve 40. Therefore, the spring 47 urges the valve portion 42 of the intake valve 40 in a seating direction, so that the valve portion 42 is seated against the valve seat 46.

The exhaust valve 50 extends through an exhaust-side through hole 19, which is formed by the cylinder head 12. The exhaust valve 50 has a shaft portion 51 and a valve portion 52. The shaft portion 51 is slidably supported by a portion of the cylinder head 12, which forms the exhaust-side through hole 19, through a gasket 53. One axial end portion of the shaft portion 51 is connected to the valve portion 52, and the other axial end portion of the shaft portion 51 is connected to an exhaust cam 55 through a tappet 54. The valve portion 52 is seatable against a valve seat 56, which is formed by the cylinder head 12 at an end portion of the exhaust port 17. A spring (resilient member) 57 is placed between the cylinder head 12 and the tappet 54. The spring 47 urges the tappet 54 in a direction away from the cylinder head 12. The tappet 54 moves integrally with the exhaust valve 50. Therefore, the spring 57 urges the valve portion 52 of the exhaust valve 50 in a seating direction, so that the valve portion 52 is seated against the valve seat 56.

A space, which is defined by an inner peripheral wall surface 13*a* of the cylinder 13 of the cylinder block 11, a cylinder block 11 side surface of the cylinder head 12, a cylinder head 12 side end surface of the piston 14, a piston 14 side end surface of the intake valve 40, and a piston 14 side end surface of the exhaust valve 50, is a combustion chamber 20. The combustion chamber 20 is communicatable with the intake port 16 and the exhaust port 17. The connection between the combustion chamber 20 and the intake port 16 is opened and closed by the intake valve 40. The connection between the combustion chamber 20 and the exhaust port 17 is opened and closed by the exhaust valve 50. As shown in FIG. 1, an opposite end portion of the intake port 16, which is opposite from the combustion chamber 20, is communicated with an intake air passage 22, which is formed by an intake manifold 21. An opposite end portion of the intake manifold 21, which is opposite from the combustion chamber 20, is communicated with an intake air guide (not shown). The air, which is introduced from the intake air guide, is guided through an air cleaner, a throttle, and a surge tank and is then supplied from the intake air passage 22 of the intake manifold 21 into the intake port 16.

Figure 3:
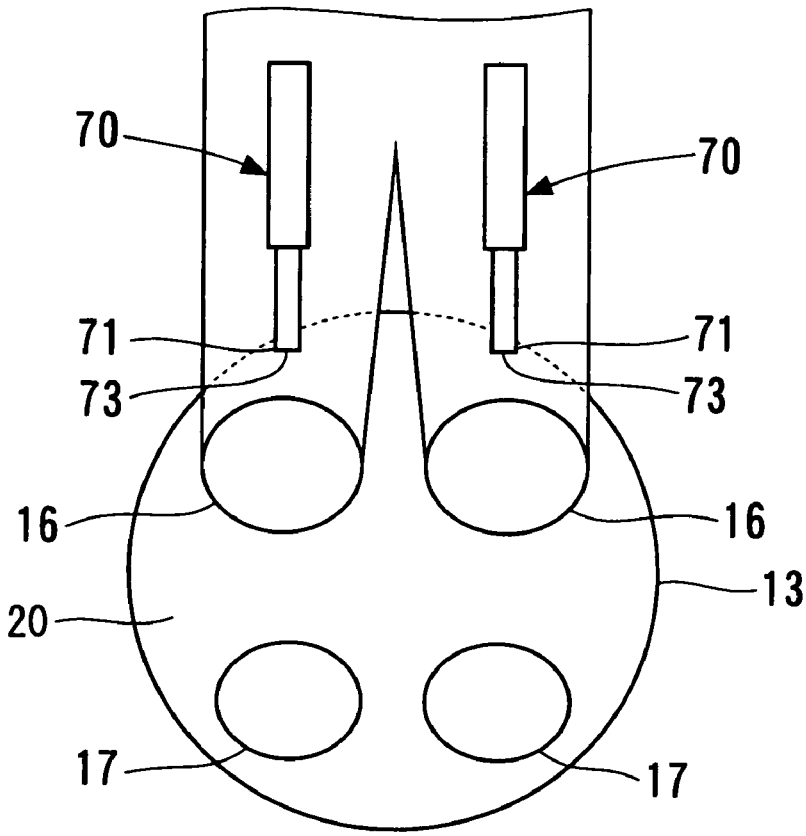
FIG. 3 is a schematic diagram illustrating the arrangement of an intake port and a fuel injection valve of the internal combustion engine which incorporates the fuel injection valve mount structure and the fuel injection system according to the first embodiment.

In the present embodiment, as shown in FIG. 3, the combustion chamber 20 is in communication with two intake ports 16 and two exhaust ports 17. That is, the engine 10 of the present embodiment is a so-called 4-valve engine. Here, it should be noted that one intake port 16 and one exhaust port 17 may be communicated with the combustion chamber 20, or alternatively three or more intake ports 16 and three or more exhaust ports 17 may be communicated with the combustion chamber 20. Further alternately, the number of intake ports 16 may be different from the number of exhaust ports 17. For example, three intake ports 16 and two exhaust ports 17 may be communicated with the combustion chamber 20 to implement a five valve engine.

As shown in FIG. 1, the cylinder head 12 has a through hole 12*a*, which communicates generally with the central portion of the combustion chamber 20. The through hole 12*a* penetrates through the cylinder head 12 in the axial direction of the cylinder 13. An igniter 60 is placed in the through hole 12*a*. The igniter 60 includes an ignition coil (not shown) and a spark plug (not shown), which are integrated together. A spark plug side end portion of the igniter 60 is exposed into the combustion chamber 20.

As shown in FIG. 2, the cylinder head 12 has an installation hole 24, which extends from an exterior side to an interior side of the intake port 16. The installation hole 24 is provided in the middle of the intake port 16. A fuel injection valve 70 is installed in the installation hole 24. The fuel injection valve 70 penetrates through the portion of the cylinder head 12, which forms the installation hole 24. One axial end portion 70*a* of the fuel injection valve 70 is exposed into the intake port 16, and the other axial end portion of the fuel injection valve 70 is connected to a fuel rail 80. Injection holes 71 are provided in the end portion 70*a* of the fuel injection valve 70, which is opposite from the fuel rail 80. The fuel rail 80 is supported by, for example, the cylinder head 12. Fuel is supplied from a fuel tank (not shown) to the fuel rail 80. The fuel, which is supplied to the fuel rail 80, is injected from the injection holes 71 of the fuel injection valve 70 into the intake air that flows in the intake port 16. The fuel injection from the fuel injection valve 70 is turned on and off by an electric signal, which is outputted from an ECU (not shown). That is, the fuel injection valve 70 is a solenoid valve, which electrically turns on and off the fuel injection thereof. In the case of the present embodiment shown in FIG. 3 where the engine 10 has two intake ports 16, two fuel injection valves 70 are provided to the two intake ports 16, respectively.

As shown in FIG. 2, the end portion 70*a* of the fuel injection valve 70, which has the injection holes 71 on the side opposite from the fuel rail 80, projects into a combustion chamber 20 side portion of the intake port 16. The portion of the cylinder head 12, which forms the intake port 16, has a wall surface 31 that is spaced from the combustion chamber 20 and is opposed to the combustion chamber 20. The shaft portion 41 of the intake valve 40 protrudes from the wall surface 31. Specifically, the wall surface 31 of the cylinder head 12 forms the intake port 16 and serves as a combustion chamber 20 side end portion of a guide, which slidably supports the shaft portion 41 of the intake valve 40.

In this instance, the center axis of the cylinder 13, which is formed by the cylinder block 11, is indicated by "Lc". Also, an imaginary plane, which extends perpendicular to the central axis Lc, i.e., which extends in a radial direction of the cylinder 13 through the wall surface 31, is indicated by "Li". At this time, the end portion 70*a* of the fuel injection valve 70 is placed at a location that overlaps with the imaginary plane Li or is projected out from the imaginary plane Li toward the combustion chamber 20. FIGS. 1 and 2 show the exemplary case where the end portion 70*a* of the fuel injection valve 70 is projected out from the imaginary plane Li toward the combustion chamber 20. The projecting amount of the fuel injection valve 70 is indicated by the projecting amount D in FIG. 2.

When the end portion 70*a* of the fuel injection valve 70 is placed at the location that overlaps with the imaginary plane Li or is projected out from the imaginary plane Li toward the combustion chamber 20, an area of the wall surface of the cylinder head 12, which forms the portion of the intake port 16 that is located along an imaginary extension of the central axis Ic of the fuel injection valve 70 on the injection hole 71 side, is reduced. Thus, it is possible to limit adhesion of fuel, which is injected from the injection holes 71 of the fuel injection valve 70, to the wall surface of the cylinder head 12, which forms the intake port 16, so that the injected fuel flows into the combustion chamber 20.

The fuel, which is injected from the injection holes 71 of the fuel injection valve 70, is atomized into mist. When the atomized fuel adheres the wall surface of the cylinder head 12, which forms the intake port 16, it grows into fuel droplets. When the grown fuel droplets flow into the combustion chamber 20, the combustion of the fuel may possibly become incomplete due to the insufficient atomization. This may result in an increase in the amount of HC contained in the exhaust gas or may deteriorate fuel consumption caused by uncombusted fuel.

In contrast, in the case of the engine 10 of the first embodiment, the fuel, which is injected from the fuel injection valve 70, is limited from adhering to the wall surface of the cylinder head 12, which forms the intake port 16, and thereby flows into the combustion chamber 20. Therefore, the atomization of the fuel, which is injected from the fuel injection valve 70, is not hindered, so that the fuel, which maintains the mist state thereof, flows into the combustion chamber 20. In this way, the fuel is combusted sufficiently in the combustion chamber 20. Therefore, the amount of uncombusted HC in the exhaust gas can be reduced, and the fuel consumption can be improved.

Figure 4A:
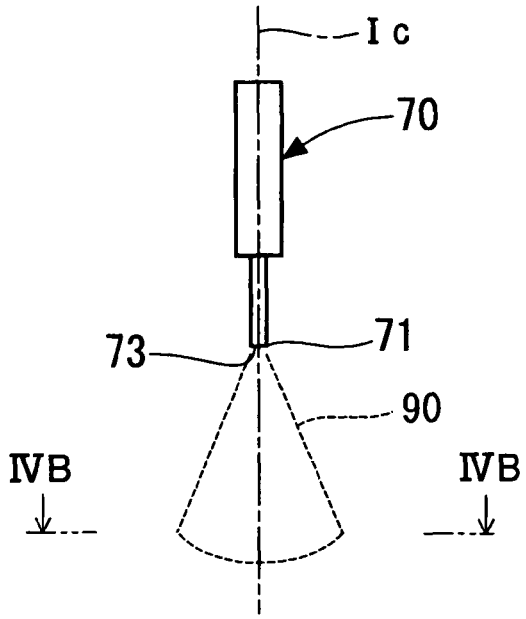
FIG. 4(A) is a schematic diagram illustrating fuel mist in an internal combustion engine which incorporates a fuel injection valve mount structure and a fuel injection system according to a second embodiment of the present invention, FIG. 4(B) being a VIB-VIB cross-sectional view illustrating the fuel mist of FIG. 4(A) and a schematic diagram illustrating the relationship between the radial position and the flow quantity of fuel mist.
Figure 4B:
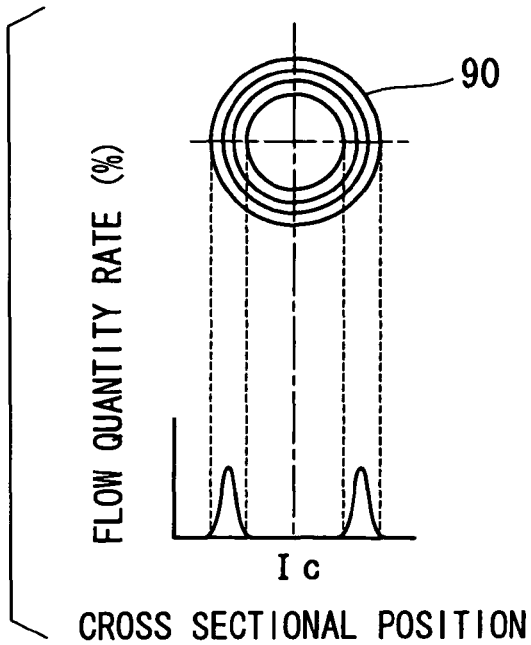

FIGS. 4(A) and 4(B) show the second embodiment of the present invention. In the following description, components similar to those of the first embodiment will be indicated by the same numerals and will not be described further for the sake of simplicity.

In the second embodiment, similar to the first embodiment, the end portion 70*a* of the fuel injection valve 70 is placed at the location that overlaps with the imaginary plane Li or is projected out from the imaginary plane Li toward the combustion chamber 20. Furthermore, in the second embodiment, as shown in FIGS. 4(A) and 4(B), the fuel injection valve 70 forms a hollow conical fuel mist 90. The shape of the fuel mist 90 can be easily set by adjusting the location of the injection holes 71 of the fuel injection valve 70. The fuel mist 90, which is injected from the fuel injection valve 70 of the second embodiment, is shaped into the hollow conical form. Specifically, as shown in FIG. 4(B), the flow quantity of fuel, which constitutes the fuel mist 90, varies in the radial direction of the fuel mist 90.

In the second embodiment, the fuel mist 90, which is injected from the fuel injection valve 70, is configured into the hollow form. Thus, when the intake valve 40 opens the intake port 16, the fuel mist 90, which is injected from the fuel injection valve 70, passes through a space between the valve portion 42 and the wall surface of the cylinder head 12, which forms the intake port 16. As a result, the fuel, which is injected from the fuel injection valve 70, passes a space on a radially outer side of the valve portion 42 and then flows into the combustion chamber 20 while avoiding contact with the wall surface of the cylinder head 12. Accordingly, the fuel, which is injected from the fuel injection valve 70, flows into the combustion chamber 20 while being limited from adhering not only to the wall surface of the cylinder head 12, which forms the intake port 16, but also to the valve portion 42 of the intake valve 40. Therefore, the atomization of the fuel, which is injected from the fuel injection valve 70, is not interfered, so that the fuel mist 90, which maintains its mist form, flows into the combustion chamber 20. In this way, the fuel is combusted sufficiently in the combustion chamber 20. Therefore, the amount of uncombusted HC in the exhaust gas can be further reduced, and the fuel consumption can be improved.

Figure 5A:
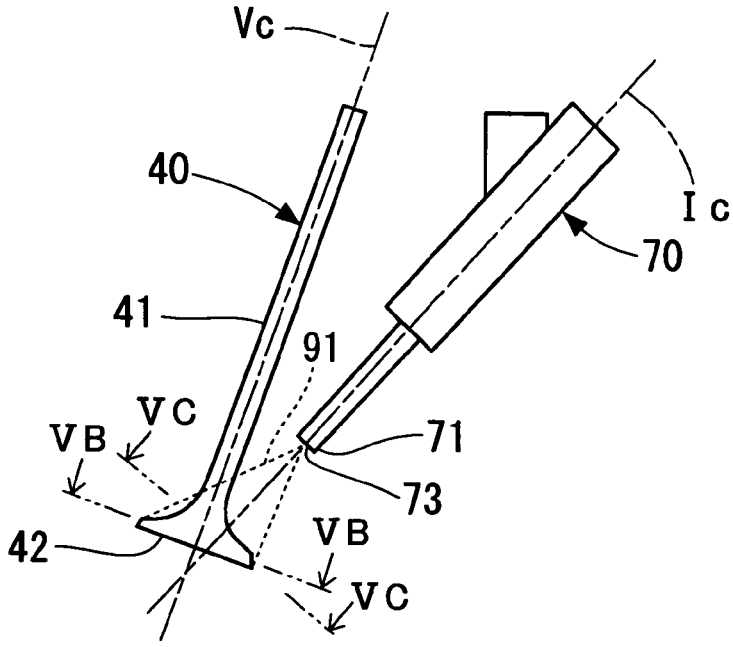
FIG. 5(A) is a schematic view illustrating a fuel injection valve and an intake valve in an internal combustion engine which incorporates a fuel injection valve mount structure and a fuel injection system according to a third embodiment of the present invention, FIG. 5(B) being a VB-VB cross-sectional view illustrating the intake valve and the fuel mist of FIG. 5(A), FIG. 5(C) being a VC-VC cross-sectional view illustrating the intake valve and the fuel mist of FIG. 5(A)
Figure 5B:
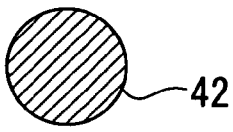
Figure 5C:
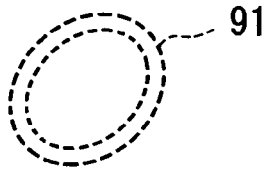

FIGS. 5(A) to 5(C) show the third embodiment of the present invention. In the following description, components similar to those of the first embodiment will be indicated by the same numerals and will not be described further for the sake of simplicity.

In the third embodiment, similar to the first embodiment, the end portion 70*a* of the fuel injection valve 70 is placed at the location that overlaps with the imaginary plane Li or is projected out from the imaginary plane Li toward the combustion chamber 20. The fuel injection valve 70 forms fuel mist 91 like in the second embodiment. Furthermore, in the third embodiment, as shown in FIG. 5(A), the center axis Vc of the intake valve 40 and the center axis Ic of the fuel injection valve 70 intersect with each other. The valve portion 42 of the intake valve 40 is generally perfectly circular in cross section, as shown in FIG. 5(B) (cross section along line VB-VB in FIG. 5(A)). When the center axis Vc of the intake valve 40 and the center axis Ic of the fuel injection valve 70 intersect with each other, the fuel mist 91, which is injected from the fuel injection valve 70, reaches the valve portion 42 at a predetermined angle with respect to the intake valve 40. Therefore, when the fuel mist, which is injected from the fuel injection valve 70, has the perfectly circular cross section, part of the fuel mist may possibly adhere to the valve portion 42 without passing the space on the radially outer side of the valve portion 42, which has the perfectly circular cross section.

In the third embodiment, the fuel injection valve 70 forms the fuel mist 91, which is elliptical in the cross section that is perpendicular to the center axis Ic, i.e., in the cross section along line VC-VC shown in FIG. 5(C). Specifically, the fuel injection valve 70 forms the fuel mist 91, which is shaped like a hollow elliptic cone. As described in the second embodiment, the shape of the fuel mist 91 can be easily changed by adjusting the location of the injection holes 71 of the fuel injection valve 70.

In the third embodiment, the fuel mist 91, which is injected from the fuel injection valve 70, has the elliptical shape in cross section. In this way, even when the center axis Vc of the intake valve 40 and the center axis Ic of the fuel injection valve 70 intersect with each other, the fuel mist 91, which is injected from the fuel injection valve 70, passes the space between the valve portion 42 and the wall surface of the cylinder head 12, which forms the intake port 16. This allows the fuel injected from the fuel injection valve 70 to flow into the combustion chamber 20 while avoiding the wall surface of the cylinder head 12 and the valve portion 42 of the intake valve 40. Accordingly, the fuel, which is injected from the fuel injection valve 70, flows into the combustion chamber 20 while being limited from adhering not only to the wall surface of the cylinder head 12, which forms the intake port 16, but also to the valve portion 42 of the intake valve 40. Therefore, the atomization of the fuel, which is injected from the fuel injection valve 70, is not hindered, so that the fuel, which maintains its mist form, flows into the combustion chamber 20. In this way, the fuel is combusted sufficiently in the combustion chamber 20. Therefore, the amount of uncombusted HC in the exhaust gas can be further reduced, and the fuel consumption can be improved.

Figure 6A:
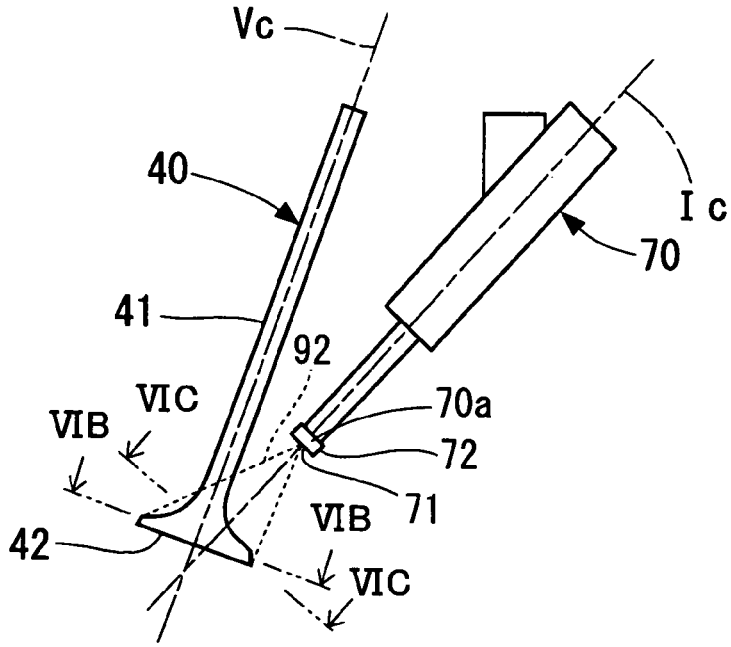
FIG. 6(A) is a schematic view illustrating a fuel injection valve and an intake valve in an internal combustion engine which incorporates a fuel injection valve mount structure and a fuel injection system according to a fourth embodiment of the present invention, FIG. 6(B) being a VIB-VIB cross-sectional view illustrating the intake valve and the fuel mist of FIG. 6(A), FIG. 6(C) being a VIC-VIC cross-sectional view illustrating the intake valve and the fuel mist of FIG. 6(A)
Figure 6B:
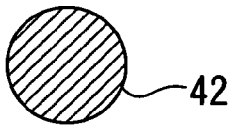
Figure 6C:
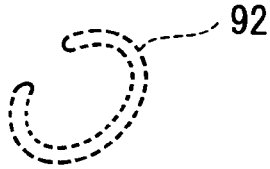

FIGS. 6(A) to 6(C) show the fourth embodiment of the present invention. In the following description, components similar to those of the first embodiment will be indicated by the same numerals and will not be described further for the sake of simplicity.

Figure 7:
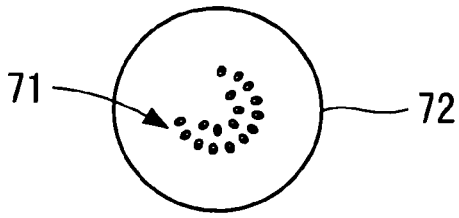
FIG. 7 is a schematic view illustrating an injection hole plate to be used in the fuel injection valve mount structure and the fuel injection system according to the fourth embodiment.

In the fourth embodiment, similar to the first embodiment, the end portion 70*a* of the fuel injection valve 70 is placed at the location that overlaps with the imaginary plane Li or is projected out from the imaginary plane Li toward the combustion chamber 20. In the fourth embodiment, the fuel injection valve 70 forms fuel mist 92, which is generally shaped like a letter C in the cross section that is perpendicular to the center axis Ic. Specifically, the fuel mist 92, which is injected from the fuel injection valve 70, has the shape of a hollow elliptic cone having a cutout in its circumferential region, as shown in FIG. 6(B) (cross section along line VIB-VIB in FIG. 6(A)). As shown in FIG. 7, in an injection hole plate 72, which forms the injection holes 71 of the fuel injection valve 70, none of the injection holes 71 is provided in a certain circumferential part of the injection hole plate 72. Thus, by adjusting the locations of the injection holes 71 arranged in the injection hole plate 72, the fuel mist 92, which has the generally C-shaped cross section, is injected from the fuel injection valve 70.

In the fourth embodiment, the center axis Vc of the intake valve 40 and the center axis Ic of the fuel injection valve 70 intersect with each other like in the third embodiment. As shown in FIG. 6(B), the cross section of the valve portion 42 of the intake valve 40 is generally perfectly circular. As described above, when the center axis Vc of the intake valve 40 and the center axis Ic of the fuel injection valve 70 intersect with each other, the fuel mist 92, which is injected from the fuel injection valve 70, reaches the valve portion 42 at a predetermined angle with respect to the intake valve 40. As described in the third embodiment, when the cross section of the fuel mist 92, which is perpendicular to the central axis Ic of the fuel injection valve 70, is made elliptical, it is possible to limit the adhesion of the fuel to the valve portion 42.

Furthermore, in the fourth embodiment, when the cross section of the fuel mist 92 is made into the C-shape, the fuel mist 92 flows into the combustion chamber 20 while avoiding contact with the shaft portion 41 of the intake valve 40. That is, the shaft portion 41 of the intake valve 40 is placed in the circumferential cut-out portion of the fuel mist 92. In this way, the fuel, which is injected from the fuel injection valve 70, flows into the combustion chamber 20 while being limited from adhering not only to the wall surface of the cylinder head 12, which forms the intake port 16, and the valve portion 42 of the intake valve 40 but also to the shaft portion 41 of the intake valve 40. Therefore, the atomization of the fuel, which is injected from the fuel injection valve 70, is not interfered, so that the fuel, which maintains its mist form, flows into the combustion chamber 20. In this way, the fuel is combusted sufficiently in the combustion chamber 20. Therefore, the amount of uncombusted HC in the exhaust gas can be further reduced, and the fuel consumption can be further improved.

In the above embodiments, there is discussed about the exemplary case where the one fuel injection valve 70 is provided in each intake port 16. Alternatively, two or more fuel injection valves 70 may be provided in each intake port 16.

Furthermore, any method can be employed to form the injection holes 71 of the fuel injection valve 70. For example, the injection holes 71 may be formed in the injection hole plate 72 like in the fourth embodiment or may be alternatively formed on a nozzle that forms the end portion of the fuel injection valve 70.

A mount structure of a fuel injection valve and a fuel injection system according to fifth to seventh embodiments of the present invention will be described below.

In the mount structure of the fuel injection valve and the fuel injection system according to the fifth to seventh embodiments, the center of the fuel injecting side end portion of the fuel injection valve is placed on one side of the center axis of the intake valve, at which the center axis of the cylinder is located, in the radial direction of the cylinder. Here, the center of the fuel injecting side end portion of the fuel injection valve refers to a portion, which is located in an axial end portion of the fuel injection valve for injecting fuel and which intersects with the center axis of the fuel injection valve. The fuel injection valve is placed on the one side of the center axis of the intake valve, at which the center axis of the cylinder is located, so that the fuel is injected from the fuel injection valve toward the center axis of the cylinder. Accordingly, even when the intake air, which is drawn from the intake port into the combustion chamber through the branch port, is directed toward the inner peripheral wall of the cylinder, the fuel, which is injected toward the center axis of the cylinder, is less likely to be carried toward the inner peripheral wall of the cylinder. Furthermore, even in the case where the fuel mist is carried toward the inner peripheral wall of the cylinder, since the fuel is injected toward the center axis of the cylinder, the amount of fuel, which is injected and adheres to the inner peripheral wall of the cylinder, is reduced. As a result, the fuel, which is injected from the fuel injection valve, is less adhered to the inner peripheral wall. Thus, it is possible to reduce the uncombusted hydrocarbon discharged from the internal combustion engine and also possible to improve the fuel consumption.

Furthermore, in the case where the center axis of the fuel injection valve is generally parallel to the center axis of the intake valve, the intake valve and the fuel injection valve can be installed in the same direction. It is thus possible to facilitate the assembly and to limit an increase in the number of processing steps and the number of assembling steps.

Furthermore, in the case where the center axis of the fuel injection valve is tilted inwardly or outwardly in the radial direction of the cylinder relative to the center axis of the intake valve, the fuel injecting side end portion of the fuel injection valve can be directed in any direction depending on the intake air flow from the branch port to the combustion chamber. Accordingly, the fuel, which is injected from the fuel injection valve, is less adhered to the inner peripheral wall of the cylinder. Thus, it is possible to reduce the amount of uncombusted hydrocarbon discharged from the internal combustion engine and also possible to improve the fuel consumption.

Figure 8:
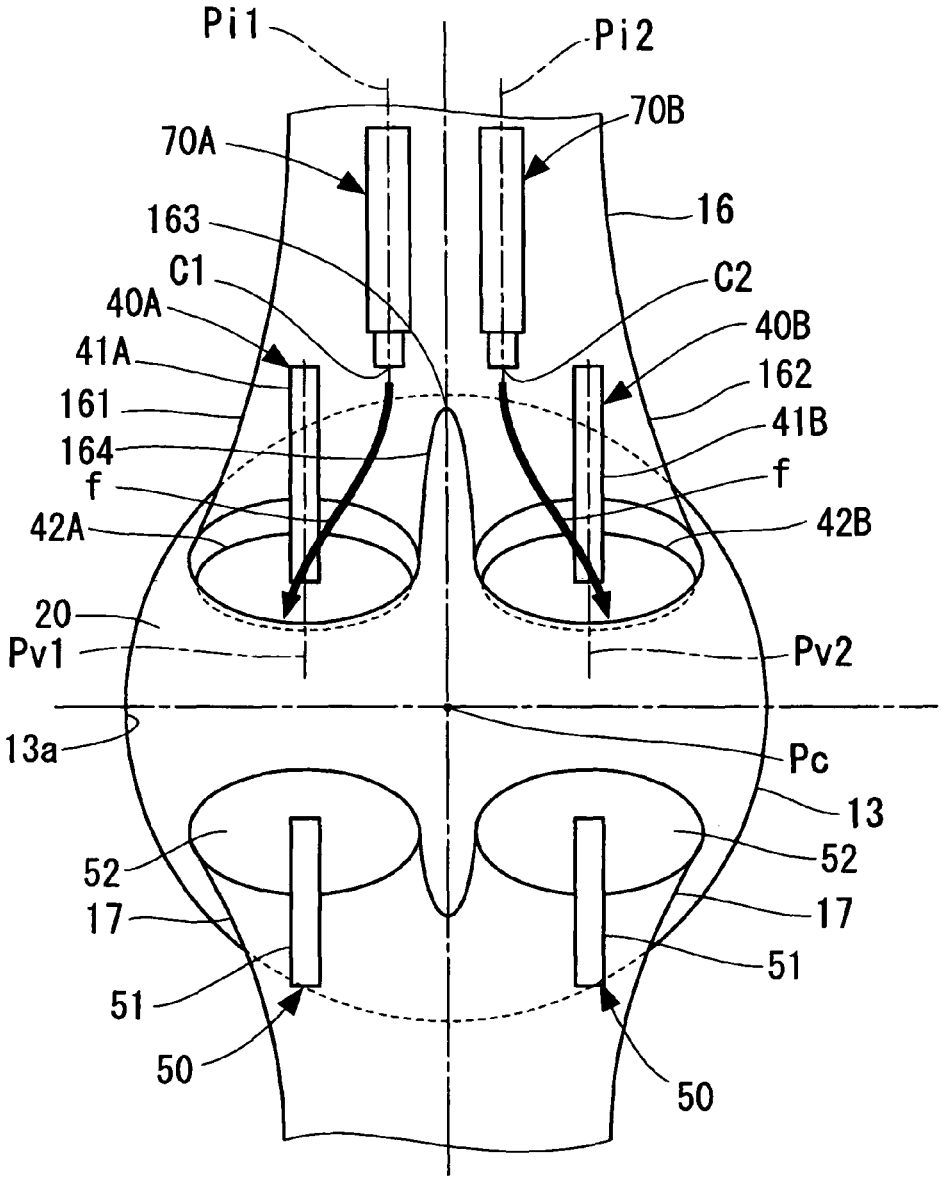
FIG. 8 is a schematic diagram, viewed from arrow VIII of FIG. 9, illustrating the positions of an intake valve and a fuel injection valve of each branch port branched from an intake port in an internal combustion engine which incorporates a fuel injection valve mount structure and a fuel injection system according to a fifth embodiment of the present invention.
Figure 9:
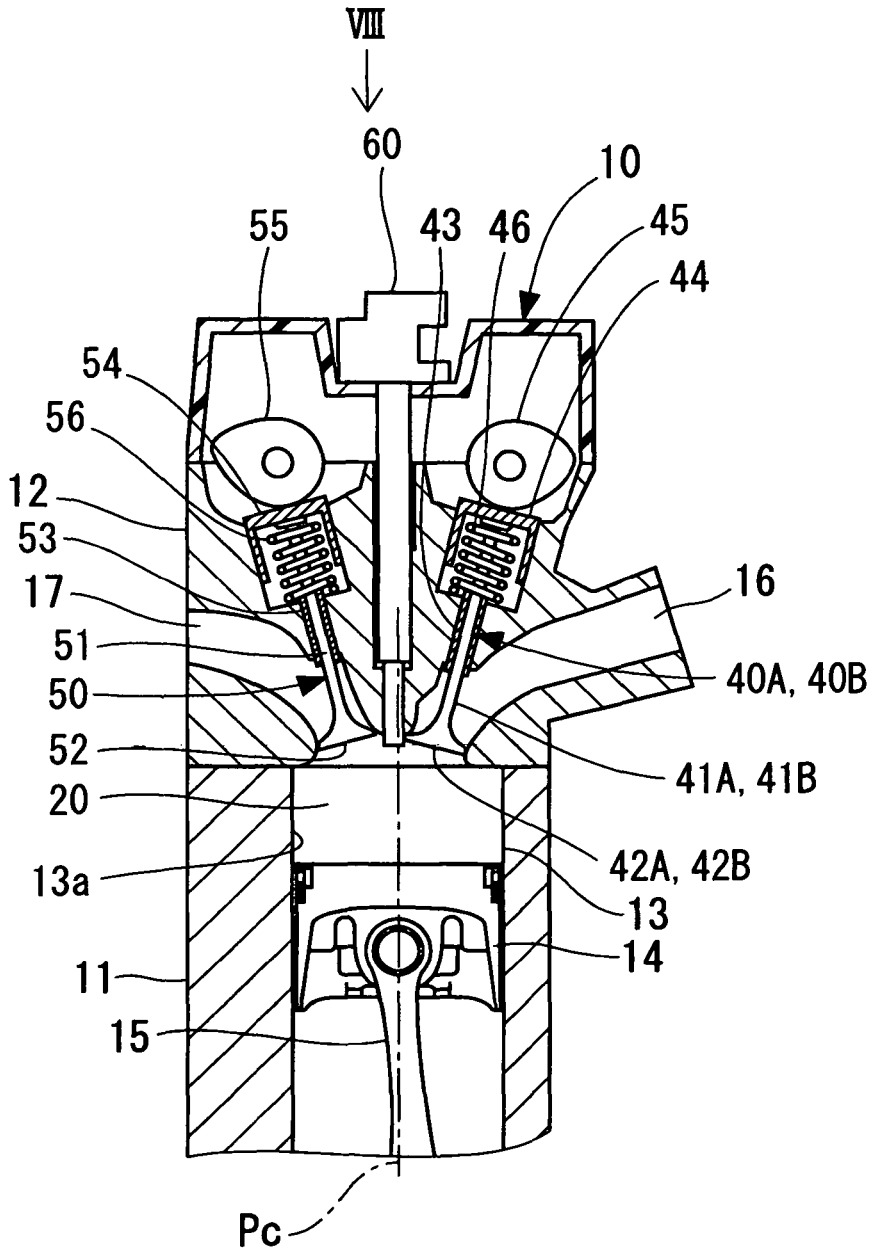
FIG. 9 is a schematic cross-sectional view illustrating an internal combustion engine which incorporates the fuel injection valve mount structure and the fuel injection system according to the fifth embodiment.

FIGS. 8 and 9 show an internal combustion engine (an engine), in which a mount structure of a fuel injection valve and a fuel injection system according to the fifth embodiment of the present invention are implemented. The engine 10 may be, for example, a gasoline engine that uses gasoline as fuel. Here, it should be noted that the fuel is not limited to the gasoline and may alternately be, for example, alcohol.

The engine 10 includes a cylinder block (housing) 11 and a cylinder head 12. The cylinder block 11 forms a cylinder 13. The engine 10 has one or more cylinders 13. Each cylinder 13 receives a piston 14 therein. The piston 14 is supported and is reciprocated by a connecting rod 15 in an axial direction of the cylinder 13.

The cylinder head 12 is disposed at one end of the cylinder block 11. The cylinder head 12 forms the intake port 16 and the exhaust port 17. As shown in FIG. 8, the intake port 16 is designed such that the cylinder 13 is branched into two branch ports 161, 162. As shown in FIG. 9, the engine 10 includes intake valves 40A, 40B and an exhaust valve 50. The intake valves 40A, 40B extend through the cylinder head 12. The intake valves 40A, 40B open and close the branch ports 161, 162, respectively. The exhaust valve 50 opens and closes the exhaust port 17.

The intake valves 40A, 40B extend through the cylinder head 12. Each intake valve 40A, 40B has a shaft portion 41A, 41B, and a valve portion 42A, 42B. The shaft portion 41A, 41B is slidably supported in the cylinder head 12 through a gasket 43. One axial end portion of the shaft portion 41A, 41B is connected to the valve portion 42A, 42B, and the other axial end portion of the shaft portion 41A, 41B is connected to an intake cam 45 through a tappet 44. A spring (resilient member) 46 is placed between the cylinder head 12 and the tappet 54 of the intake valve 40A, 40B. The spring 46 urges the tappet 44 in a direction away from the cylinder head 12. The tappet 44 moves integrally with the intake valve 40A, 40B.

The exhaust valve 50 extends through the cylinder head 12. The exhaust valve 50 has a shaft portion 51 and a valve portion 52. The shaft portion 51 is movably supported by the cylinder head 12 through a gasket 53. One axial end portion of the shaft portion 51 is connected to the valve portion 52, and the other axial end portion of the shaft portion 51 is connected to an exhaust cam 55 through a tappet 54. A spring 56 (resilient member) is placed between the cylinder head 12 and the tappet 54. The spring 56 urges the tappet 54 in a direction away from the cylinder head 12. The tappet 54 moves integrally with the exhaust valve 50.

A space, which is defined by an inner peripheral wall surface 13*a* of the cylinder 13 of the cylinder block 11, a cylinder block 11 side surface of the cylinder head 12, a cylinder head 12 side end surface of the piston 14, a piston 14 side end surface of the intake valve 40A, 40B, and a piston 14 side end surface of the exhaust valve 50, is a combustion chamber 20. The combustion chamber 20 is communicatable with the intake port 16 and the exhaust port 17. An opposite end portion of the intake port 16, which is opposite from the combustion chamber 20, is communicated with a surge tank (not shown). An end portion of the surge tank, which is opposite from the intake port 16, is communicated with an intake air guide (not shown). The air, which is introduced from the intake air guide, is guided through an air cleaner, a throttle and a surge tank and is then supplied to the intake port 16.

The cylinder head 12 has the igniter 60 generally at the central portion of the combustion chamber 20. The igniter 60 is installed to extend through the cylinder head 12. The igniter 60 includes an ignition coil (not shown) and a spark plug (not shown), which are integrated together. A spark plug side end portion of the igniter 60 is exposed into the combustion chamber 20.

In the present embodiment, as shown in FIG. 8, the combustion chamber 20 is communicated with the two intake ports 161, 162, which are branched from the intake port 16. Furthermore, the combustion chamber 20 is communicated with two exhaust ports 17. That is, the engine 10 of the present embodiment is a so-called 4-valve engine. Alternatively, three or more branch ports 161, 162 and/or three or more exhaust ports 17 of the engine 10 may be provided to communicate with the combustion chamber 20. Further alternately, the number of intake ports may be different from the number of exhaust ports. For example, three intake ports and two exhaust ports may be communicated with the combustion chamber 20 to implement a five valve engine.

The intake port 16 is branched into the two branch ports 161, 162 at a branching portion 163 between the surge tank and the combustion chamber 20. In this way, the intake air, which is drawn from the surge tank into the intake port 16, is distributed into the two branch ports 161, 162 at the branching portion 163. A wall portion 164 is provided between the branch port 161 and the branch port 162 to partition therebetween.

As shown in FIG. 8, the cylinder head 12 is provided with fuel injection valves 70A, 70B. As shown in FIG. 8, the fuel injection valves 70A, 70B are provided to the branch ports 161, 162, respectively. Each fuel injection valve 70A, 70B extends through the cylinder head 12. One axial end portion of each fuel injection valve 70A, 70B is exposed in the corresponding branch port 161, 162, and the other axial end portion of the fuel injection valve 70A, 70B is connected to a fuel rail (not shown).

Figure 10:
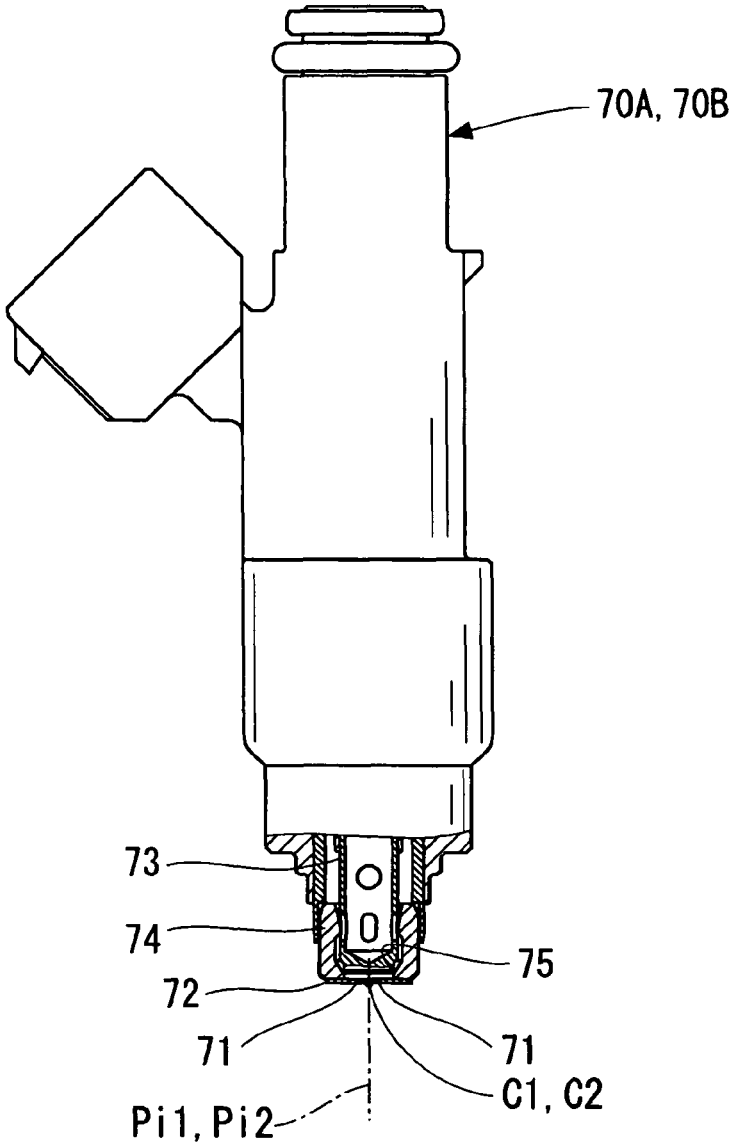
FIG. 10 is a schematic partially cross-sectional view illustrating a fuel injection valve in the fuel injection valve mount structure and the fuel injection system according to the fifth embodiment.

The one end portion of each fuel injection valve 70A, 70B, which is opposite from the fuel rail, is a fuel injecting side end portion. As shown in FIG. 10, each fuel injection valve 70A, 70B has injection holes 71 at the fuel injecting side end portion thereof. The fuel injection valve 70A, 70B injects the fuel, which is supplied to the fuel rail (not shown), into the corresponding branch port 161, 162 through the injection holes 71.

Figure 11:
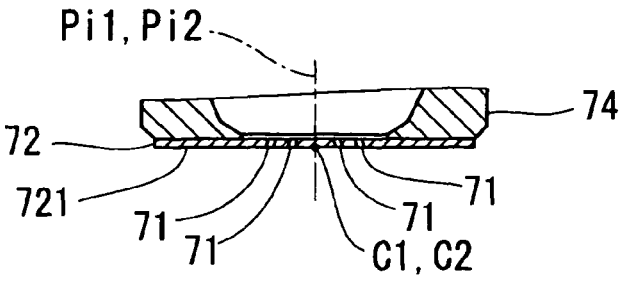
FIG. 11 is a schematic cross-sectional view illustrating the end portion of the fuel injection valve in the fuel injection valve mount structure and the fuel injection system according to the fifth embodiment.

In the fifth embodiment, the fuel injection valve 70A, 70B is a solenoid valve, which is axially reciprocated by turning on and off of electric power to its coil (not shown). As shown in FIG. 10, each fuel injection valve 70A, 70B has a needle 73, which is moved axially therein. The needle 73 is seated against and is lifted away from a valve seat 75, which is formed in a body 74, so that the fuel injection from the injection holes 71 is stopped and executed. In the fifth embodiment, as shown in FIG. 11, the injection hole plate 72, which forms the injection holes 71, is provided at the distal end of the body 74 of the fuel injection valve 70A, 70B.

FIG. 8 is a schematic view of the engine 10 taken in a direction of an arrow VIII in FIG. 9 and schematically illustrates the positional relationship between the branch port 161, 162 branched from intake port 16 of the engine 10 and the intake valve 40A, 40B and the fuel injection valve 70A, 70B provided in the port 161, 162. As discussed above, the two branch ports 161, 162, which are branched from the intake port 16, are communicated with the combustion chamber 20 of the engine 10. The fuel injection valves 70A, 70B are provided to the branch ports 161, 162, respectively. The intake valve 40A opens and closes the chamber 20 side end portion of the branch port 161. The intake valve 40B opens and closes the combustion chamber 20 side end portion of the branch port 162. The center axis Pc of the cylinder 13 passes through the center of the combustion chamber 20.

According to the fifth embodiment, a center C1 of the distal end portion of the fuel injection valve 70A at the fuel injecting side thereof in the branch port 161 is placed on one side of the center axis Pv1 of the intake valve 40A, at which the center axis Pc of the cylinder 13 is located, in the radial direction of the cylinder 13. Similarly, a center C2 of the distal end portion of the fuel injection valve 70B at the fuel injecting side thereof in the branch port 162 is placed on one side of the center axis Pv2 of the intake valve 40B, at which the center axis Pc of the cylinder 13 is located, in the radial direction of the cylinder 13.

In this instance, as shown in FIG. 10, the center C1, C2 of the distal end portion of each fuel injection valve 70A, 70B at the fuel injecting side thereof refers to a location, at which the distal end portion of the fuel injection valve 70A, 70B intersects with the center axis Pi1, Pi2 of the fuel injection valve 70A, 70B. In the fifth embodiment, the injection hole plate 72 is provided to the distal end of the body 74. Accordingly, in the fifth embodiment, the center C1, C2 of the distal end portion of the fuel injection valve 70A, 70B at the fuel injecting side thereof is the point, at which the end surface of the injection plate 72, which is opposite from the body 74, i.e., the combustion chamber 20 side end surface 721 of the injection plate 72, intersects with the center axis Pi1, Pi1 of the fuel injection valve 70A, 70B.

The intake air, which flows through the intake port 16, is divided at the branching portion 163 and is guided to the branch port 161 and the branch port 162. Accordingly, the intake air, which flows from the intake port 16 into the respective branch ports 161, 162, flows from the center side to the radially outer side in the cylinder 13, i.e., flows toward the inner peripheral wall 13*a* of the cylinder block 11, which forms the cylinder 13. Accordingly, the fuel mist, which is injected from each fuel injection valve 70A, 70B, is carried along the intake air flow, which is indicated by an arrow f.

In the fifth embodiment, the center C1 of the distal end portion of the fuel injection valve 70A is placed on the radially inner side of the center axis Pv1 of the intake valve 40A where the center axis Pc of the cylinder 13 is located, and the center C2 of the distal end portion of the fuel injection valve 70B is placed on the radially inner side of the center axis Pv2 of the intake valve 40B where the center axis Pc of the cylinder is located. Thus, even when the fuel mist, which is injected from the fuel injection valve 70A, 70B, is carried along the intake air flow indicated by the arrow f, the fuel mist enters into the combustion chamber 20 around the center of the branch port 161, 162, i.e., around the center of the valve portion 42, 52 of the intake valve 40A, 40B. In this way, even in the case where the intake air flows from the intake port 16 to the branch ports 161, 162, adhesion of the fuel to the inner peripheral wall 13*a* of the cylinder block 11, which forms the cylinder 13, is reduced.

By reducing the adhesion of the fuel to the inner peripheral wall 13*a* of the cylinder block 11, the amount of fuel, which does not contribute to the combustion, is reduced. Accordingly, it is possible to reduce the incomplete combustion of the fuel, which is injected from the fuel injection valves 70A, 70B. As a result, it is possible to reduce the amount of uncombusted fuel discharged from the engine 10. Thereby, it is possible to reduce the amount of uncombusted HC discharged from the engine 10. Furthermore, the fuel, which is injected from the fuel injection valves 70A, 70B, is effectively combusted without becoming fuel droplets. Thus, at the time of demanding a predetermined output to the engine 10, the amount of fuel, which needs to be injected from the fuel injection valves 70A, 70B, can be reduced. As a result, the fuel consumption can be improved.

Furthermore, according to the fifth embodiment, the center axis Pi1 of the fuel injection valve 70A, the center axis Pv1 of the intake valve 40A, the center axis Pi1 of the fuel injection valve 70B and the center axis of Pv2 of the intake valve 40B are generally parallel to each other. Therefore, the intake valves 40A, 40B and the fuel injection valves 70A, 70B can be installed in the same direction. As a result, the assembling of the intake valves 40A, 40B and the fuel injection valves 70A, 70B can be eased, and the number of the processing steps can be reduced.

Figure 12:
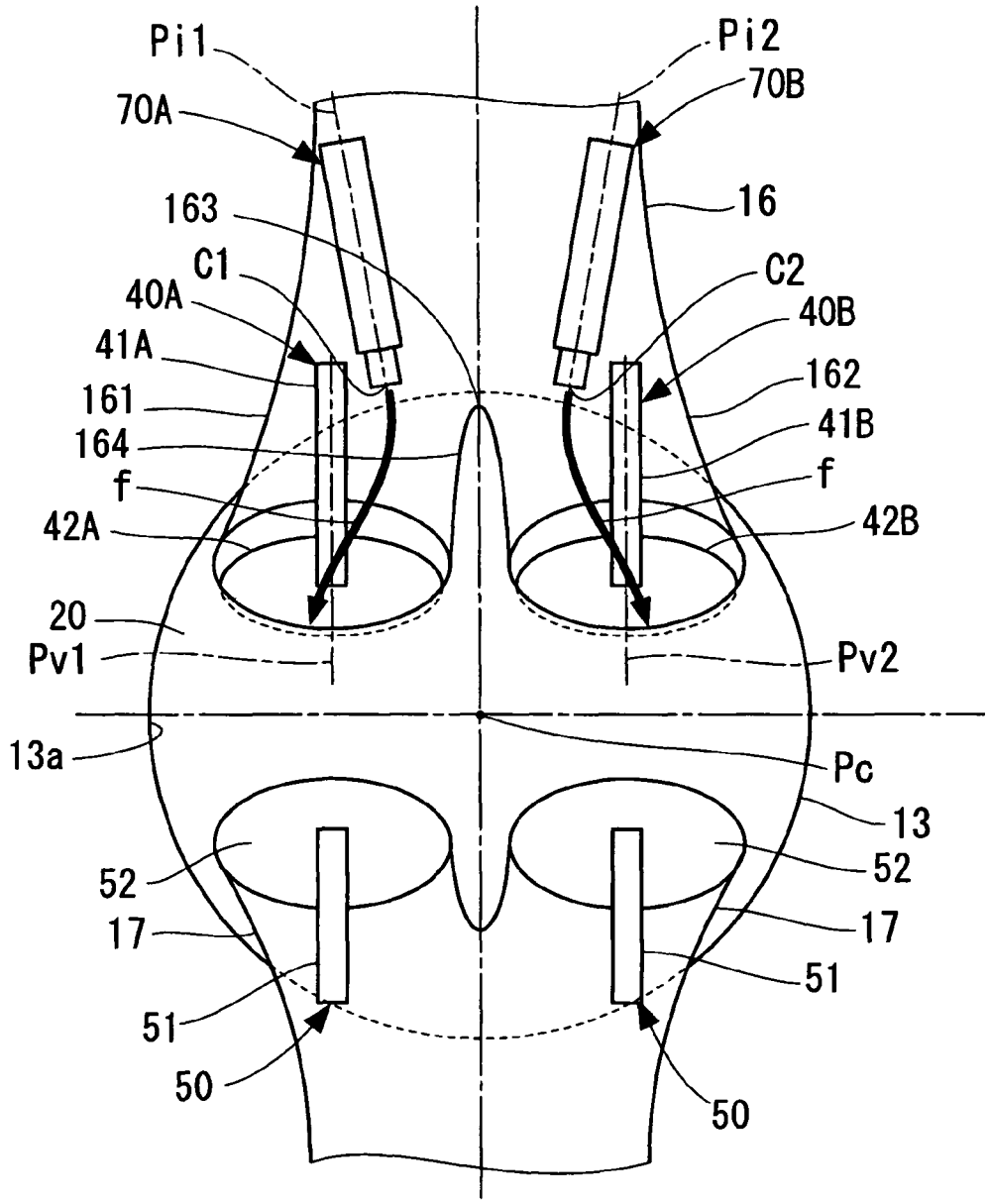
FIG. 12 is a schematic diagram illustrating the position of an intake valve and a fuel injection valve of each branch port branched from an intake port in an internal combustion engine which incorporates a fuel injection valve mount structure and a fuel injection system according to a sixth embodiment of the present invention.
Figure 13:
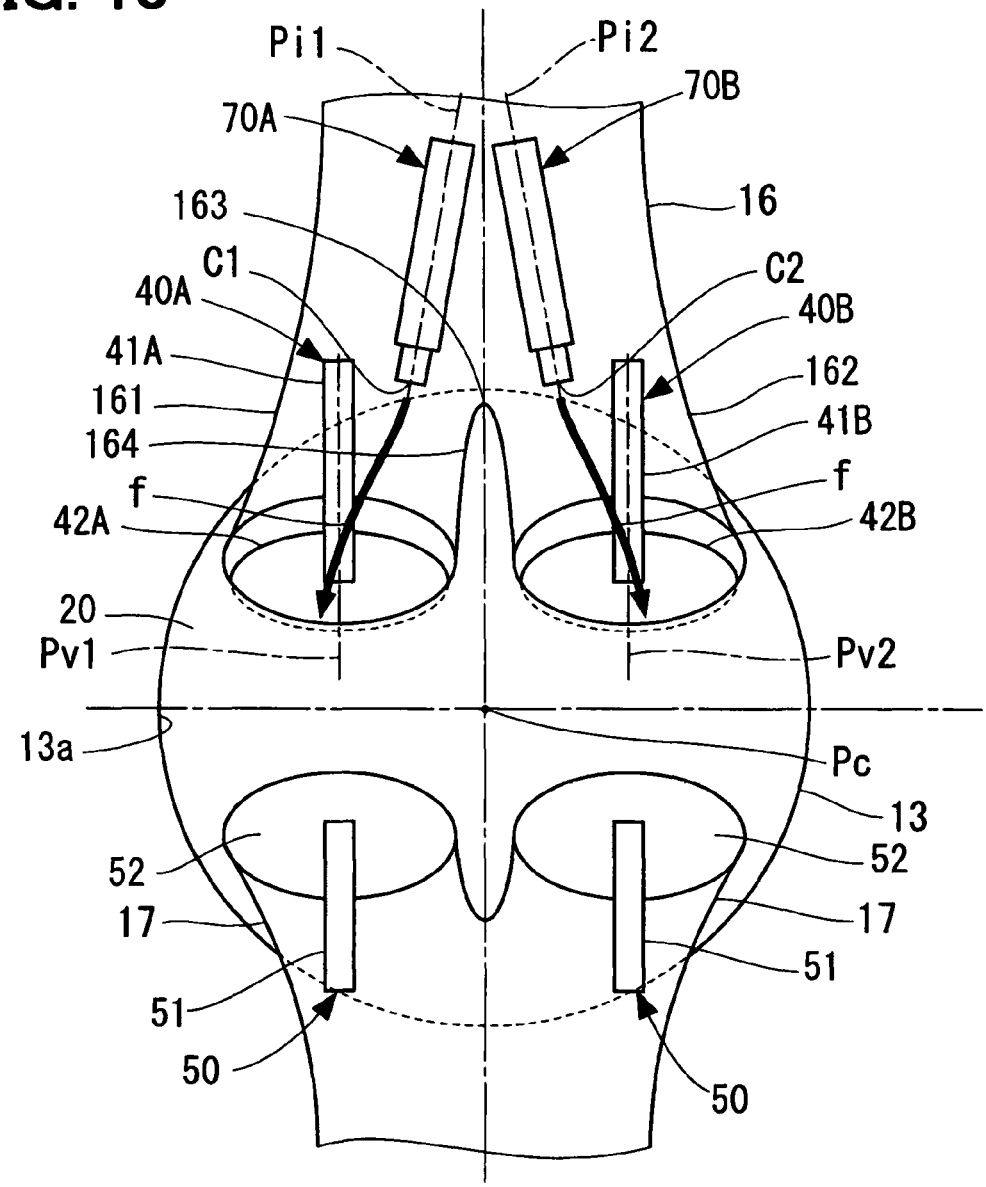
FIG. 13 is a schematic diagram illustrating the positions of an intake valve and a fuel injection valve of each branch port branched from an intake port in an internal combustion engine which incorporates a fuel injection valve mount structure and a fuel injection system according to a seventh embodiment of the present invention.

FIG. 12 shows the engine 10 according to the sixth embodiment, and FIG. 13 shows the engine 10 according to the seventh embodiment.

In the sixth embodiment, as shown in FIG. 12, the combustion chamber 20 side of the center axis Pi1 of the fuel injection valve 70A is tilted inwardly in the radial direction of the cylinder 13 relative to the center axis Pv1 of the intake valve 40A. Furthermore, the combustion chamber 20 side of the center axis Pi2 of the fuel injection valve 70B is tilted inwardly in the radial direction of the cylinder 13 relative to the center axis Pv2 of the intake valve 40B. The center C1 of the distal end portion of the fuel injection valve 70A is located on the radially inner side of the center axis Pv1 of the intake valve 40A where the center axis Pc of the cylinder 13 is located, and the center C2 of the distal end portion of the fuel injection valve 70B is located on the radially inner side of the center axis Pv2 of the intake valve 40B where the center axis Pc of the cylinder 13 is located. In this way, the fuel, which is injected from the fuel injection valves 70A, 70B, is injected toward the center axis Pc in the radial direction of the cylinder 13. Then, the injected fuel is carried outwardly in the radial direction of the cylinder 13, i.e., is carried toward the inner peripheral wall 13*a* of the cylinder 13 by the intake air flow from the intake port 16 into the branch ports 161, 162.

In the seventh embodiment, as shown in FIG. 13, the combustion chamber 20 side of the center axis Pi1 of the fuel injection valve 70A is tilted outwardly in the radial direction of the cylinder 13 relative to the center axis Pv1 of the intake valve 40A. Furthermore, the combustion chamber 20 side of the center axis Pi2 of the fuel injection valve 70B is tilted outwardly in the radial direction of the cylinder 13 relative to the center axis Pv2 of the intake valve 40B. The center C1 of the distal end portion of the fuel injection valve 70A is located on the radially inner side of the center axis Pv1 of the intake valve 40A where the center axis Pc of the cylinder 13 is located, and the center C2 of the distal end portion of the fuel injection valve 70B is located on the radially inner side of the center axis Pv2 of the intake valve 40B where the center axis Pc of the cylinder 13 is located. In this way, the fuel, which is injected from the fuel injection valve 70A and the fuel injection valve 70B, is carried by the intake air flow, which is drawn from the intake port 16 into the branch port 161 and the branch port 162, toward the inner peripheral wall 13*a*, which forms the cylinder 13.

As described above, in the sixth embodiment or the seventh embodiment, as long as the centers C1, C2 of the fuel injecting side end portions of the fuel injection valve 70A and of the fuel injection valve 70B are disposed closer to the center axis Pc of the cylinder 13 with respect to the center axis Pv1 of the intake valve 40A or the center axis Pv2 of the intake valve 40B, the center axis Pi1 of the fuel injection valve 70A or the center axis Pi1 of the fuel injection valve 70B may not be parallel to the center axis Pv1 of the intake valve 40A or the center axis Pv2 of the intake valve 40B. As described above, in the sixth embodiment or the seventh embodiment, the fuel injection valve 70A or the fuel injection valve 70B is disposed at the predetermined angle with respect to the intake valve 40A or the intake valve 40B. In this way, it possible to inject fuel to the desired location according to the intake air flow, which flows through the branch port 161 and the branch port 162. Thereby, it is possible to reduce the adhesion of fuel to the inner peripheral wall 13*a* of the cylinder 13, which forms the combustion chamber 20, regardless of the intake air flow in the branch port 161 and the branch port 162.

In the fifth to seventh embodiments, there are described the fuel injection valves 70A, 70B, in each of which the injection hole plate 72 is provided at the distal end of the body 74, as shown in FIG. 11.

Figure 14:
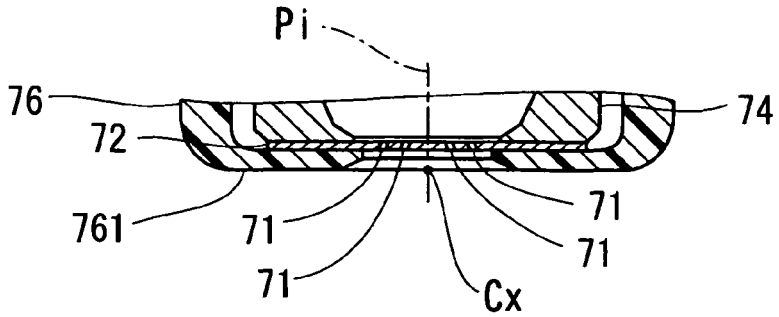
FIG. 14 is a schematic cross-sectional view illustrating the end portion of a fuel injection valve in a fuel injection valve mount structure and a fuel injection system according to a modified example of the fifth to seventh embodiments of the present invention.

In contrast to this, as shown in FIG. 14, there is provided a fuel injection valve, which includes a sleeve 76 that covers an outer side of the injection hole plate 72 installed to the distal end of the body 74. In the case of the fuel injection valve, which has the sleeve 76, the center Cx of the fuel injecting side distal end portion serves as a point, at which the distal end portion of the sleeve 76, i.e., an end face 761 of the sleeve 76 opposite to the body 74 intersects with the center axis Pi of the fuel injection valve.

Figure 15:
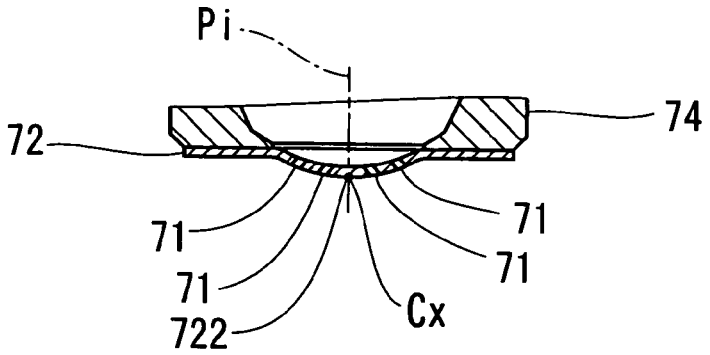
FIG. 15 is a schematic cross-sectional view illustrating the end portion of a fuel injection valve in a fuel injection valve mount structure and a fuel injection system according to a modified example of the fifth to seventh embodiments of the present invention.

Furthermore, as shown in FIG. 15, there is also another case where part of the injection hole plate 72 is formed to have a curved surface that protrudes toward the combustion chamber 20. In this case, the center Cx of the fuel injecting side end portion is a point, at which a projecting distal end portion 722 of the injection hole plate 72 intersects with the center axis Pi of the fuel injection valve.

Figure 16:
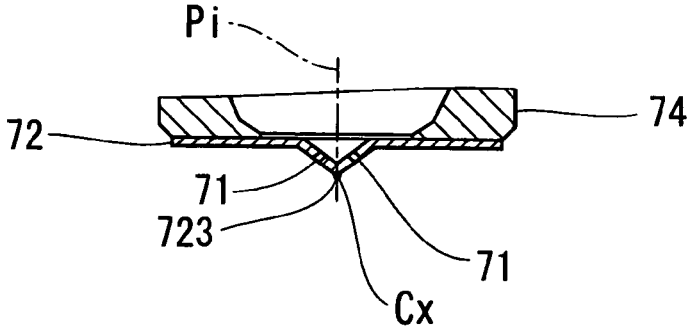
FIG. 16 is a schematic cross-sectional view illustrating the end portion of a fuel injection valve in a fuel injection valve mount structure and a fuel injection system according to a modified example of the fifth to seventh embodiments of the present invention.

As shown in FIG. 16, in a case where the injection hole plate 72 projects toward the combustion chamber 20, the center Cx of the fuel injecting side distal end portion is a point, at which the distal end portion 723 of the projecting injection hole plate 72 intersects with the center axis Pi of the fuel injection valve.

Figure 17:
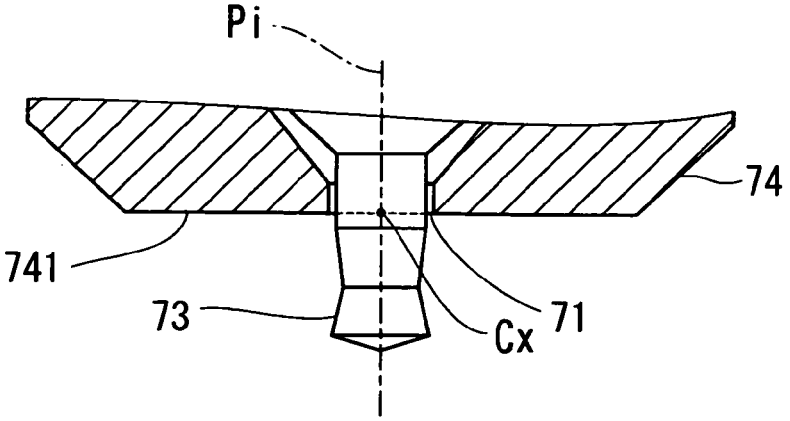
FIG. 17 is a schematic cross-sectional view illustrating the end portion of a fuel injection valve in a fuel injection valve mount structure and a fuel injection system according to a modified example of the fifth to seventh embodiments of the present invention.

As shown in FIG. 17, in a case where the distal end of the needle 73 projects from the distal end surface 741 of the body 74, the center Cx of the fuel injecting side end portion is a point, at which the distal end surface 741 of the body 74 intersects with the center axis Pi of the fuel injection valve.

Figure 18:
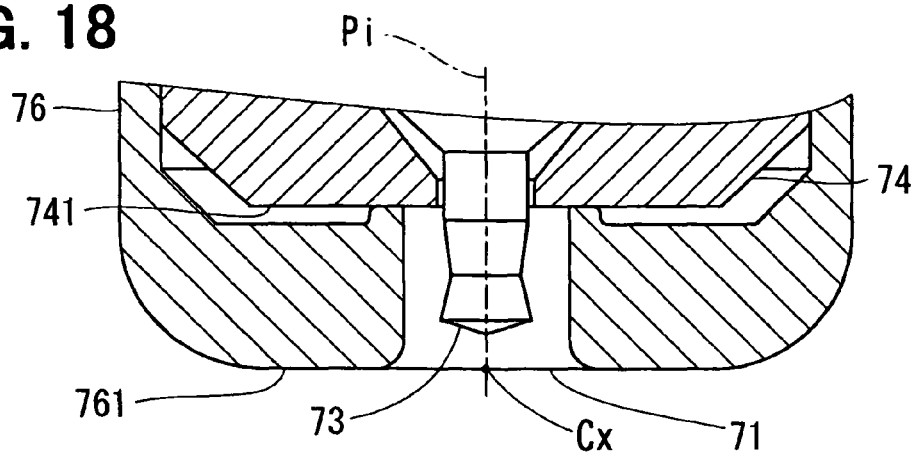
FIG. 18 is a schematic cross-sectional view illustrating the end portion of a fuel injection valve in a fuel injection valve mount structure and a fuel injection system according to a modified example of the fifth to seventh embodiments of the present invention.

Furthermore, as shown in FIG. 18, there is also a case where the distal end of the needle 73 projects from the distal end surface 741 of the body 74, and the sleeve 76 covers the outer side of the distal end of the needle 73. In this case, the center Cx of the fuel injecting side distal end portion is a point, at which the distal end surface 761 of the sleeve 76 intersects with the center axis Pi of the fuel injection valve.

As described above, regardless of the shape of the distal end portion of the fuel injection valve, the center Cx of the fuel injecting side distal end portion is defined as a portion, at which the end surface of the fixed member (e.g., the body 74 or the sleeve 76) that is closest to the combustion chamber 20 in the fixed member intersects with the center axis Pi of the fuel injection valve.

Now, a fuel injection system according to an eighth embodiment of the present invention will be described.

The fuel injection system according to the eighth embodiment includes an upstream side fuel injection valve in addition to the downstream side fuel injection valves, which are provided to the branch ports, respectively. The upstream side fuel injection valve is provided on the opposite side of the branching portion, which is opposite from the branch ports, i.e., is provided on the upstream side of the branching portion in the flow direction of the intake air. For example, in a case where the required fuel flow quantity is small, such as a case where the output of the engine is relatively low, the fuel is injected from the downstream side fuel injection valves. In this way, the relatively small quantity of fuel is injected from the downstream side injection valves into the respective branch ports. Thus, the fuel can be atomized. Furthermore, for example, in a case where the required fuel flow quantity becomes large, such as a case where the output of the engine is relatively high, the fuel is injected also from the upstream side fuel injection valve in addition to the downstream side fuel injection valves. In this way, additional fuel, which cannot be supplied by the downstream side fuel injection valves alone, is injected from the upstream side fuel injection valve into the intake port. When the large fuel flow quantity is required, the flow quantity of intake air, which flows through the intake port and the branch ports, is large. Therefore, even when the fuel, which is injected from the upstream side fuel injection valve provided on the upstream side of the branching portion, adheres to the wall surface of the respectively branch ports, the adhered fuel is volatilized by the intake air flow. Therefore, the required fuel flow quantity is achieved, and the fuel, which is sufficiently mixed with the intake air, is supplied to the combustion chamber.

Furthermore, in a case where a control means controls the injection quantity of fuel, which is injected from the upstream side fuel injection valve and the downstream side fuel injection valves, the injection quantity of fuel, which is injected from the upstream side fuel injection valve and the downstream side fuel injection valves, can be controlled according to, for example, the flow quantity of the intake air or the required output.

Furthermore, in the case where the control means operates the upstream side fuel injection valve to inject fuel at the time of encountering the shortage in the injection quantity of fuel injected from the downstream side fuel injection valves, when the required fuel flow quantity is small, the fuel is injected from the downstream side fuel injection valves. In this way, the relatively small quantity of fuel is injected from the downstream side injection valves into the respective branch ports. Then, for example, when the output becomes relatively high, and thereby the required fuel flow quantity becomes large, the fuel is injected from the upstream side fuel injection valve in addition to the downstream side fuel injection valves. When the large fuel flow quantity is required, the flow quantity of intake air, which flows through the intake port and the branch ports, is large. Therefore, even when the fuel, which is injected from the upstream side fuel injection valve provided on the upstream side of the branching portion, adheres to the wall surface of the respectively branch ports, the adhered fuel is volatilized by the intake air flow. Therefore, the required fuel flow quantity is achieved, and the fuel, which is sufficiently mixed with the intake air, is supplied to the combustion chamber.

Furthermore, in a case where the injection quantity of fuel injected from the upstream side fuel injection valve and the downstream side fuel injection valves is set according to the flow quantity of the intake air that is sensed with a flow quantity sensing means, when the flow quantity of the intake air is increased, the required fuel is increased, so that the fuel injection from the downstream side fuel injection valves alone causes shortage of the fuel. Therefore, when the flow quantity of the intake air becomes large, the control means operates the upstream side fuel injection valve to inject fuel in addition to the downstream side fuel injection valves. When the large fuel flow quantity is required, the flow quantity of intake air, which flows through the intake port and the branch ports, is large. Therefore, even when the fuel, which is injected from the upstream side fuel injection valve provided on the upstream side of the branching portion, adheres to the wall surface of the respectively branch ports, the adhered fuel is volatilized by the intake air flow. Therefore, the required fuel flow quantity is achieved, and the fuel, which is sufficiently mixed with the intake air, is supplied to the combustion chamber.

For example, when the temperature of the engine coolant is low, the temperature of the wall surface of the intake port is also low. Thus, the fuel, which adheres to the wall surface of the port, is not easily volatilized. Therefore, when the fuel is injected from the upstream side fuel injection valve, the fuel tends to adhere to the wall surface of the respective branch ports. In contrast, when the temperature of the engine coolant is high, the temperature of the wall surface of the intake port is also high. Thus, the fuel, which adheres to the wall surface of the port, is easily volatilized. Therefore, even when the fuel is injected from the upstream side fuel injection valve, the fuel does not tend to adhere to the wall surface of the respective branch ports on the downstream side of the branching portion. In the case where the injection quantity of fuel, which is injected from the upstream side fuel injection valve and the downstream side fuel injection valves, is set according to the temperature of the engine coolant that is sensed with the temperature sensing means, the required fuel flow quantity is achieved, and the fuel, which is sufficiently mixed with the intake air, can be supplied to the combustion chamber.

Figure 20:
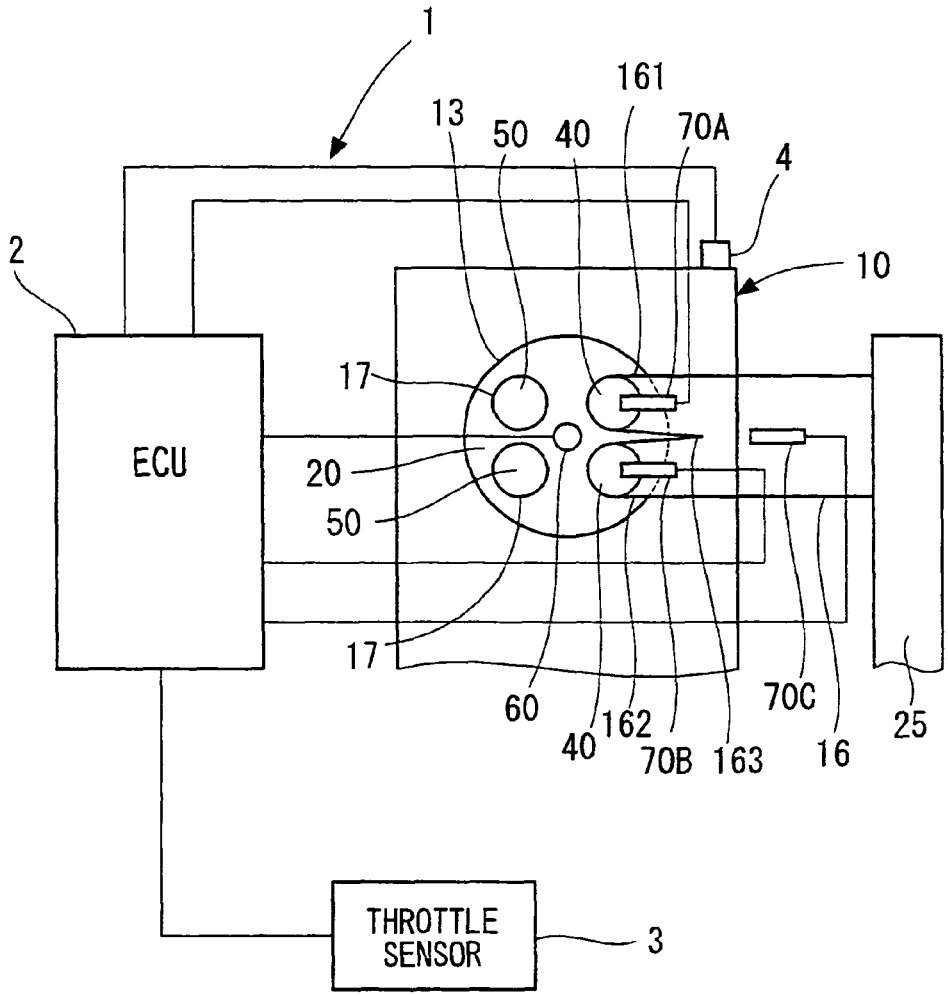
FIG. 20 is a schematic block diagram illustrating the structure of the internal combustion engine which incorporates the fuel injection system according to the eighth embodiment of the present invention.
Figure 21:
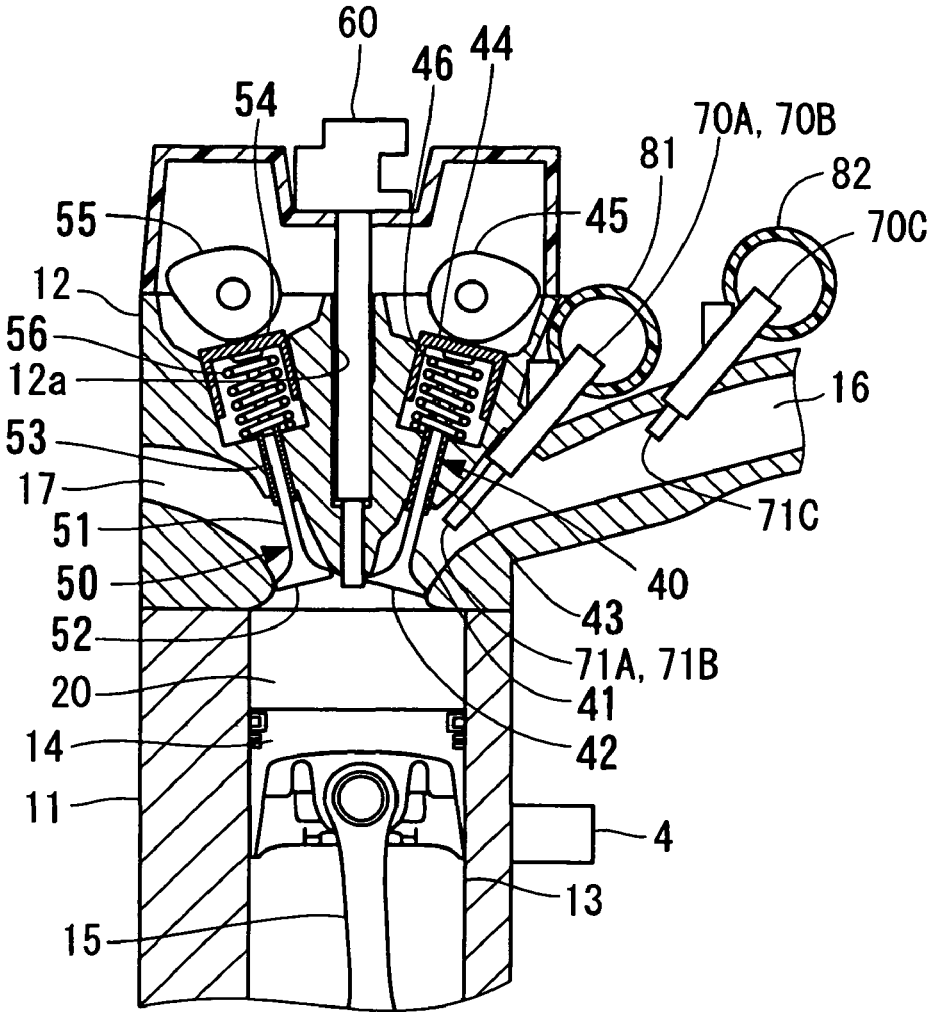
FIG. 21 is a schematic cross-sectional view illustrating the internal combustion engine which incorporates the fuel injection system according to the eighth embodiment of the present invention.

FIG. 20 shows an engine, in which a fuel injection system according to the eighth embodiment of the present invention is applied. An engine system 1 includes the engine 10 and a controller 2. As shown in FIG. 21, the engine 10 is, for example, a gasoline engine, which uses gasoline as its fuel. Here, it should be noted that the fuel may alternately be, for example, alcohol. Furthermore, the engine 10 is not limited to the gasoline engine and may also be, for example, a diesel engine.

The engine 10 includes a cylinder block 11 and a cylinder head 12. The cylinder block 11 forms a cylinder 13. The engine 10 has one or more cylinders 13. Each cylinder 13 receives a piston 14 therein. The piston 14 is reciprocated by a connecting rod 15 in an axial direction of the cylinder 13.

The cylinder head 12 is disposed at one end of the cylinder block 11. The cylinder head 12 forms an intake port 16 and an exhaust port 17. The engine 10 includes an intake valve 40 and an exhaust valve 50. The intake valve 40 penetrates through the cylinder head 12 and opens and closes the intake port 16. The exhaust valve 50 opens and closes the exhaust port 17.

The intake valve 40 extends through the cylinder head 12. The intake valve 40 has a shaft portion 41 and a valve portion 42. The shaft portion 41 is slidably supported by the cylinder head 12 through a gasket 43. One axial end portion of the shaft portion 41 is connected to the valve portion 42, and the other axial end portion of the shaft portion 41 is connected to an intake cam 45 through a tappet 44. A spring (resilient member) 46 is placed between the cylinder head 12 and the tappet 44. The spring 46 urges the tappet 44 in a direction away from the cylinder head 12. The tappet 44 moves integrally with the intake valve 40.

The exhaust valve 50 extends through the cylinder head 12. The exhaust valve 50 has a shaft portion 51 and a valve portion 52. The shaft portion 51 is movably supported by the cylinder head 12 through a gasket 53. One axial end portion of the shaft portion 51 is connected to the valve portion 52, and the other axial end portion of the shaft portion 51 is connected to an exhaust cam 55 through a tappet 54. A spring (resilient member) 56 is placed between the cylinder head 12 and the tappet 54. The spring 56 urges the tappet 54 in a direction away from the cylinder head 12. The tappet 54 moves integrally with the exhaust valve 50.

A space, which is defined by an inner peripheral wall surface of the cylinder 13 of the cylinder block 11, a cylinder block 11 side surface of the cylinder head 12, a cylinder head 12 side end surface of the piston 14, a piston 14 side end surface of the intake valve 40, and a piston 14 side end surface of the exhaust valve 50, is a combustion chamber 20. The combustion chamber 20 is communicatable with the intake port 16 and the exhaust port 17. As shown in FIG. 20, an opposite end portion of the intake port 16, which is opposite from the combustion chamber 20, is communicated with a surge tank 25. An end portion of the surge tank 25, which is opposite from the intake port 16, is communicated with an intake air guide (not shown). The air, which is introduced from the intake air guide, is supplied into the surge tank 25 through an air cleaner and a throttle (not shown). The surge tank 25 distributes the air, which is drawn from the intake air guide, to the intake ports 16, which are communicated with cylinders 13, respectively, of the engine 10.

As shown in FIG. 21, an igniter 60 is placed generally in the center of the combustion chamber 20. The igniter 60 is installed to extend through the cylinder head 12. The igniter 60 includes an ignition coil (not shown) and a spark plug (not shown), which are integrated together. A spark plug side end portion of the igniter 60 is exposed into the combustion chamber 20.

Figure 19:
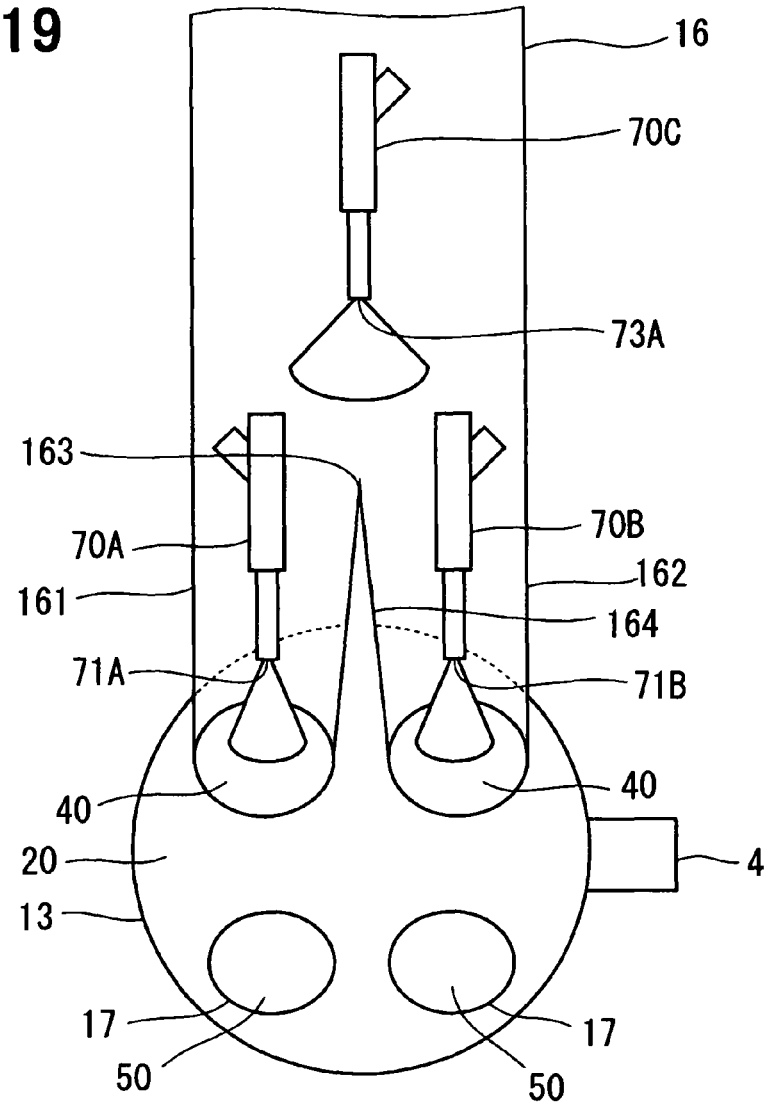
FIG. 19 is a schematic diagram illustrating the structure of a main portion of an internal combustion engine which incorporates a fuel injection system according to an eighth embodiment of the present invention.

In the eighth embodiment, as shown in FIG. 19, the combustion chamber 20 is in communication with two branch ports 161, 162, which are branched from the intake port 16. Furthermore, the combustion chamber 20 is communicated with two exhaust ports 17. That is, the engine 10 of the eighth embodiment is a 4-valve engine. Alternatively, three or more branch ports 161, 162 and/or three or more exhaust ports 17 of the engine 10 may be provided to communicate with the combustion chamber 20. Further alternately, the number of intake ports may be different from the number of exhaust ports. For example, three intake ports and two exhaust ports may be communicated with the combustion chamber 20 to implement a five valve engine.

The intake port 16 is branched into the two branch ports 161, 162 at the branching portion 163, which is located between the surge tank 25 and the combustion chamber 20. In this way, the intake air, which is drawn from the surge tank 25 into the intake port 16, is distributed to the two branch ports 161, 162 at the branching portion 163. In the case of the eighth embodiment, the two branch ports 161, 162 have generally the same inner diameter. A wall portion 164 is provided between the branch port 161 and the branch port 162 to partition therebetween.

As shown in FIG. 21, the cylinder head 12 is provided with fuel injection valves 70A, 70B, 70C. As shown in FIG. 19, the fuel injection valves 70A, 70B are provided to the branch ports 161, 162, respectively. Furthermore, the fuel injection valve 70C is provided in the middle of the intake port 16. In this way, the three fuel injection valves are provided in the intake port 16 and the branch ports 161, 162. Each fuel injection valve 70A, 70B, 70C extends through the cylinder head 12. One axial end portion of each of the fuel injection valves 70A, 70B is exposed in the corresponding branch port 161, 162, and the other axial end portion of the fuel injection valve 70A, 70B is connected to a fuel rail 81. One axial end portion of the fuel injection valve 70C is exposed into the intake port 16, and the other axial end portion of the fuel injection valve 70C is connected to a fuel rail 82.

Each of the fuel injection valves 70A, 70B has injection holes 71A, 71B at the end portion thereof, which is opposite from the fuel rail 81. The fuel injection valve 70C has injection holes 71C at the end portion thereof, which is opposite from the fuel rail 82. The fuel rail 81 and the fuel rail 82 are supported by, for example, the cylinder head 12. Fuel is supplied from a fuel tank (not shown) to the fuel rails 81, 82. The fuel injection valves 70A, 70B inject the fuel, which is supplied to the fuel rail 81, from the injection holes 71A, 71B into the intake air that flows in the branch ports 161, 162, respectively. The fuel, which is supplied to the fuel rail 82, is injected from the injection holes 71C of the fuel injection valve 70C into the intake air that flows in the intake port 16.

In the eighth embodiment, the fuel injection valves 70A, 70B are installed in the branch ports 161, 162, respectively, and the fuel injection valve 70C is installed in the intake port 16. In this way, the injection hole 71C side end portion of the fuel injection valve 70C is placed on the opposite side of the branching portion 163, which is opposite from the combustion chamber 20, i.e., is placed on the upstream side of the branching portion 163 in the flow direction of the intake air. Thereby, the fuel injection valve 70C serves as an upstream side fuel injection valve of the accompanying claims. Furthermore, the injection hole 71A, 71B side end portion of the fuel injection valve 70A, 70B is placed on the side of the branching portion 163 where the combustion chamber 20 is located, i.e., is placed on the downstream side of the branching portion 163 in the flow direction of the intake air. Thereby, the fuel injection valves 70A, 70B serve as upstream side fuel injection valves of the accompanying claims.

The injection hole 711 side end portion of the fuel injection valve 70A and the injection hole 721 side end portion of the fuel injection valve 70B are placed on the combustion chamber 20 side of the branching portion 163. Further, the injection angle of the fuel, which is injected from the fuel injection valve 70A, and the injection angle of the fuel, which is injected from the fuel injection valve 70B are set based on the inner diameters of the branch ports 161, 162, respectively. That is, the injection angle of the fuel, which is injected from the fuel injection valve 70A, and the injection angle of the fuel, which is injected from the fuel injection valve 70B, are respectively set to a corresponding angle, which does not cause adhesion of the fuel to the inner wall of the cylinder head 12, which forms the corresponding branch port 161, 162. Thereby, the fuel, which is injected from the fuel injection valves 70A, 70B, does not adhere to the partition wall portion 164, which partitions between the branch port 161 and the branch port 162.

The controller (ECU) 2 shown in FIG. 20 is a microcomputer, which includes, for example, a CPU, a ROM and a RAM. The controller 2 is connected to the fuel injection valves 70A, 70B, 70C of the engine 10. The controller 2 outputs a drive signal to the fuel injection valves 70A, 70B, 70C to control the timing of fuel injection at the respective fuel injection valves 70A, 70B, 70C. The controller 2 is connected to a throttle sensor 12, which senses an opening degree of a throttle (not shown). The flow quantity of the intake air at the intake port 16 and the branch ports 161, 162 is correlated with the opening degree of the throttle. Therefore, the controller 2 senses the flow quantity of the intake air, which flows in the intake port 16 and the branch ports 161, 162, by sensing the opening degree of the throttle (not shown) with the throttle sensor 12. Therefore, the throttle sensor 12 serves as a flow quantity sensing means of the accompanying claims.

The controller 2 is connected not only to the fuel injection valves 70A, 70B, 70C and the throttle sensor 12 but also to the igniter 60 and a coolant temperature sensor 4. The controller 2 outputs a drive signal to the igniter 60 to ignite the air-fuel mixture in the combustion chamber 20 at predetermined timing. The coolant temperature sensor 4 measures the temperature of the engine coolant (not shown). Therefore, the coolant temperature sensor 4 serves as a temperature sensing means of the accompanying claims.

The controller 2 is also connected to a rotational speed sensor (not shown) and the like. The rotational speed sensor (not shown) measures a rotational speed of the engine 10. The controller 2 measures the operational state and the load state of the engine 10 based on the measurements of the throttle sensor 12, the coolant temperature sensor 4 and the rotational speed sensor and sets the injection quantity of fuel, which is injected from the fuel injection valves 70A, 70B, 70C.

Next, the operation of the controller 2 for controlling the fuel injection valves 70A, 70B, 70C will be described.

When the controller 2 controls the fuel injection valves 70A, 70B, 70C based on the flow quantity of the intake air, the controller 2 measures the opening degree of the throttle (not shown) through the throttle sensor 12. As described above, the opening degree of the throttle correlates to the flow quantity of the intake air in the intake port 16 and the branch ports 161, 162. For example, when the throttle is not substantially opened, i.e., when the engine 10 is operated in an idling state, the flow quantity of the intake air at the intake port 16 and the branch ports 161, 162 becomes minimum. In contrast, when the opening degree of the throttle is increased and becomes fully open, the engine 10 is placed in a high output state, and the flow quantity of the intake air in the intake port 16 and the branch ports 161, 162 increases. Therefore, the controller 2 senses the flow quantity of the intake air, which flows in the intake port 16 and the branch ports 161, 162, by sensing the opening degree of the throttle (not shown) with the throttle sensor 12.

The controller 2 controls the fuel injection from the fuel injection valves 70A, 70B, 70C based on the sensed flow quantity of the intake air. When the flow quantity of the intake air is relatively small, the controller 2 outputs the drive signal to the fuel injection valves 70A, 70B. In this way, the fuel is injected from the fuel injection valves 70A, 70B, which are placed in the two branch ports 161, 162, respectively. The fuel, which is injected from each of the fuel injection valves 70A, 70B, is supplied into the intake air that flows in the corresponding one of the branch ports 161, 162.

When the flow quantity of the intake air is relatively small, the flow quantity of the intake air in the branch ports 161, 162 is also small. Thus, when the injection quantity of fuel from the fuel injection valves 70A, 70B is increased, the fuel is not sufficiently mixed with the intake air and tends to adhere to the inner wall of the cylinder head 12, which forms the branch ports 161, 162. The fuel, which becomes the fuel droplets and adheres to the inner wall of the cylinder head 12, flows along the inner wall of the cylinder head 12 while maintaining the liquid state thereof. The liquid state fuel is not mixed with the intake air, which is drawn into the combustion chamber 20, so that the combustion in the combustion chamber 20 becomes incomplete. Therefore, the liquid state fuel does not contribute to the output of the engine 10 and thereby results in the deterioration in the fuel consumption, so that the uncombusted hydrocarbon (HC), which is included in the exhaust gas, is increased.

In the eighth embodiment, when the flow quantity of the intake air is relatively small, the fuel is injected from the fuel injection valves 70A, 70B, which are placed in the branch ports 161, 162, respectively. Thereby, the flow quantity of fuel, which is injected from the fuel injection valves 70A, 70B, can be reduced. By reducing the flow quantity of fuel, which is injected from the fuel injection valves 70A, 70B, the diameter of the respective injection holes 71A, 71B of the fuel injection valves 70A, 70B can be made small. The atomization of the fuel, which is injected from the fuel injection valves 70A, 70B, is promoted in the greater degree when the diameter of the respective injection holes 71A, 71B is made smaller. Therefore, the atomization of the fuel, which is injected from the fuel injection valves 70A, 70B, is promoted by reducing the flow quantity of fuel, which is injected from the fuel injection valves 70A, 70B, and by reducing the diameter of the respective injection holes 71A, 71B of the fuel injection valves 70A, 70B. As a result, the fuel, which is injected from the fuel injection valves 70A, 70B into the branch ports 161, 162, is sufficiently mixed with the intake air that flows in the branch ports 161, 162. In this way, even in the case where the flow quantity of the intake air is relatively small, the atomized fuel is sufficiently mixed with the intake air. Thus, the fuel is sufficiently combusted in the combustion chamber 20. Thereby, it does not result in the deterioration in the fuel consumption, and it is possible to reduce the amount of HC contained in the exhaust gas.

When the flow quantity of the intake air is relatively small, the controller 2 does not output the drive signal to the fuel injection valve 70C. Thus, the fuel injection valve 70C does not inject fuel into the intake air, which flows in the intake port 16. When the flow quantity of the intake air is relatively small, the fuel, which is required for the operation of the engine 10, is injected from the fuel injection valves 70A, 70B, which are placed in the branch ports 161, 162, respectively. Thus, the fuel, which is required by the engine 10, can be sufficiently supplied by the fuel injection from the fuel injection valves 70A, 70B. Therefore, the engine 10 is operated in the stable manner although the fuel is not injected from the fuel injection valve 70C, which is placed in the intake port 16.

In the case where the flow quantity of the intake air is relatively small, when the fuel is injected from the fuel injection valve 70C, portion of the fuel, which is injected from the fuel injection valve 70C, may possibly adhere to the wall portion 164, which partitions between the branch ports 161, 162. In the case where the flow quantity of the intake air is small, the fuel, which adheres to the wall portion 164, may become the fuel droplets, which then flow into the combustion chamber 20 along the wall portion 164 through the branch ports 161, 162. The fuel in the droplet state cannot be combusted sufficiently, as discussed above. Thus, when the flow quantity of the intake air is relatively small, the controller 2 stops the injection of the fuel from the fuel injection valve 70C. Thereby, it is possible to reduce the adhesion of the fuel to the wall portion 164 and the flow of the adhered fuel into the combustion chamber 20. Thereby, it does not result in the deterioration in the fuel consumption, and it is possible to reduce the amount of HC contained in the exhaust gas.

In contrast, when the flow quantity of the intake air becomes relatively large, i.e., when the engine 10 is required to provide the large output, the controller 2 outputs the drive signal to the fuel injection valve 70C, which is placed in the intake port 16, in addition to the fuel injection valves 70A, 70B, which are placed in the branch ports 161, 162. When the engine 10 is required to provide the large output, the flow quantity of the intake air is increased, and the required flow quantity of fuel is also increased. At this time, there is an upper limit in the flow quantity of fuel, which can be injected from the fuel injection valves 70A, 70B that are placed in the branch ports 161, 162, respectively. Thus, the fuel, which is injected from the fuel injection valves 70A, 70B, becomes short with respect to the required flow quantity of fuel. In view of this, the controller 2 outputs the drive signal to the fuel injection valve 70C when the injection quantity of fuel from the fuel injection valves 70A, 70B becomes short. In this way, in addition to the fuel injection valves 70A, 70B, the fuel injection valve 70C injects fuel into the intake air, which flows in the intake port 16.

When the output of the engine 10 is increased, the flow quantity of the intake air, which flows in the intake port 16 and the branch ports 161, 162, is increased. Therefore, even when the fuel, which is injected from the fuel injection valve 70C, adheres to the wall portion 164, which partitions between the branch ports 161, 162, the adhered fuel is volatilized by the intake air flow. As a result, the volatilized fuel is easily mixed with the intake air, which flows in the intake port 16 and the branch ports 161, 162. Thus, the mixing of the fuel and the intake air can be promoted while the sufficient flow quantity of fuel is achieved.

When the controller 2 controls the fuel injection valves 70A, 70B, 70C based on the temperature of the engine coolant, the controller 2 senses the temperature of the engine coolant (not shown) through the coolant temperature sensor 4. The controller 2 controls the fuel injection from the fuel injection valves 70A, 70B, 70C based on the sensed temperature of the engine coolant. When the temperature of the engine coolant is relatively low, the controller 2 outputs the drive signal to the fuel injection valves 70A, 70B. In this way, the fuel is injected from the fuel injection valves 70A, 70B, which are placed in the two branch ports 161, 162, respectively. The fuel, which is injected from each of the fuel injection valves 70A, 70B, is supplied into the intake air that flows in the corresponding one of the branch ports 161, 162.

When the temperature of the engine coolant is relatively low, the temperature of the wall surface of the intake port is also low. Thus, the fuel, which adheres to the wall surface of the port, is not easily volatilized. Thus, when the injection quantity of fuel from the fuel injection valves 70A, 70B is increased, the injected fuel is not sufficiently mixed with the intake air and tends to adhere to the inner wall of the cylinder head 12, which forms the branch ports 161, 162. The fuel, which becomes the fuel droplets and adheres to the inner wall of the cylinder head 12, flows along the inner wall of the cylinder head 12 while maintaining the liquid state thereof. The liquid state fuel is not mixed with the intake air, which is drawn into the combustion chamber 20, so that the combustion in the combustion chamber 20 becomes insufficient. Therefore, the liquid state fuel does not contribute to the output of the engine 10 and thereby results in the deterioration in the fuel consumption, so that the uncombusted HC, which is included in the exhaust gas, is increased.

In the eighth embodiment, when the temperature of the engine coolant is relatively low, the fuel is injected from the fuel injection valves 70A, 70B, which are placed in the branch ports 161, 162, respectively. Thereby, the flow quantity of fuel, which is injected from the fuel injection valves 70A, 70B, can be reduced. By reducing the flow quantity of fuel, which is injected from the fuel injection valves 70A, 70B, the diameter of the respective injection holes 71A, 71B of the fuel injection valves 70A, 70B can be made small. The atomization of the fuel, which is injected from the fuel injection valves 70A, 70B, is promoted in the greater degree when the diameter of the respective injection holes 71A, 71B is made smaller. Therefore, the atomization of the fuel, which is injected from the fuel injection valves 70A, 70B, is promoted by reducing the flow quantity of fuel, which is injected from the fuel injection valves 70A, 70B, and by reducing the diameter of the respective injection holes 71A, 71B of the fuel injection valves 70A, 70B. As a result, the fuel, which is injected from the fuel injection valves 70A, 70B into the branch ports 161, 162, is sufficiently mixed with the intake air that flows in the branch ports 161, 162. In this way, even in the case where the temperature of the engine coolant is relatively low, the atomized fuel is sufficiently mixed with the intake air. Thus, the fuel is sufficiently combusted in the combustion chamber 20. Thereby, it does not result in the deterioration in the fuel consumption, and it is possible to reduce the amount of HC contained in the exhaust gas.

When the temperature of the engine coolant is relatively low, the controller 2 does not output the drive signal to the fuel injection valve 70C. Thus, the fuel injection valve 70C does not inject fuel into the intake air, which flows in the intake port 16. When the temperature of the engine 10 is low like in the state right after the starting of the engine 10, the temperature of the components of the intake system, which supplies the intake air to the engine 10, is also low. Furthermore, when the temperature of the engine 10 is low in the state, for example, right after the starting of the engine 10, the rotational speed and the load of the engine 10 are also low. Therefore, even when the fuel is not injected from the fuel injection valve 70C, which is placed in the intake port 16, the engine main body is operated in the stable manner by the fuel, which is injected from the fuel injection valves 70A, 70B that are placed in the branch ports 161, 162, respectively.

In the state where the temperature of the engine coolant is relatively low (not only in the state right after the starting of the engine 10), when the fuel is injected from the fuel injection valve 70C, portion of the fuel, which is injected from the fuel injection valve 70C, may possibly adhere to the wall portion 164, which partitions between the branch ports 161, 162, not only at the time of right after the starting of the engine 10. When the temperature of the engine coolant is low, the fuel, which adheres to the wall portion 164, becomes the fuel droplets, and these fuel droplets flow into the combustion chamber 20 along the wall portion 164 through the branch ports 161, 162. The fuel in the droplet state cannot be combusted sufficiently, as discussed above. Therefore, when the temperature of the engine coolant is low, the controller 2 stops the injection of fuel from the fuel injection valve 70C. Thereby, it is possible to reduce the adhesion of the fuel to the wall portion 164 and the flow of the adhered fuel into the combustion chamber 20. Thereby, it does not result in the deterioration in the fuel consumption, and it is possible to reduce the amount of HC contained in the exhaust gas.

In contrast, when the output of the engine 10 becomes large to cause the increase in the temperature of the engine 10, the temperature of the intake air system is increased, and the temperature of the engine coolant is also increased. When the output of the engine 10 is increased, the flow quantity of fuel, which is required by the engine 10, is increased. Therefore, the controller 2 outputs the drive signal to the fuel injection valve 70C, which is placed in the intake port 16, in addition to the fuel injection valves 70A, 70B, which are placed in the branch ports 161, 162.

There is an upper limit in the flow quantity of fuel, which can be injected from the fuel injection valves 70A, 70B that are placed in the branch ports 161, 162, respectively. Thus, when the flow quantity of fuel, which is required by the engine 10, is increased, the fuel, which is injected from the fuel injection valves 70A, 70B alone, becomes short. Therefore, the controller 2 outputs the drive signal to the fuel injection valve 70C in the state where the temperature of the engine coolant is high, and the injection quantity of fuel from the fuel injection valves 70A, 70B becomes short relative to the flow quantity of the intake air, which is sensed based on the opening degree of the throttle. In this way, in addition to the fuel injection valves 70A, 70B, the fuel injection valve 70C injects fuel into the intake air, which flows in the intake port 16.

When the temperature of the engine coolant is high, the temperature of the wall surface of the intake port is also high. Thus, even when the fuel, which is injected from the fuel injection valve 70C, adheres to the wall portion 164, which partitions between the branch ports 161, 162, the adhered fuel is volatilized. As a result, the volatilized fuel is easily mixed with the intake air, which flows in the intake port 16 and the branch ports 161, 162. Thus, the mixing of the fuel and the intake air can be promoted while the sufficient flow quantity of fuel is achieved.

In the eighth embodiment, the control operation of the fuel injection valves 70A, 70B, 70C based on the flow quantity of the intake air is described separately from the control operation of the fuel injection valves 70A, 70B, 70C based on the temperature of the engine coolant. However, the injection of the fuel from the injection valves 70A, 70B, 70C may be controlled based on the combination of the flow quantity of the intake air and the temperature of the engine coolant. Also, the flow quantity of the intake air and the temperature of the engine coolant, which are used to determine whether the fuel needs be injected from the fuel injection valve 70C, can be set to any appropriate values based on, for example, the flow quantity of fuel, which is injected from the fuel injection valves 70A, 70B, 70C.

Furthermore, in the eighth embodiment, there is described the case where the fuel is injected from the fuel injection valve 70C, which is placed in the intake port 16, when the injection quantity of fuel from the fuel injection valves 70A, 70B, which are placed in the branch ports 161, 162, becomes short. However, in the case where the flow quantity of the intake air is large, or the temperature of the engine coolant is high, the fuel may be injected only from the fuel injection valve 70C, which is placed in the intake port 16, while stopping the fuel injection from the fuel injection valves 70A, 70B, which are placed in the branch ports 161, 162. That is, the injection quantity of fuel from the fuel injection valve 70C, which is placed in the intake port 16, may be set to be larger than a sum of the injection quantities of the fuel injection valves 70A, 70B, which are placed in the branch ports 161, 162.

As described above, in the eighth embodiment, in the case where the intake air and the fuel cannot be mixed sufficiently, such as in the case of the small flow quantity of the intake air or in the case of the low temperature of the engine coolant, the small quantity of fuel is injected from the fuel injection valves 70A, 70B, which are placed in the branch ports 161, 162, respectively. In the case where the small quantity of fuel is injected from the fuel injection valves 70A, 70B, the diameter of the respective injection holes is made small, so that the atomization of the fuel is promoted. Therefore, even when the flow quantity of the intake air is small, or the temperature of the engine coolant is low, the intake air, which flows in the branch ports 161, 162, is sufficiently mixed with the fuel. Thereby, the fuel is sufficiently combusted in the combustion chamber 20. Thus, the deterioration in the fuel consumption does not occur, and it is possible to reduce the amount of HC contained in the exhaust gas.

In contrast, in the case where the flow quantity of fuel, which is required by the engine 10, is large, such as in the case of the large flow quantity of the intake air or in the case of the high temperature of the engine coolant, the fuel is injected from the fuel injection valve 70C, which is placed in the intake port 16. Thus, even in the case where the fuel, which is injected from the fuel injection valves 70A, 70B placed in the branch ports 161, 162, alone is not enough, the sufficient fuel can be supplied into the combustion chamber 20. Furthermore, when the flow quantity of the intake air is large, or the temperature of the engine coolant is high, the temperature of the wall surface of the intake port is high. Thus, even when the fuel is injected from the fuel injection valve 70C, which is placed on the upstream side of the branching portion 163 for branching to the branch ports 161, 162, and thereby adheres to the wall portion 164, the adhered fuel is volatilized due to the high temperature of the wall surface of the port. Thus, the fuel is supplied into the combustion chamber 20 upon being sufficiently mixed with the intake air. Thereby, the enough flow quantity of fuel and the sufficient combustion of the fuel can be both achieved.

In the eighth embodiment, there is described the exemplary case where the flow quantity of the intake air is sensed based on the opening degree of the throttle, which is measured with the throttle sensor 12. Alternatively, the flow quantity of the intake air may be sensed based on the opening degree of the accelerator. Furthermore, the flow quantity sensor may be placed in the intake port 16 or the branch ports 161, 162, and the flow quantity of the intake air may be sensed with the flow quantity sensor.

Hereinafter, fuel injection systems according to ninth to sixteenth embodiments of the present invention will be described.

In each of the fuel injection systems according to the ninth to sixteenth embodiments, fuel injection valves are provided to two or more intake ports, respectively, which are communicated with the combustion chamber. Thus, the fuel is injected from the fuel injection valves into the intake ports, respectively. An injection quantity control means controls the injection quantity of fuel for each of the fuel injection valves. Thereby, for example, when the intake valve closes the connection between the intake port and the combustion chamber, the fuel injection valve, which is placed in the closed intake port, may be controlled to stop the injection of the fuel. In this way, it is possible to independently control the injection quantity of fuel, which is injected from each of the fuel injection valves placed in the intake ports, respectively. Therefore, it is possible to limit occurrence of stagnation of the injected fuel in the intake port and the deterioration in the fuel consumption of the engine. Also, it is possible to reduce the amount of uncombusted HC discharged from the engine.

Furthermore, in the case where the injection quantity control means controls the injection quantity of fuel from each fuel injection valve based on the flow quantity of the intake air at the corresponding intake port, when one intake valve closes the connection between the intake port and the combustion chamber to limit the flow of the intake air into this intake port, it is possible to execute the control operation for stopping the fuel injection into this intake port. As described above, the fuel injection control operation can be performed based on the flow quantity of the intake air at each intake port. Thus, it is possible to more effectively limit the occurrence of the stagnation of the injected fuel in the intake port.

Furthermore, in the case where injection quantity control means controls the injection quantity of fuel from each fuel injection valve based on the amount of lift of the intake valve, when the amount of lift of the intake valve is small, the flow quantity of the intake air at the intake port, which is opened and closed by that intake valve, becomes small. Then, when the amount of lift of the intake valve is increased, the flow quantity of the intake air at the intake port is increased. In contrast, when the amount of lift of the intake valve is zero, i.e., when the intake valve closes the intake port, the intake air does not flow into this intake port. As described above, the amount of lift of the intake valve correlates to the flow quantity of the intake air at the corresponding intake port, which is opened and closed by this intake valve. Therefore, by controlling the injection quantity of fuel from the fuel injection valve based on the amount of lift of the intake valve, it is possible to inject the corresponding amount of fuel, which corresponds to the flow quantity of the intake air at each intake port. Therefore, it is possible to limit the occurrence of the stagnation of the fuel in the intake port.

When the load of the engine is low, the flow quantity of the intake air, which is drawn into the engine, i.e., the required quantity of the intake air becomes small. Thus, previously, in the case of the engine, which has the multiple intake ports communicated with the one combustion chamber, the control operation is performed such that one of the intake valves is closed while the other intake valves are opened. As described above, when the opening and closing of the intake valve are not uniformly performed among the intake valves, the flow of the fuel, which is supplied into the combustion chamber, becomes biased, so that the formation of the air-fuel mixture is promoted. As a result, the combustion state in the combustion chamber is improved. Thereby, it is possible to improve the fuel consumption and to reduce the amount of HC discharged from the engine. However, in the previously proposed technique, the fuel is injected from the one fuel injection valve into the two or more intake ports, so that the fuel mist flows toward the closed intake port, at which the intake valve is closed. Therefore, portion of the injected fuel remains in the closed intake port. When the closed intake port is opened due to a change in the operational state, the fuel remained in this intake port flows into the combustion chamber while maintaining the liquid state of the fuel. As a result, combustion of the fuel in the liquid state becomes incomplete, and thereby the uncombusted HC is disadvantageously increased.

Therefore, when the amount of lift of the intake valve becomes equal to or less than a predetermined value, the injection of the fuel from the fuel injection valve associated with this intake port is stopped. In this way, when the intake port is closed by the intake valve, or the amount of lift of the intake valve is small, the fuel is not injected from the fuel injection valve placed in this intake port. As a result, the fuel, which remains in the interior of the intake port, is reduced. Thus, the uncombusted HC is reduced, and the fuel consumption is improved.

Furthermore, in the case where the fuel injection valves, which are provided to the two or more intake ports, respectively, are controlled based on the characteristics thereof, the appropriate quantity of fuel is injected into the respective intake ports with the simple control operation while limiting the stagnation of the fuel in the interior of the respective intake ports. Therefore, it is possible to limit the deterioration of the fuel consumption of the engine and to reduce the amount of uncombusted HC discharged from the engine.

Previously, at the time of starting the engine, when the time elapsed since the starting of the engine is short, or when the temperature of the engine is low, the fuel is injected from the fuel injection valve before occurrence of the opening of the intake port by the intake valve. Like in this case where the fuel is injected from the fuel injection valve before occurrence of the opening of the intake port, and the atomization of the injected fuel and the volatilization of the fuel are promoted, it is possible to reduce the amount of uncombusted HC discharged from the engine at the time of stating the engine. In contrast, for example, in the case where the engine load is large, for example, at the large opening degree of the throttle (WOT: Wide Open Throttle), the fuel is injected from the fuel injection valve while the intake valve opens the intake port. In this way, the air in the combustion chamber is cooled by the latent heat of vaporization of the injected fuel. As a result, the air density in the combustion chamber is reduced, and thereby the engine output is improved. In this case, the open time period of the intake port, which is opened by the intake valve, is short, so that the injection quantity of fuel per unit time needs to be increased to improve the torque. However, when the injection quantity of fuel per unit time is increased excessively, the atomization of the injected fuel is limited. As a result, it is difficult to achieve both of the reduction of the amount of HC discharged from the engine at the time of starting the engine and the improvement of the output of the engine at the time of the high load.

In order to address the above disadvantage, the injection quantity of fuel per unit time and the injection time period are varied from one to another in the two or more fuel injection valves. In this way, for example, in the state right after the starting of the engine, the fuel is injected from one of the two or more fuel injection valves, which is designed to have a small injection quantity of fuel per unit time. For example, in the state right after the starting of the engine, the fuel is injected from the fuel injection valve before occurrence of the opening of the intake port by the intake valve. Therefore, the time period from the starting of the engine to the occurrence of the opening of the intake port by the intake valve becomes relatively long. As a result, the fuel is injected for the relatively long time period from the fuel injection valve, which is designed to have the small injection quantity of fuel per unit time. In this way, the atomization of the fuel is promoted, and the required quantity of fuel is provided. In contrast, in the case where the load of the engine is large, for example, in the WOT state, the fuel is injected from another one of the fuel injection valves, which is designed to have a large injection quantity of fuel per unit time. For example, in the state where the load of the engine is large, the fuel is injected from the fuel injection valve while the intake port is opened by the intake valve. Therefore, the open time period of the intake port, which is opened by the intake valve, i.e., the injection time period of the fuel from the fuel injection valve becomes short. As a result, the fuel is injected for the relatively short time period from the fuel injection valve, which is designed to have the large injection quantity of fuel per unit time. In this way, the fuel, which is injected from the fuel injection valve, flows directly into the combustion chamber to reduce the temperature of the combustion chamber. Furthermore, when the injection quantity of fuel per unit time is made large, the required quantity of fuel is provided. Therefore, it is possible to achieve both of the reduction of the HC at the time of starting the engine and the improvement of the output of the engine at the time of the high load.

Previously, in the case where the engine has two or more intake valves, it is known to supply a small quantity of air into the combustion chamber by opening and closing at least one of the intake valves after closing of the intake valves in the low load state of the engine. In this way, the air flow in the combustion chamber is increased, and the combustion in the combustion chamber is improved, thereby improving the fuel consumption. However, in a case where at least one of the intake valves is opened and closed, when the fuel is injected from one of the fuel injection valves, the fuel also flows toward the closed intake valve. Thus, the fuel remains in the interior of the intake port, which is closed by the intake valve. Then, when the intake valve is opened, this remaining fuel in the liquid state is directly supplied into the combustion chamber. As a result, the fuel may not be combusted sufficiently, and thereby uncombusted HC may possibly be discharged from the engine.

In view of this, in the case where the number of fuel injections per unit time is controlled for each of two or more fuel injection valves, it is possible to reduce the fuel, which remains in the intake port, particularly, in the intake port, at which the intake valve is closed. Thus, it is possible to achieve both of the improvement of the fuel consumption and the reduction of the amount of HC discharged from the engine.

Furthermore, the inner diameters of the two or more intake ports may be different from one another, and the injection angles of the fuel injection valves may be set based on the inner diameters of the intake ports. Specifically, when the inner diameter of the intake port is small, the injection angle of the fuel, which is injected from the injection valve, may be set to small. Also, when the inner diameter of the intake port is large, the injection angle of the fuel, which is injected from the injection valve, may be set to large. In such a case, it is possible to limit adhesion of the fuel, which is injected from the respective fuel injection valves, to the wall surface of the respective intake ports. For example, when the fuel, which is injected from the fuel injection valve, adheres to the wall surface of the intake port, the adhered fuel becomes fuel droplets and flows into the combustion chamber. The fuel, which becomes the fuel droplets and is supplied into the combustion chamber, does not contribute to the combustion, so that such fuel is discharged from the engine as the uncombusted fuel. In the fuel injection system according to the present aspect, the injection angle of the fuel, which is injected from the fuel injection valve, is set based on the inner diameter of the corresponding intake port. Thus, the adhesion of the fuel to the wall surface of the intake port is reduced. Therefore, the supply of the fuel, which is in the droplet state, into the combustion chamber is reduced. Thereby, it is possible to limit the deterioration of the fuel consumption of the engine and to reduce the amount of uncombusted HC discharged from the engine. Furthermore, in the present fuel injection system, the two or more fuel injection valves have different injection angles, respectively. The injection angle of the first fuel injection valves is set based on the inner diameter of the intake port. The injection angle of the second fuel injection valve is set to be wider than the injection angle of the first fuel injection valve. In the case where the fuel is injected in the closed state of the respective intake valves, the injection quantity of fuel from the first fuel injection valve is controlled to be larger than the injection quantity of fuel from the second fuel injection valve. Furthermore, in the case where the fuel is injected in the open state of the respective intake valves, the injection quantity of fuel from the second fuel injection valve is controlled to be larger than the injection quantity of fuel from the first fuel injection valve. In this way, it is possible to reduce the deterioration of the fuel consumption of the engine and to reduce the amount of uncombusted HC discharged from the engine. Furthermore, in the state where the load of the engine is large, when the fuel is injected at the time of opening the intake valves, the output of the engine can be improved.

Furthermore, in the case where the fuel injection valves are placed in the two or more intake ports, respectively, which are communicated with the combustion chamber, the fuel is injected to the respective intake ports. An injection timing control means controls the injection timing of the respective fuel injection valves, which inject fuel into the intake ports, respectively. In this way, for example, the injection timing of the fuel injection valves may be shifted from one another, so that the fuel concentration may be locally changed in the intake air, which is drawn into the combustion chamber, or such a local change of fuel concentration may be eliminated. For example, the fuel, which is injected in the early stage, may be used to form the fuel mist of high concentration at a location adjacent to the igniter to improve the ignitability of the air-fuel mixture. Furthermore, in the engine operational condition, at which the valve open time period is long, when the fuel is completely injected within a short time period, the time of supplying only the air to the cylinder is increased, so that the homogeneous air-fuel mixture cannot be formed. However, in the case where the injection time period is shifted from one to another in the fuel injection valves, it is possible to provide a more uniform air to fuel ratio, and thereby the output of the engine can be improved.

Furthermore, in the case where the injection timing of the fuel injection valves is controlled based on the opening and closing timing of the intake valves, respectively, an appropriate fuel mist is formed in the interior of the combustion chamber in accordance with the flow of the intake air formed in the combustion chamber through the opening and closing of the intake valve. Therefore, the ignitability of the air-fuel mixture can be improved, and the amount of uncombusted HC discharged from the engine can be reduced.

Furthermore, the fuel injection valves include an early stage fuel injection valve and a late stage fuel injection valve. In the case where the injection timing of the fuel from the early stage fuel injection valve is set to timing before the lifting of the intake valve by the fuel injection timing control means, the fuel, which is injected from the early stage fuel injection valve, is drawn into the combustion chamber along with the intake air upon the lifting of the intake valve. At this time, the fuel is not yet injected from the late stage fuel injection valve. Therefore, in the interior of the combustion chamber, a swirl flow is created by the pressure difference in the intake air, which is caused by the pressure difference in the injected fuel. As a result, the fuel mist, which has the high fuel concentration, is formed at the location, for example, adjacent to the igniter. After the starting of the injection of the fuel from the early stage fuel injection valve, the injection timing control means starts the injection of the fuel from the late stage fuel injection valve. Thus, the required quantity of fuel, which is required to provide the output of the engine, is achieved by the fuel, which is injected from the respective fuel injection valves. Therefore, particularly, even when the quantity of the intake air drawn into the combustion chamber is small at, for example, the idling state of the engine, the stable combustion can be achieved with the small quantity of fuel. Thereby, it is possible to improve the fuel consumption and to reduce the amount of uncombusted HC discharged from the engine.

Figure 23:
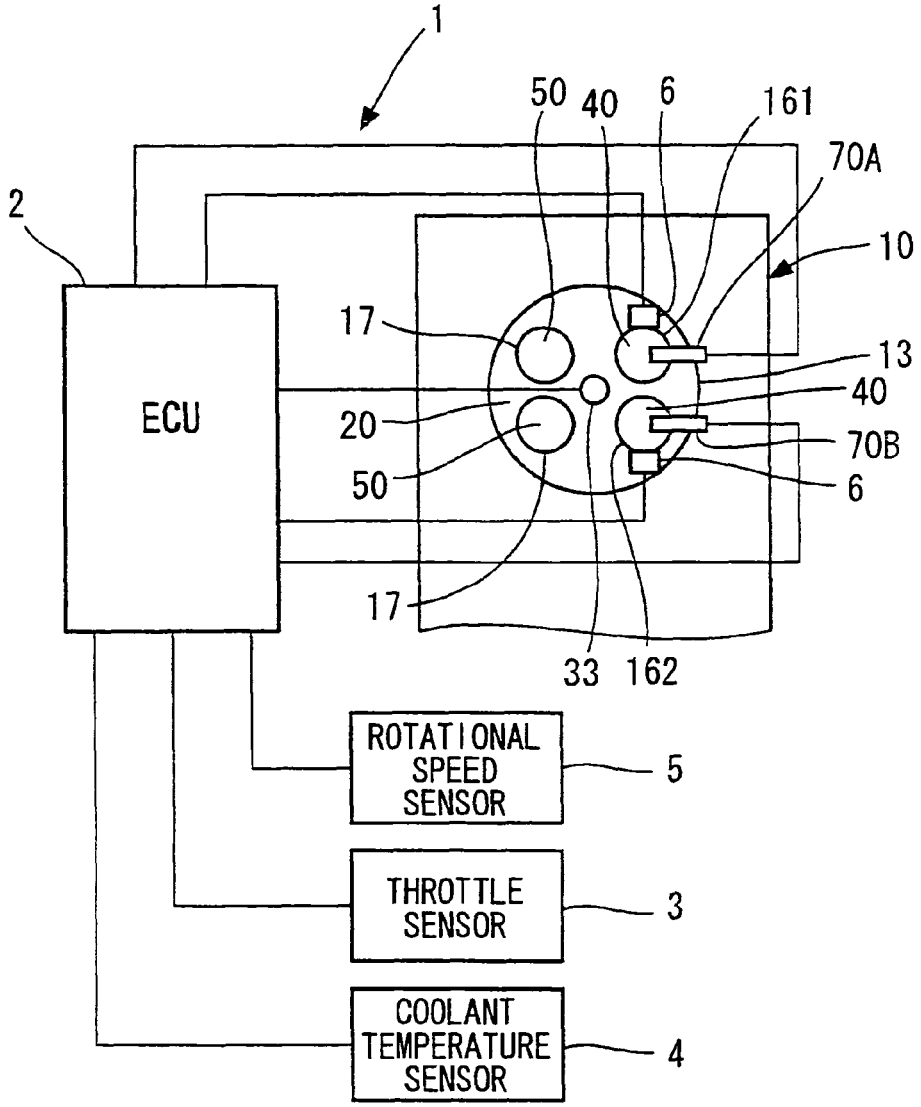
FIG. 23 is a schematic block diagram illustrating the structure of the internal combustion engine which incorporates the fuel injection system according to the ninth embodiment of the present invention.
Figure 24:
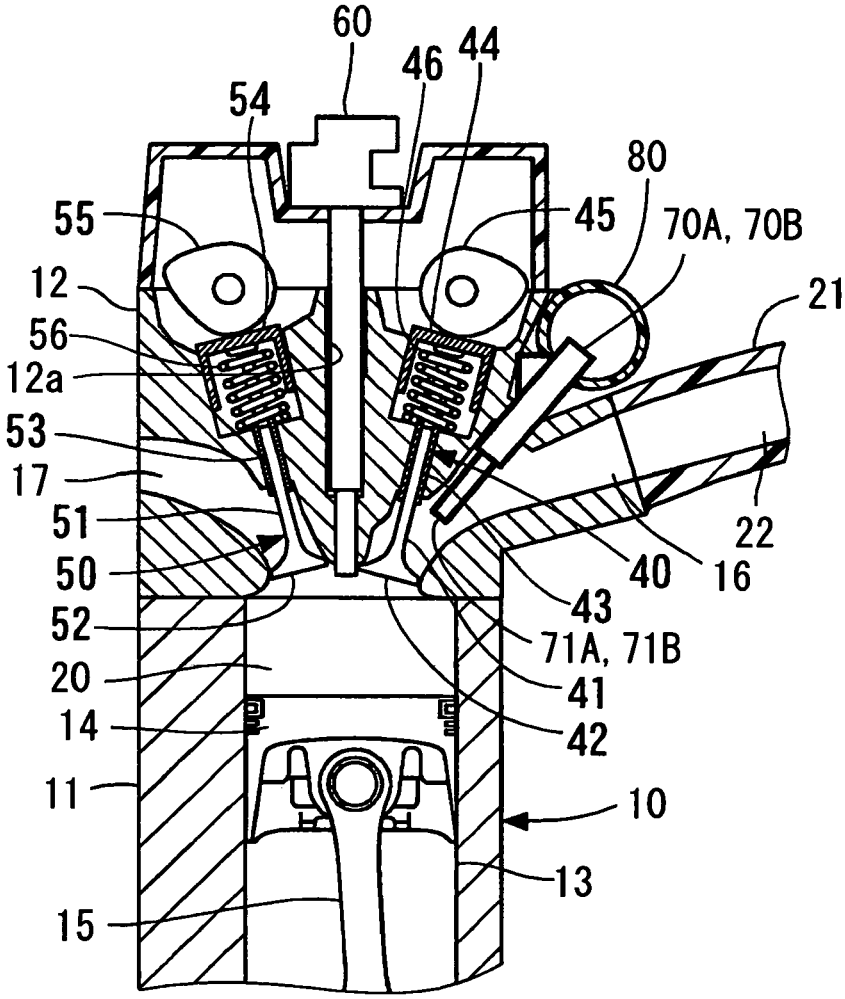
FIG. 24 is a schematic cross-sectional view illustrating the internal combustion engine which incorporates the fuel injection system according to the ninth embodiment of the present invention.

FIG. 23 shows an engine system, in which a fuel injection system according to the ninth embodiment of the present invention, is applied. The engine system 1 includes the engine 10 and a controller (a control means) 2 of the fuel injection system. As shown in FIG. 24, the engine 10 is, for example, a gasoline engine, which uses gasoline as its fuel. Here, it should be noted that the fuel may alternately be, for example, alcohol.

The engine 10 includes a cylinder block 11 and a cylinder head 12. The cylinder block 11 forms a cylinder 13. The engine 10 has one or more cylinders 13. Each cylinder 13 receives a piston 14 therein. The piston 14 is reciprocated by a connecting rod 15 in an axial direction of the cylinder 13.

The cylinder head 12 is disposed at one end of the cylinder block 11. The cylinder head 12 forms an intake port 16 and an exhaust port 17. The engine 10 includes an intake valve 40 and an exhaust valve 50. The intake valve 40 penetrates through the cylinder head 12 and opens and closes the intake port 16. The exhaust valve 50 opens and closes the exhaust port 17.

The intake valve 40 extends through the cylinder head 12. The intake valve 40 has a shaft portion 41 and a valve portion 42. The shaft portion 41 is slidably supported by the cylinder head 12 through a gasket 43. One axial end portion of the shaft portion 41 is connected to the valve portion 42, and the other axial end portion of the shaft portion 41 is connected to an intake cam 45 through a tappet 44. The valve portion 42 opens and closes the end portion of the intake port 16. A spring (resilient member) 46 is placed between the cylinder head 12 and the tappet 44. The spring 46 urges the tappet 44 in a direction away from the cylinder head 12. The tappet 44 moves integrally with the intake valve 40. Therefore, the spring 46 urges the intake valve 40 in a closing direction thereof for closing the intake port 16 with the intake valve 40.

The exhaust valve 50 extends through the cylinder head 12. The exhaust valve 50 has a shaft portion 51 and a valve portion 52. The shaft portion 51 is slidably supported by the cylinder head 12 through a gasket 53. One axial end portion of the shaft portion 51 is connected to the valve portion 52, and the other axial end portion of the shaft portion 51 is connected to an exhaust cam 55 through a tappet 54. The valve portion 52 opens and closes the end portion of the exhaust port 17. A spring (resilient member) 56 is placed between the cylinder head 12 and the tappet 54. The spring 56 urges the tappet 54 in a direction away from the cylinder head 12. The tappet 54 moves integrally with the exhaust valve 50. Therefore, the spring 56 urges the exhaust valve 50 in the closing direction thereof for closing the exhaust port 17.

A space, which is defined by an inner peripheral wall surface of the cylinder 13 of the cylinder block 11, a cylinder block 11 side surface of the cylinder head 12, a cylinder head 12 side end surface of the piston 14, a piston 14 side end surface of the intake valve 40, and a piston 14 side end surface of the exhaust valve 50, is a combustion chamber 20. The combustion chamber 20 is communicatable with the intake port 16 and the exhaust port 17. The connection between the combustion chamber 20 and the intake port 16 is opened and closed by the intake valve 40. The connection between the combustion chamber 20 and the exhaust port 17 is opened and closed by the exhaust valve 50. An opposite end portion of the intake port 16, which is opposite from the combustion chamber 20, is communicated with an intake passage 22, which is formed by an intake manifold 21. An opposite end portion of the intake manifold 21, which is opposite from the combustion chamber 20, is communicated with an intake air guide (not shown). The air, which is introduced from the intake air guide, is guided through an air cleaner, a throttle, and a surge tank and is then supplied from the intake air passage 22 of the intake manifold 21 into the intake port 16.

Figure 22A:
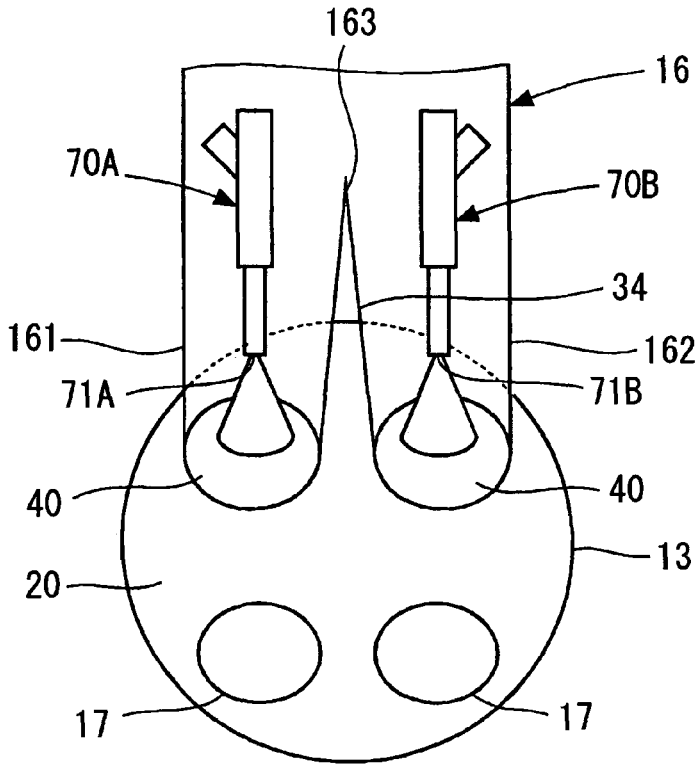
FIG. 22(A) is a schematic view illustrating the structure of a main portion of an internal combustion engine which incorporates a fuel injection system according to a ninth embodiment of the present invention, FIG. 22(B) being a timing chart showing the drive timing of each fuel injection valve in FIG. 22(A)

In the ninth embodiment, as shown in FIG. 22(A), two intake ports 16 and two exhaust ports 17 are communicated with the combustion chamber 20. That is, the engine 10 of the ninth embodiment is a 4-valve engine. Alternatively, three or more intake ports 16 and/or three or more exhaust ports 17 of the engine 10 may be provided to communicate with the combustion chamber 20. Further alternately, the number of intake ports 16 may be different from the number of exhaust ports 17. For example, three intake ports 16 and two exhaust ports 17 may be communicated with the combustion chamber 20 to implement a valve engine.

As shown in FIG. 24, an igniter 60 is placed generally in the center of the combustion chamber 20. The igniter 60 is installed to extend through the cylinder head 12. The igniter 60 includes an ignition coil (not shown) and a spark plug (not shown), which are integrated together. A spark plug side end portion of the igniter 60 is exposed into the combustion chamber 20.

As shown in FIGS. 22(A) and 24, fuel injection valves 70A, 70B are placed in the intake ports 16 at the cylinder head 12. As shown in FIG. 24, the fuel injection valves 70A, 70B extend through the cylinder head 12. One axial end portion of each of the fuel injection valves 70C, 70B is exposed into the intake port 16, and the other axial end portion of each of the fuel injection valves 70A, 70B is connected to a fuel rail 82. Each of the fuel injection valves 70A, 70B has injection holes 71A, 71B at the end portion thereof, which is opposite from the fuel rail 80. The fuel rail 80 is supported by, for example, the cylinder head 12. Fuel is supplied from a fuel tank (not shown) to the fuel rail 80. The fuel injection valves 70A, 70B inject the fuel, which is supplied to the fuel rail 80, from the injection holes 71A, 71B into the intake air that flows in the intake port 16.

In the ninth embodiment, as shown in FIG. 22(A), the intake port 16, which is communicated with the combustion chamber 20, is branched into two intake ports 161, 162. The two fuel injection valves 70A, 70B are placed in the two intake ports 161, 162, respectively. Specifically, the injection hole 71A, 71B side end portion of each of the fuel injection valve 70A, 70B is placed on the combustion chamber 20 side of the branching portion 163 for branching to the two intake ports 161, 162. As a result, it is possible to limit the adhesion of the fuel, which is injected from the fuel injection valve 70A and the fuel injection valve 70B, to the wall portion 164, which partitions between the intake port 161 and the intake port 162. In the ninth embodiment, the injection quantity Q1 of fuel injected from the fuel injection valve 70A per unit time is substantially the same as the injection quantity Q2 of fuel injected from the fuel injection valve 70B per unit time.

The controller (ECU) 2 shown in FIG. 23 is a microcomputer, which includes, for example, a CPU, a ROM and a RAM. The controller 2 is connected to the respective fuel injection valves 70A, 70B of the engine 10. The controller 2 outputs a drive signal to the respective fuel injection valves 70A, 70B to control the timing of fuel injection at the respective fuel injection valves 70A, 70B. The controller 2 is connected to lift sensors 6, each of which measures the amount of lift of the corresponding one of the intake valves 40. As in the case of the ninth embodiment where the two intake ports 161, 162 are communicated to the one combustion chamber 20, the lift sensors 6 are respectively provided to the intake valves 40, which open and close the intake ports 161, 162, respectively. In this way, the controller 2 senses the amount of lift of each intake valve 40.

The controller 2 is connected not only to the fuel injection valves 70A, 70B and the lift sensors 6 of the intake valves 40 but also to, for example, an igniter 60, a rotational speed sensor 5, a throttle sensor 3 and a coolant temperature sensor 4. The controller 2 outputs a drive signal to the igniter 60 to ignite the air-fuel mixture in the combustion chamber 20 at predetermined timing. The rotational speed sensor 5 measure the rotational speed of the engine 10. The throttle sensor 3 measures an opening degree of a throttle (not shown). The coolant temperature sensor 4 measures the temperature of the coolant of the engine 10. The controller 2 senses the operational state and the load state of the engine 10 based on the measurements of the rotational speed sensor 5, the throttle sensor 3 and the coolant temperature sensor 4 and sets the injection quantity of fuel, which is injected from the fuel injection valves 70A, 70B.

For example, when the engine system 1 has the valve lift amount variable device or a valve timing variable device (not show), the amount of lift of the respective intake valves 40 is changed according to the rotational speed or load of the engine 10. Furthermore, depending on the rotational speed or load of the engine 10, one of the intake valves 40 may not be driven at all in some cases. When the amount of lift of each intake valve 40 is changed in this manner, the flow quantity of the intake through the corresponding intake port 161, 162 is changed based on the amount of lift of the intake valve 40. Thus, the controller 2 senses the amount of lift of each intake valve 40 to sense the flow quantity of the intake air, which flows through the corresponding intake port 161, 162. For example, when the intake valves 40 closes the intake ports 161, 162, the flow of the intake air is not formed in the intake ports 161, 162. In contrast, when the amount of lift of each intake valve 40 is increased, the flow quantity of the intake air, which flows through the corresponding intake port 161, 162, is increased.

When the flow of the intake air is not generated in the intake ports 161, 162, the intake valves 40 close the intake ports 161, 162. Thus, when the fuel is injected from the fuel injection valves 70A, 70B, the injected fuel remains on the side of the respective intake valves 40, which is opposite from the combustion chamber 20, i.e., remains in the interior of the respective intake ports 161, 162. Furthermore, in the case where the flow quantity of the intake air at the intake port 162 is smaller than the flow quantity of the intake air at the intake port 161 due to a difference between the opening degrees of the intake valves 40, when the same quantity of fuel, which is the same as that of the fuel injection valve 70A of the intake port 161, is injected from the fuel injection valve 70B of the intake port 162, the injected fuel becomes excessive relative to the flow quantity of the intake air at the intake port 162. A portion of the excessive fuel becomes fuel droplets and remains in the interior of the intake port 162.

The fuel, which remains in the interior of the intake port 162, flows into the combustion chamber 20 while maintaining the liquid state thereof when the intake valve 40 of the intake port 162 is opened due to a change in the rotational speed or the load of the engine 10. The fuel in the liquid state is not atomized sufficiently, so that the combustion of such fuel becomes insufficient. The fuel, the combustion of which is insufficient, does not contribute to the output of the engine 10. Therefore, the amount of uncombusted HC discharged from the engine 10 is increased, and the fuel consumption of the engine 10 is deteriorated.

In the ninth embodiment, the controller 2 senses the amount of lift of each intake valve 40. Then, the controller 2 sets the injection quantity of fuel from each fuel injection valve 70A, 70B based on the sensed amount of lift of the corresponding intake valve 40. The controller 2 reduces the injection quantity of fuel from the respective fuel injection valves 70A, 70B in the case where the amount of lift of the respective intake valves 40, which open and close the intake ports 161, 162, is small, and thereby the flow quantity of the intake air, which flows through the respective intake ports 161, 162, is small. In contrast, the controller 2 increases the injection quantity of fuel from the respective fuel injection valves 70A, 70B in the case where the amount of lift of the respective intake valves 40, which open and close the intake ports 161, 162, is large, and thereby the flow quantity of the intake air, which flows through the respective intake ports 161, 162, is large. Furthermore, the controller 2 stops the injection of the fuel from the fuel injection valves 70A, 70B in the case where the intake valves 40 are not lifted, i.e., when the flow of the intake air is not generated in the respective intake ports 161, 162. As described above, the controller 2 controls the respective fuel injection valves 70A, 70B, which inject the fuel into the intake ports 161, 162, respectively, based on the flow quantity of the intake air at the respective intake ports 161, 162, which are communicated with the combustion chamber 20.

Furthermore, the controller 2 may stop the injection of the fuel from the fuel injection valves 70A, 70B when the amount of lift of the respective intake valves 40 becomes equal to or less than a predetermined value. In the case where the multiple intake valves 40 are provided like in the ninth embodiment, the amount of lift of one of the intake valves 40 possibly becomes smaller, or one of the intake valves 40 possibly becomes non-liftable. When the amount of lift of the intake valve 40 becomes equal to or smaller than the predetermined value like in the above case where the amount of lift of the intake valve 40 becomes smaller or the intake valve 40 becomes non-liftable, the intake air is substantially not supplied to the intake port 161 or the intake port 162 where the amount of the corresponding intake valve 40 is small. When the fuel is injected from the fuel injection valve 70A or the fuel injection valve 70B in the state where the flow of the intake air is not substantially generated in the corresponding intake port 161, 162, the injected fuel remains in the intake port 161, 162 on the upstream side of the intake valve 40, i.e., on the side of the intake valve 40, which is opposite from the combustion chamber 20. The fuel, which remains in the intake port 161, 162, tends to adhere to the shaft portion 41 or the valve portion 42 of the corresponding intake valve 40 or tends to adhere to the wall portion 164 or wall surface of the intake port 161, 162. The adhered fuel becomes fuel droplets and remains in the intake port 161, 162. Then, when the intake valve 40 is opened due to the change in the operational state of the engine 10, such fuel may possibly flow into the combustion chamber 20 while maintaining the droplet state thereof. Because of the above reason, the controller 2 stops the injection of the fuel from the fuel injection valves 70A, 70B when the amount of lift of the intake valve 40 becomes equal to or less than the predetermined value. Therefore, the flow of the fuel in the droplet state from the intake ports 161, 162 into the combustion chamber 20 can be reduced. Thereby, it is possible to reduce the amount of uncombusted HC discharged from the engine and to improve the fuel consumption of the engine.

Figure 22B:
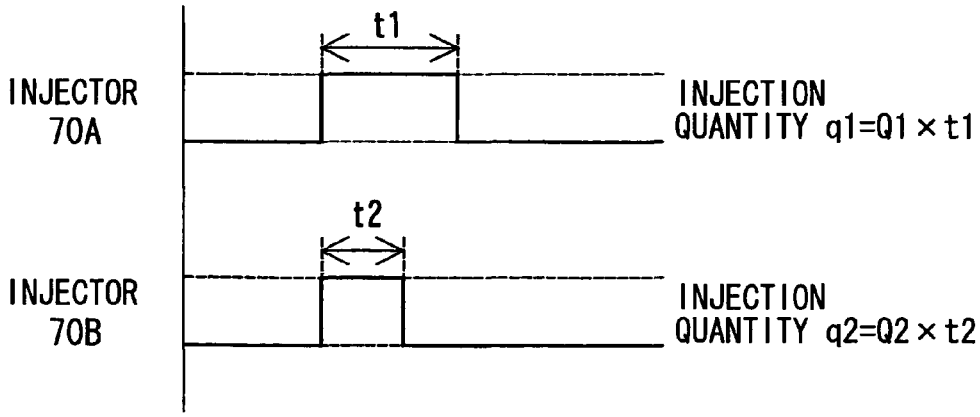

In the ninth embodiment, the fuel injection characteristic of the fuel injection valve 70A is generally the same as the fuel injection characteristic of the fuel injection valve 70B. Specifically, the injection quantity Q1 of fuel injected from the fuel injection valve 70A per unit time is substantially the same as the injection quantity Q2 of fuel injected from the fuel injection valve 70B per unit time. Thus, as indicated in FIG. 22(B), the controller 2 changes a drive time period t1 of the fuel injection valve 70A and a drive time period t2 of the fuel injection valve 70B according to the amount of lift of the corresponding intake valve 40, i.e., according to the flow quantity of the intake air at the corresponding intake port 161, 162. When the drive time periods t1, t2 of the fuel injection valves 70A, 70B are long, i.e., when output time periods of the drive signals from the controller 2 to the fuel injection valves 70A, 70B are long, the valve open time periods of the fuel injection valves 70A, 70B become long. Therefore, the injection quantities q1, q2 of fuel from the fuel injection valves 70A, 70B are increased. In contrast, when the output time periods of the drive signals from the controller 2 to the fuel injection valves 70A, 70B are short, the valve open time periods of the fuel injection valves 70A, 70B become short. Therefore, the injection quantities q1, q2 from the fuel injection valves 70A, 70B are reduced. As discussed above, the injection quantities q1, q2 of fuel from the fuel injection valves 70A, 70B are controlled by controlling the output time periods of the drive signals to the fuel injection valves 70A, 70B. As an example, the injection quantity of fuel injected from the fuel injection valve 70A per unit time is denoted as Q1, and the injection quantity of fuel injected from the fuel injection valve 70B per unit time is denoted as Q2. In the ninth embodiment, the relation of Q1=Q2 is implemented. As shown in FIG. 22(B), the drive time period of the fuel injection valve 70A is denoted as t1, and the drive time period of the fuel injection valve 70B is denoted as t2. At this time, the injection quantity q1 of fuel from the fuel injection valve 70A is expressed as q1=Q1×t1. Also, the injection quantity q2 of fuel from the fuel injection valve 70B is expressed as q2=Q2×t2. A relation of q1>q2 is established due to the relation of Q1=Q2 and the relation of t1>t2. Therefore, the injection quantity q1 of fuel from the fuel injection valve 70A into the intake port 161 and the injection quantity q2 of the fuel from the fuel injection valve 70B into the intake port 162 can be set by changing the drive time periods of the fuel injection valves 70A, 70B.

As described above, in the ninth embodiment, the fuel injection valves 70A, 70B are placed in the intake ports 161, 162, which are communicated with the combustion chamber 20. Thus, the fuel injected from the fuel injection valves 70A, 70B flow into the combustion chamber 20 while limiting adhesion of the fuel, which is injected from the fuel injection valves 70A, 70B, to the wall portion 164, which partitions between the intake port 161 and the intake port 162. As a result, the inflow of the fuel, which adheres to the wall portion 164 and becomes the droplet state, into the combustion chamber 20 is reduced, and the incomplete combustion of the fuel is reduced. Thereby, the amount of uncombusted HC discharged from the engine 10 is reduced, and the fuel consumption of the engine 10 is improved.

Also, in the ninth embodiment, the flow quantity of the intake air, which flows in the respective intake ports 161, 162 communicated with the combustion chamber 20, is sensed based on the amount of lift of the respective intake valves 40. Then, the controller 2 controls the injection quantities q1, q2 of fuel from the fuel injection valves 70A, 70B based on the flow quantities of the intake air in the intake ports 161, 162. Thereby, the excess fuel is not injected from the respective fuel injection valves 70A, 70B, which inject the fuel into the intake ports 161, 162. In this way, it is possible to limit the stagnation of the excess fuel in the intake ports 161, 162 and also to limit the inflow of the fuel in the droplet state into the combustion chamber 20. As a result, the incomplete combustion of the fuel is reduced. Thereby, the amount of uncombusted HC discharged from the engine 10 is reduced, and the fuel consumption of the engine 10 is improved.

Furthermore, in the ninth embodiment, the controller 2 controls the injection quantities q1, q2 of fuel from the fuel injection valves 70A, 70B by changing the drive time periods t1, t2 of the fuel injection valves 70A, 70B. Thus, the injection quantity of fuel can be controlled in a reliable and accurate manner with the simple structure.

An engine system, in which a fuel injection system according to a tenth embodiment of the present invention is applied, will be described. In the following description, components similar to those of the ninth embodiment will be indicated by the same numerals and will not be described further for the sake of simplicity.

Figure 25A:
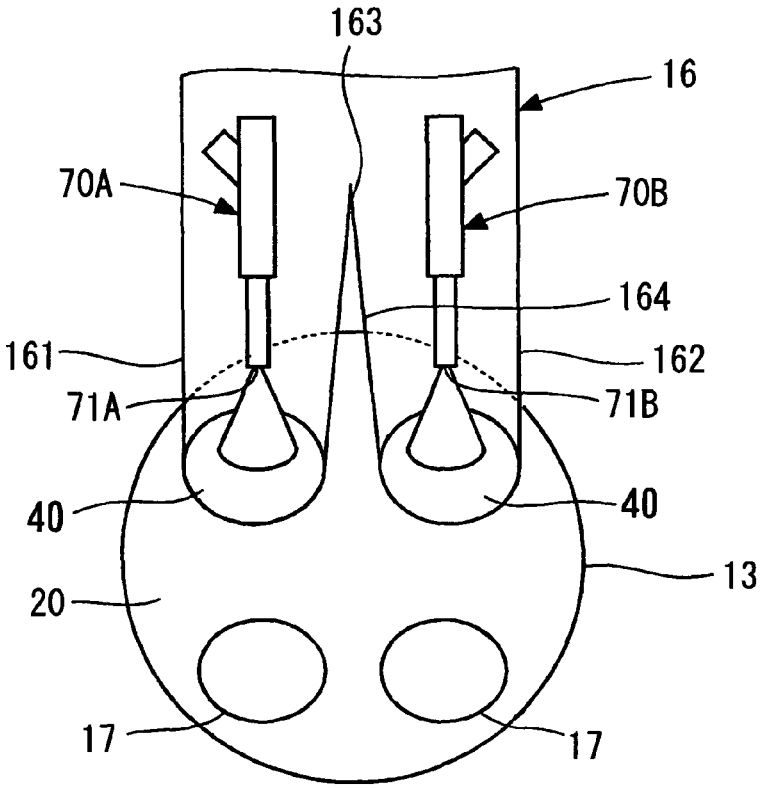
FIG. 25(A) is a schematic view illustrating the structure of a main portion of an internal combustion engine which incorporates a fuel injection system according to a tenth embodiment of the present invention, FIG. 25(B) being a schematic diagram illustrating the drive timing of each fuel injection valve in FIG. 25(A)
Figure 25B:
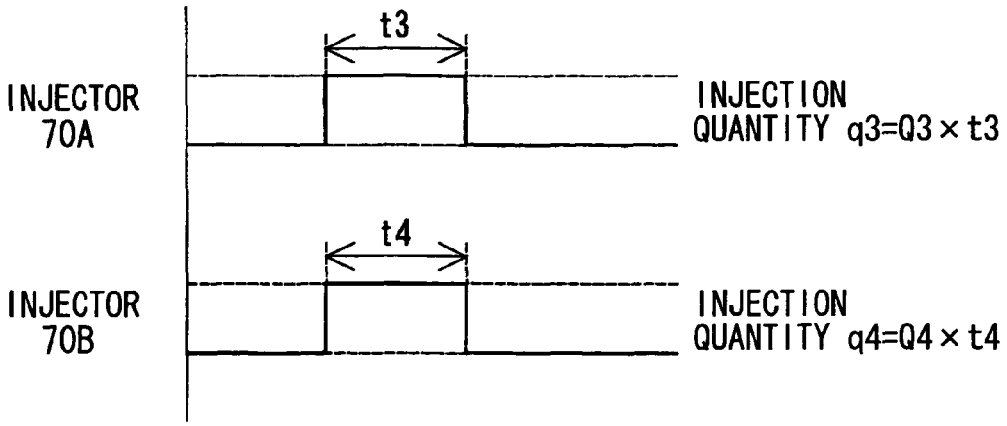

In the tenth embodiment, the structure of the engine 10 is generally the same as that of the ninth embodiment. In the tenth embodiment, as shown in FIG. 25(B), the fuel injection characteristic of the fuel injection valve 70A is different from the fuel injection characteristic of the fuel injection valve 70B. Specifically, the injection quantity of fuel injected from the fuel injection valve 70A per unit time is different from the injection quantity of fuel injected from the fuel injection valve 70B per unit time. The fuel injection valves 70A, 70B have the different injection quantities of fuel per unit time due to, for example, a difference in the size and/or the number of the injection holes 71A, 71B. In the tenth embodiment, the injection quantity of fuel injected from the fuel injection valve 70A per unit time is denoted as Q3, and the injection quantity of fuel injected from the fuel injection valve 70B per unit time is denoted as Q4.

In the tenth embodiment, two intake ports 161, 162 are communicated with the one combustion chamber 20. Here, there may be set the intake port 161, which has the large flow quantity of the intake air and serve as a main intake port, and the intake port 162, which has the small flow quantity of the intake air and serves as a sub intake port. The fuel injection valve 70A, which is placed in the main intake port 161, has the large injection quantity Q3 of fuel per unit time. In contrast, the fuel injection valve 70B, which is placed in the sub intake port 162, has the small injection quantity Q4 of fuel per unit time. That is, the relation of Q3>Q4 exists.

As shown in FIG. 25(B), the drive time period t3 of the fuel injection valve 70A is set to be generally the same as the drive time period t4 of the fuel injection valve 70B by the controller 2. In this way, the injection quantity q3 of fuel from the fuel injection valve 70A is expressed as q3=Q3×t3. Also, the injection quantity q4 of fuel from the fuel injection valve 70B is expressed as q4=Q4×t4. At this time, a relation of q3>q4 is established due to the relation of Q3>Q4 regardless of the relation of t3=t4. Thus, the injection quantities q3, q4 of fuel from the fuel injection valves 70A, 70B are set according to the flow quantities of the intake air in the intake ports 161, 162. Thereby, the amount of uncombusted HC discharged from the engine 10 is reduced, and the fuel consumption of the engine 10 is improved.

Furthermore, according to the tenth embodiment, the fuel injection valves 70A, 70B, which show the different fuel injection characteristics, are used, and the injection quantities q3, q4 of fuel from the fuel injection valves 70A, 70B are controlled by injecting the fuel while setting the drive time period t3 and the drive time period t4 at the same value. Thus, the injection quantity of fuel can be controlled in a reliable and accurate manner with the simple structure.

Here, the ninth embodiment and the tenth embodiment may be combined. Specifically, the fuel injection quantities q3, q4 may be controlled by changing the injection quantity Q3 of fuel injected from the fuel injection valve 70A relative to the injection quantity Q4 of fuel injected from the fuel injection valve 70B per unit time, and also by changing the drive time period t3 of the fuel injection valve 70A relative to the drive time period t4 of the fuel injection valve 70B.

An engine system, in which a fuel injection system according to an eleventh embodiment of the present invention is applied, will be described. In the following description, components similar to those of the ninth embodiment will be indicated by the same numerals and will not be described further for the sake of simplicity.

Figure 26:
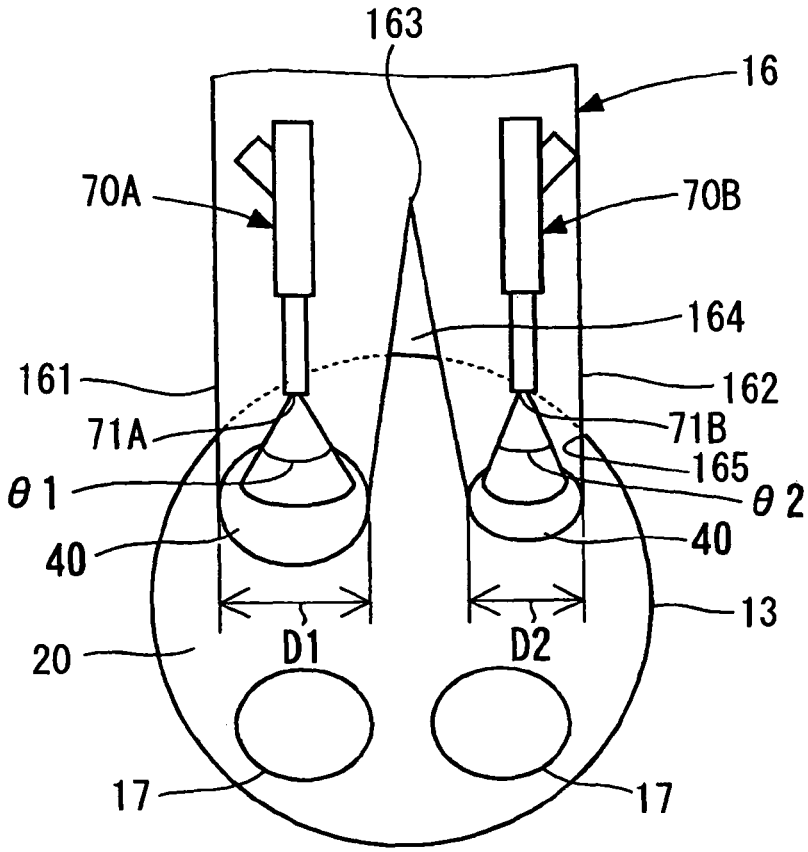
FIG. 26 is a schematic view illustrating the structure of a main portion of an internal combustion engine which incorporates a fuel injection system according to an eleventh embodiment of the present invention.

In the eleventh embodiment, as shown in FIG. 26, there is a difference in the inner diameter between the two intake ports 161, 162, which are communicated with the one combustion chamber 20. Specifically, the inner diameter D1 of the intake port 161 is larger than the inner diameter D2 of the intake port 162. In this case, when the injection angle θ1 of the fuel injected from the fuel injection valve (second fuel injection valve) 70A is the same as the injection angle θ2 of the fuel injected from the fuel injection valve (first fuel injection valve) 70B, the fuel mist, which is injected from the fuel injection valve 70B in the intake port 162 of the small inner diameter, may possibly adhere to the wall surface 165 of the intake port 162. When the fuel mist, which is injected from the fuel injection valve 70B, adheres to the wall surface 165 of the intake port 162, the adhered fuel becomes the fuel droplets and flows into the combustion chamber 20 along the wall surface 165. As a result, the combustion of the fuel in the combustion chamber 20 may possibly become incomplete.

Therefore, according to the eleventh embodiment, the injection angle θ1 of the fuel injection valve 70A and the injection angle θ2 of the fuel injection valve 70B are set based on the inner diameters of the intake ports 161, 162. In this way, the fuel injection valve 70A, which is placed in the intake port 161 of the large inner diameter, forms the fuel mist at the large injection angle θ1, and the fuel injection valve 70B, which is placed in the intake port 162 of the small inner diameter, forms the fuel mist at the small injection angle θ2. Thereby, it is possible to limit the adhesion of the fuel, which is injected from the fuel injection valves 70A, 70B, to the wall surface, which forms the intake ports 161, 162. As a result, the amount of uncombusted HC discharged from the engine 10 is reduced, and the fuel consumption of the engine 10 is improved.

An engine system, in which a fuel injection system according to a twelfth embodiment of the present invention is applied, will be described. The structure of the fuel injection system of the twelfth embodiment is generally the same as those of the ninth to eleventh embodiments and therefore will not be described in detail, and only the fuel injection control operation of the twelfth embodiment will be described below.

In the twelfth embodiment, the injection quantity and the injection time period of the fuel injection valve 70A are different from those of the fuel injection valve 70B. The injection quantity of fuel injected from the fuel injection valve 70A per unit time is set to be larger than that of the fuel injection valve 70B. In this way, for example, in the state right after the starting of the engine 10, the controller 2 executes the fuel injection from the fuel injection valve 70B, which has the small injection quantity per unit time. In the state right after the starting of the engine 10, the fuel is injected from the fuel injection valve 70B during a time period between closing of the intake ports 161, 162 by the intake valves 40 and reopening of the intake ports 161, 162 by the intake valves 40. Thus, the time period between the closing of the intake ports 161, 162 by the intake valves 40 and the reopening of the intake ports 161, 162 is relatively long. As a result, the fuel is injected for the relatively long time period from the fuel injection valve 70B, which has the small injection quantity per unit time. In this way, the atomization of the fuel is promoted, and the required quantity of fuel is provided.

In contrast, in the state where the load of the engine 10 is large, for example, at the WOT state, the controller 2 executes the fuel injection from the fuel injection valve 70A, which has the large injection quantity per unit time. For example, in the state where the load of the engine 10 is large, the fuel is injected from the fuel injection valve 70A during the time period of opening the intake ports 161, 162 by the intake valves 40. Thus, the time period of opening the intake ports 161, 162 by the intake valves 40, i.e., the injection time period of the fuel from the fuel injection valve 70A is short. As a result, the fuel is injected for the relatively short time period from the fuel injection valve 70A, which has the large injection quantity per unit time. In this way, the fuel, which is injected from the fuel injection valve 70A, flows directly into the combustion chamber 20 and lowers the temperature of the combustion chamber 20. Furthermore, when the injection quantity of fuel per unit time is made large, the required quantity of fuel is provided.

As discussed above, in the twelfth embodiment, the injection quantity of fuel per unit time of the fuel injection valve 70A differs from that of the fuel injection valve 70B. The controller 2 controls the injection time period of the fuel from the fuel injection valve 70A and the injection time period of the fuel from the fuel injection valve 70B such that the fuel is injected for the long time period from the fuel injection valve 70B, which has the low injection quantity per unit time, for example, in the state right after the starting of the engine 10 where the time elapsed since the starting of the engine 10 is short, and thereby the temperature of the engine 10 is low, or the engine 10 is in the idling state. In contrast, the controller 2 executes the fuel injection for the short time period from the fuel injection valve 70A, which has the large injection quantity per unit time, in the state where the load of the engine 10 is large, such as in the WOT state. Therefore, it is possible to achieve both of the reduction of the HC at the time of starting the engine in the low load state, such as the idling state, and the improvement of the output of the engine at the time of the high load.

An engine system, in which a fuel injection system according to a thirteenth embodiment of the present invention is applied, will be described. The structure of the fuel injection system of the thirteenth embodiment is generally the same as those of the ninth to eleventh embodiments and therefore will not be described in detail, and only the fuel injection control operation of the thirteenth embodiment will be described below.

In the thirteenth embodiment, the number of fuel injections per unit time is controlled for each of the fuel injection valves 70A, 706. In the case of the engine 10, which has the multiple intake valves 40, like in the thirteenth embodiment, a small quantity of air may be supplied into the combustion chamber 20 by opening and closing at least one of the intake valves 40 after closing of the intake valves 40 in the low load state of the engine 10. In this way, the air flow in the combustion chamber 20 is increased, and the combustion in the combustion chamber 20 is improved, thereby improving the fuel consumption. However, in the case where at least one of the intake valves 40 is opened and closed, when the fuel is injected from one of the fuel injection valves, the fuel also flows toward the closed intake valve 40. Thus, the fuel remains in the interior of the intake port 161, 162, which is closed by the intake valve 40. Then, when the intake valve 40 is opened, this remaining fuel in the liquid state is directly supplied into the combustion chamber.

Therefore, in the thirteenth embodiment, the number of fuel injections per unit time is controlled for each of the fuel injection valves 70A, 70B. For example, there is a difference between the number of fuel injections from the fuel injection valve 70A and the number of fuel injections from the fuel injection valve 70B during the time period from the time of opening and closing the two intake valves 40 and the time of opening and closing one of the two intake valves 40 once again. Thus, when the one of the intake valves 40 is opened and closed once again, the fuel is not injected into the closed one of the intake ports 161, 162. As a result, the fuel, which remains in the closed one of the intake ports 161, 162 having the closed intake valve 40, is reduced. In this way, it is possible to reduce the inflow of the fuel in the liquid state into the combustion chamber 20. Thus, it is possible to achieve both of the improvement of the fuel consumption and the reduction of the amount of HC discharged from the engine.

An engine system, in which a fuel injection system according to a fourteenth embodiment of the present invention is applied, will be described. In the following description, components similar to those of the ninth embodiment will be indicated by the same numerals and will not be described further for the sake of simplicity.

Figure 27:
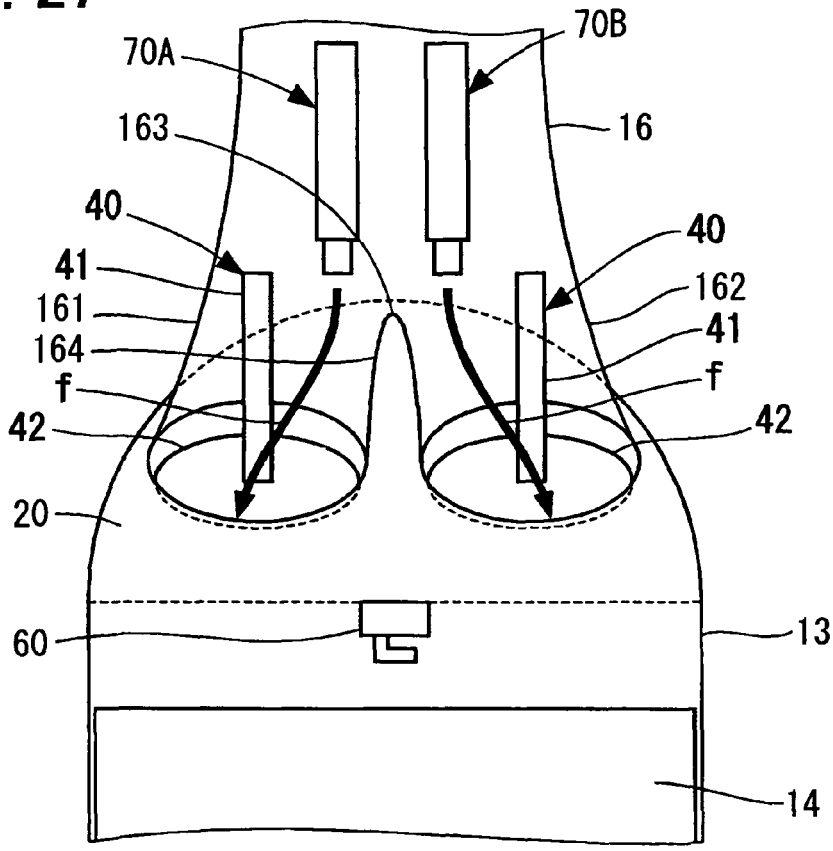
FIG. 27 is a schematic view illustrating the structure of a main portion of an internal combustion engine which incorporates a fuel injection system according to a twelfth embodiment of the present invention.

In the ninth to eleventh embodiments, the fuel injection valve 70A is placed in the intake port 161, and the fuel injection valve 70B is placed in the intake port 162, and each of the fuel injection valves is placed on the combustion chamber 20 side of the branching portion 163 for branching to the two intake ports 161, 162. Alternatively, as shown in FIG. 27, two fuel injection valves 70A, 70B may be placed on the opposite side of the branching portion 163, which is opposite from the combustion chamber 20. Specifically, as discussed in the ninth to eleventh embodiments, the fuel injection valves 70A, 70B may be placed closer to the intake valve 40 at the location on the combustion chamber 20 side of the branching portion 163 or may be placed further away from the intake valve 40 at the location on the opposite side of the branching portion 163, which is opposite from the combustion chamber 20.

In the fourteenth embodiment, the intake air, which flows in the intake port 16, is separated at the branching portion 163 into the flow to the intake port 161 and the flow to the intake port 162. Accordingly, the intake air, which flows from the intake port 16 into the respective branch ports 161, 162, flows from the center side to the radially outer side in the cylinder 13, i.e., flows toward the inner peripheral wall 13*a* of the cylinder block 11, which forms the cylinder 13. Accordingly, the fuel mist, which is injected from each fuel injection valve 70A, 70B, is carried along the intake air flow, which is indicated by an arrow f.

In the fourteenth embodiment, each of the fuel injection valves 70A, 70B is placed on the radially inner side of the center axis of the corresponding intake valve 40. Accordingly, even when the fuel mist, which is injected from each of the fuel injection valves 70A, 70B, is carried along the intake air flow, which is indicated by an arrow f, the fuel mist flows into the combustion chamber 20 at the location near the center of the corresponding intake port 161, 162, i.e., near the center of the valve portion 42 of the corresponding intake valve 40. In this way, even in the case where the intake air flows from the intake port 16 to the ports 161, 162, adhesion of the fuel to the inner peripheral wall 231 of the cylinder block 11, which forms the cylinder 13, is reduced.

The fuel, which adheres to the inner peripheral wall 231 of the cylinder block 11, is kept in the liquid state and remains in the combustion chamber 20, so that such fuel does not contribute to the combustion and causes the incomplete combustion and the deterioration of the fuel consumption. In contrast, in the fourteenth embodiment, although each of the fuel injection valves 70A, 70B is placed further away from the corresponding intake valve 40, the adhesion of the fuel to the inner peripheral wall 231 of the cylinder block 11 is reduced, so that the fuel, which does not contribute to the combustion, is reduced. Accordingly, it is possible to reduce the incomplete combustion of the fuel, which is injected from the fuel injection valves 70A, 70B. As a result, it is possible to reduce the amount of uncombusted fuel discharged from the engine 10. Thereby, it is possible to reduce the amount of uncombusted HC discharged from the engine 10. Furthermore, the fuel, which is injected from the fuel injection valves 70A, 70B, is effectively combusted without becoming fuel droplets. Thus, at the time of demanding a predetermined output to the engine 10, the amount of fuel, which needs to be injected from the fuel injection valves 70A, 70B, can be reduced. Thus, the fuel consumption can be improved.

An engine system, in which a fuel injection system according to a fifteenth embodiment of the present invention is applied, will be described. In the fuel injection system of the fifteenth embodiment, two or more fuel injection valves 70A, 70B have different injection angles. The injection angle of the first fuel injection valve 70A is set based on the inner diameter of the intake port 161, and the injection angle of the second fuel injection valve 70B is set to be larger than the injection angle of the first fuel injection valve 70A. The remaining structure of the fuel injection system of the fifteenth embodiment other than this feature is the same as that of the ninth to eleventh embodiments and thereby will not be described further, and only the fuel injection control operation will be described below.

In the fifteenth embodiment, in the case where the fuel is injected in the closed state of the intake valves 40, the injection quantity of fuel from the first fuel injection valve 70A is controlled to be larger than the injection quantity of fuel from the second fuel injection valve 70B. Furthermore, in the case where the fuel is injected in the open state of the intake valves 40, the injection quantity of fuel from the second fuel injection valve 70B is controlled to be larger than the injection quantity of fuel from the first fuel injection valve 70A.

In the engine, which has the two intake valves 40, at the time of starting the engine and at the time of low load state of the engine, the fuel is injected in the closed state of the intake valves 40. At that time, the fuel is mainly injected from the first fuel injection valve 70A, the injection angle of which is set based on the inner diameter of the intake port, so that the adhesion of the fuel to the wall surface of the intake port is reduced, and the inflow of the fuel in the liquid state into the combustion chamber is reduced. Thus, the deterioration of the fuel consumption of the engine can be limited, and the amount of uncombusted HC discharged from the engine can be reduced. Furthermore, in the high load state of the engine, the fuel is injected in the open state of the intake valves 40. At that time, the intake air flow is generated in the intake ports, and the injected fuel is carried by this intake air flow into the cylinder. Thus, even when the fuel is injected at the angle equal to or larger than the injection angle that is set based on the inner diameter of the intake port, the adhesion of the fuel to the wall surface of the intake ports is reduced. When the injection angle is increased, the interference between the fuel mists can be reduced. Thus, the atomization of the fuel is promoted. As a result, the intake air cooling effect can be obtained, and the flow quantity of the intake air is increased. Thereby, the output of the engine can be improved. Accordingly, in the case of injecting the fuel in the open state of the intake valves 40, when the fuel is injected mainly from the second fuel injection valve 70B that has the larger injection angle in comparison to the first fuel injection valve 70A, the injection angle of which is set based on the inner diameter of the corresponding intake port, it is possible to reduce the deterioration of the fuel consumption of the engine and the amount of uncombusted HC discharged from the engine and to increase the output of the engine.

An engine system, in which a fuel injection system according to a sixteenth embodiment of the present invention is applied, will be described. The engine system of the sixteenth embodiment is that the injection timing of fuel is controlled in the engine system of the fourteenth embodiment.

Figure 28:
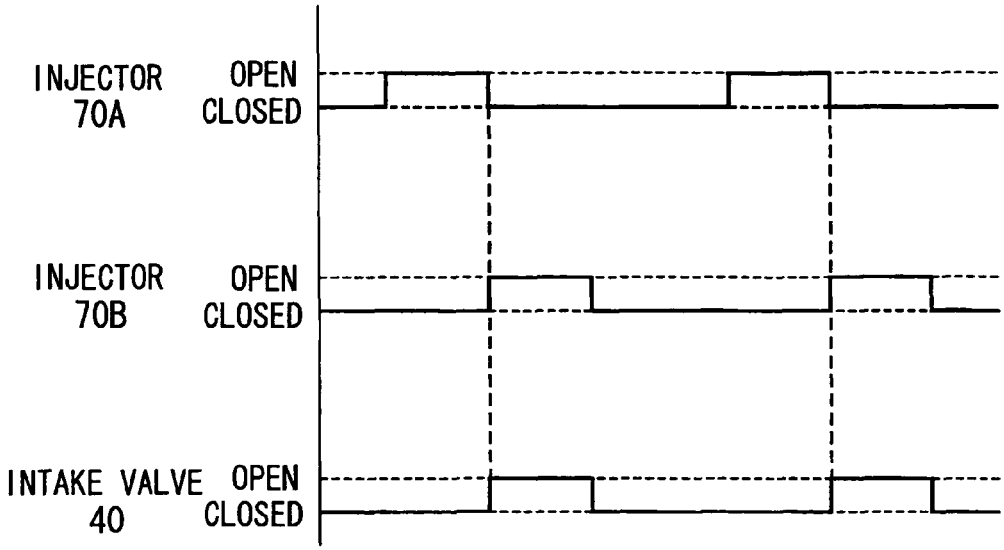
FIG. 28 is a timing chart showing the drive timing of each fuel injection valve and intake valve in an internal combustion engine which incorporates a fuel injection system according to a fifteenth embodiment of the present invention.

Similar to the ninth embodiment, the engine system 1 of the sixteenth embodiment shown in FIG. 28 includes a controller 2. The controller 2 outputs a drive signal to the respective fuel injection valves 70A, 70B to control the timing of fuel injection at the respective fuel injection valves. The controller 2 is connected to the lift sensors 6, the igniter 60, the rotational speed sensor 5, the throttle sensor 3 and the coolant temperature sensor 4. The controller 2 constitutes an injection timing control means of the accompanying claims.

In the sixteenth embodiment, the fuel injection valve 70A serves as the early stage fuel injection valve, and the fuel injection valve 70B serves as the late stage fuel injection valve. The controller 2 sets the injection timing of the fuel injection valve 70A, which is the early stage fuel injection valve, to the timing before occurrence of the lifting of the corresponding intake valve 40. Specifically, the fuel is injected from the fuel injection valve 70A before the occurrence of the lifting of the intake valve 40. In this way, the fuel, which is injected from the fuel injection valve 70A, is drawn into the combustion chamber 20 along with the intake air upon the lifting of the intake valve 40. In contrast, the controller 2 sets the injection timing of the fuel injection valve 70B to the timing after the starting of the fuel injection from the fuel injection valve 70A. Specifically, the fuel injection of the fuel injection valve 70B is started after the starting of the fuel injection from the fuel injection valve 70A.

As shown in FIG. 28, when the fuel injection from the fuel injection valve 70A is started, the fuel is not yet injected from the fuel injection valve 70B. Furthermore, at this time, each of the intake valves 40 closes the connection between the corresponding intake port 161, 162 and the combustion chamber 20. Thus, the air-fuel mixture is generated in the intake port 161 by the fuel injected from the fuel injection valve 70A. Then, when the injection of the fuel from the fuel injection valve 70A is terminated, the intake valve 40 opens the corresponding intake port 161. In this way, the air-fuel mixture generated in the intake port 161 flows into the combustion chamber 20 upon the opening of the intake valve 40. Simultaneously with this, the controller 2 starts the injection of fuel from the fuel injection valve 70B.

In the interior of the intake port 161, the fuel is injected from the fuel injection valve 70A. Thus, the pressure in the intake port 161 is larger than the pressure in the intake port 162. Therefore, when the intake valves 40 of the intake ports 161, 162 are opened, the air-fuel mixture discharged from the intake port 161, which has the higher pressure, creates the stronger flow in the combustion chamber 20 in comparison to that of the air-fuel mixture discharged from the intake port 162. Therefore, in the interior of the combustion chamber 20, a swirl flow is created by the pressure difference. As a result, the fuel mist, which has the high fuel concentration supplied from the intake port 161 into the combustion chamber 20, is formed at the location for example, adjacent to the igniter 60.

As described above, the controller 2 starts the injection of fuel from the fuel injection valve 70B after the starting of the injection of fuel from the fuel injection valve 70A. Thus, the amount of fuel, which is required to achieve the output of the engine 10, is provided by the fuel injected from the fuel injection valves 70A, 70B. As a result, for example, when the engine 10 is in the idling state, the air-fuel mixture of the high fuel concentration is formed around the igniter 60 with the small amount of fuel. Therefore, even when the amount of air-fuel mixture, which is drawn into the combustion chamber 20, is small, the stable combustion can be achieved with the small amount of fuel. Thereby, the fuel consumption can be improved, and the amount of uncombusted HC discharged from the engine can be reduced.

Figure 29:
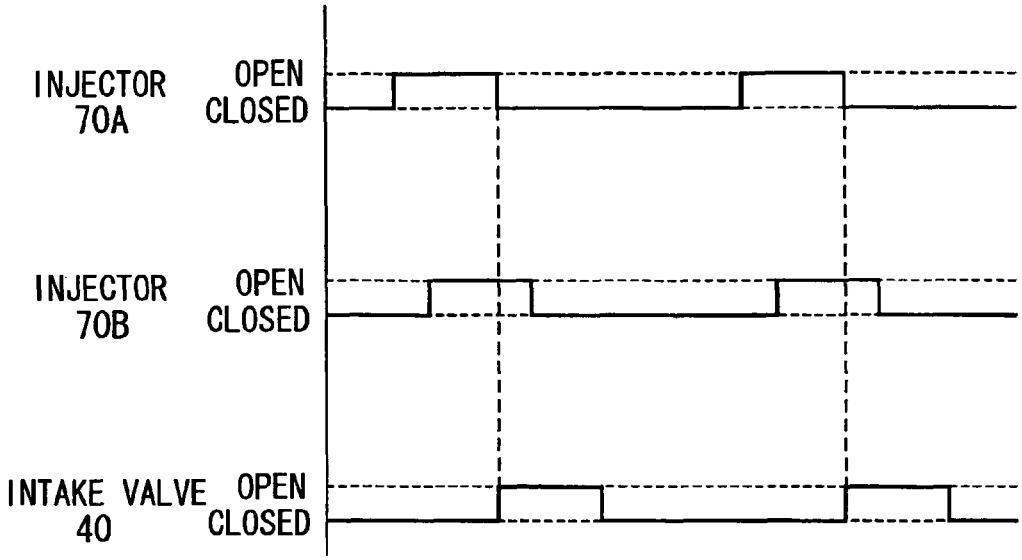
FIG. 29 is a schematic diagram illustrating the drive timing of each fuel injection valve and intake valve in an internal combustion engine which incorporates a fuel injection system according to a modified example of the fifteenth embodiment of the present invention.

In the sixteenth embodiment, there is described the exemplary case where the injection of the fuel from the fuel injection valve 70B is started after the termination of the injection of the fuel from the fuel injection valve 70A, as shown in FIG. 28. Alternatively, as shown in FIG. 29, the injection of fuel from the fuel injection valve 70B may be started during a period between the starting of the injection of fuel from the fuel injection valve 70A and the terminating of the injection of fuel from the fuel injection valve 70A.

In the ninth to sixteenth embodiments, there are described the exemplary cases where the flow quantity of the intake air at the respective intake ports 161, 162 is sensed based on the amount of the lift of the respective intake valves 40. Alternatively, intake air flow quantity sensors may be provided to the intake ports 161, 162, respectively, to measure the flow quantity of the intake air at the respective intake ports 161, 162 and thereby to control the injection quantity of fuel from the respective fuel injection valves 70A, 70B.

Also, in the ninth to sixteenth embodiments, the respective embodiments are applied individually. Alternatively, some of the embodiments may be combined in any appropriate manner. For example, the placement of the fuel injection valves 70A, 70B described in the fourteenth embodiment may be combined with the control operation for controlling the injection quantity of fuel described in any of the ninth to thirteenth embodiments and the fifteenth embodiment. Furthermore, the placement of the fuel injection valves 70A, 70B described in any one of the ninth to thirteenth embodiments may be combined with the control operation for controlling the injection timing of the fuel described in the sixteenth embodiment.

Furthermore, the eleventh embodiment of FIG. 26 may be implemented as follows. Specifically, the injection quantities of the first fuel injection valve 70B (having the injection angle $\theta 2$) and of the second fuel injection valve 70A (having the injection angle $\theta 1$ that is larger than the injection angle $\theta 2$) of FIG. 26 may be controlled such that an injection quantity of fuel from the first fuel injection valve 70B is larger than an injection quantity of fuel from the second fuel injection valve 70A at all times of injecting fuel in a closed state of the two or more intake valves 40. Also, the injection quantities of the first fuel injection valve 70B and of the second fuel injection valve 70A may be controlled such that the injection quantity of fuel from the second fuel injection valve 70A is larger than the injection quantity of fuel from the first fuel injection valve 70B at all times of injecting fuel in an open state of the two or more intake valves 40.

The above description of the present invention merely indicates the examples. Thus, modifications of the above embodiments within the purpose of the present invention should be included in the present invention. Such modifications do not deviate from the intention and scope of the present invention.

What is claimed is:

1. A fuel injection system comprising:

two or more intake ports that are communicated with a combustion chamber;

two or more intake valves, each of which is placed in an end portion of a corresponding one of the two or more intake ports to open and close a connection between the corresponding intake port and the combustion chamber;

two or more fuel injection valves, each of which is placed in a corresponding one of the two or more intake ports to inject fuel into intake air that flows in the corresponding intake port; and an injection quantity control means for controlling an injection quantity of fuel at each of the two or more fuel injection valves, wherein:

the total number of the two or more fuel injection valves is the same as the total number of the two or more intake valves;

the two or more fuel injection valves have different injection quantities of fuel per unit time, respectively;

the injection quantity control means controls injection start timing and injection end timing of each of the two or more fuel injection valves based on an operational state of the internal combustion engine;

the injection quantity control means executes injection of fuel from one of the two or more fuel injection valves, which has a small injection quantity of fuel per unit time, while stopping injection of fuel from another one of the two or more fuel injection valves, which has a large injection quantity of fuel per unit time that is larger than the small injection quantity of fuel per unit time, until opening of the two or more intake ports by the two or more intake valves when the following two conditions are satisfied:

time elapsed since starting of the internal combustion engine is still within a predetermined time period; and a temperature of the internal combustion engine is equal to or less than a predetermined value; and the injection quantity control means executes injection of fuel from the another one of the two or more fuel injection valves, which has the large injection quantity of fuel per unit time, during opening of the two or more intake ports by the two or more intake valves when a load of the internal combustion engine is equal to or larger than a predetermined value in a state where the two conditions are not satisfied, such that the time elapsed since the starting of the internal combustion engine is longer than the predetermined time period, and the temperature of the internal combustion engine is greater than the predetermined value.

2. The fuel injection system according to claim 1, wherein the injection quantity control means controls the injection start timing and the injection end timing of each of the two or more fuel injection valves such that the two or more fuel injection valves do not simultaneously start and end the injection of fuel.

3. The fuel injection system according to claim 1, further comprising a monitoring means for monitoring the time elapsed since the starting of the internal combustion engine and the temperature of the internal combustion engine, wherein:

when the monitoring means determines that the two conditions are satisfied based on a result of the monitoring of the monitoring means, the injection quantity control means executes the injection of fuel from the one of the two or more fuel injection valves, which has the small injection quantity of fuel per unit time, while stopping the injection of fuel from the another one of the two or more fuel injection valves, which has the large injection quantity of fuel per unit time, until the opening of the two or more intake ports by the two or more intake valves; and when the monitoring means determines that the two conditions are not satisfied based on the result of the monitoring of the monitoring means, the injection quantity control means executes the injection of fuel from the another one of the two or more fuel injection valves, which has the large injection quantity of fuel per unit time, in addition to the injection of fuel from the one of the two or more fuel injection valves, during the opening of the two or more intake ports by the two or more intake valves when the load of the internal combustion engine is equal to or larger than the predetermined value.

4. The fuel injection system according to claim 1, wherein the injection quantity control means executes injection from the one of the injection valves only when the intake ports are closed, and injection from the another one of the fuel injection valves only during opening of the intake ports.

5. The fuel injection system according to claim 1, wherein the injection quantity control means executes injection of fuel from the another one of the two or more fuel injection valves, which has the large injection quantity of fuel per unit time, while stopping injection of fuel from the one of the two or more fuel injection valves during opening of the two or more intake ports by the two or more intake valves when a load of the internal combustion engine is equal to or larger than a predetermined value in a state where the two conditions are not satisfied, such that the time elapsed since the starting of the internal combustion engine is longer than the predetermined time period, and the temperature of the internal combustion engine is greater than the predetermined value.

6. A fuel injection system comprising:

two or more intake ports that are communicated with a combustion chamber;

two or more intake valves, each of which is placed in an end portion of a corresponding one of the two or more intake ports to open and close a connection between the corresponding intake port and the combustion chamber;

two or more fuel injection valves, each of which is placed in a corresponding one of the two or more intake ports to inject fuel into intake air that flows in the corresponding intake port; and an injection quantity control means for controlling an injection quantity of fuel at each of the two or more fuel injection valves, wherein:

the total number of the two or more fuel injection valves is the same as the total number of the two or more intake valves;

the two or more fuel injection valves include:

a first fuel injection valve that has an injection angle of fuel, which is set based on an inner diameter of the corresponding intake port; and a second fuel injection valve that has an injection angle of fuel, which is larger than the injection angle of the first fuel injection valve;

the injection quantity control means controls the injection quantities of the first fuel injection valve and of the second fuel injection valve such that an injection quantity of fuel from the first fuel injection valve is larger than an injection quantity of fuel from the second fuel injection valve at all times of injecting fuel in a closed state of the two or more intake valves; and the injection quantity control means controls the injection quantities of the first fuel injection valve and of the second fuel injection valve such that the injection quantity of fuel from the second fuel injection valve is larger than the injection quantity of fuel from the first fuel injection valve at all times of injecting fuel in an open state of the two or more intake valves.

* * * * *